US011306689B2

(12) United States Patent
Yoshioka et al.

(10) Patent No.: US 11,306,689 B2
(45) Date of Patent: Apr. 19, 2022

(54) EGR SYSTEM

(71) Applicant: AISAN KOGYO KABUSHIKI KAISHA, Obu (JP)

(72) Inventors: Mamoru Yoshioka, Nagoya (JP); Kaisho So, Nagoya (JP); Takashi Bessho, Chiryu (JP); Shinji Kawai, Gifu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/177,571

(22) Filed: Feb. 17, 2021

(65) Prior Publication Data

US 2021/0277850 A1 Sep. 9, 2021

(30) Foreign Application Priority Data

Mar. 4, 2020 (JP) ..... JP2020-036675
May 21, 2020 (JP) ..... JP2020-088748
Sep. 3, 2020 (JP) ..... JP2020-148198

(51) Int. Cl.
*F02M 35/10* (2006.01)
*F02M 26/35* (2016.01)
*F02M 26/18* (2016.01)
*F02M 26/22* (2016.01)

(52) U.S. Cl.
CPC ..... *F02M 26/18* (2016.02); *F02M 26/35* (2016.02); *F02M 35/10222* (2013.01); *F02M 35/10268* (2013.01); *F02M 26/22* (2016.02)

(58) Field of Classification Search
CPC ..... F02M 26/11; F02M 26/35; F02M 35/10222; F02M 35/10268; F01N 2240/16
See application file for complete search history.

(56) References Cited

U.S. PATENT DOCUMENTS 6,092,512 A * 7/2000 Ma ..... F02B 47/08 123/568.15
7,829,048 B1 * 11/2010 Gonze ..... B01D 53/9495 423/213.2
8,784,741 B2 * 7/2014 Yoshioka ..... F01N 3/2853 422/177
2006/0196484 A1 * 9/2006 Gill ..... F02M 31/13 123/549

(Continued)

FOREIGN PATENT DOCUMENTS

DE 3048540 A1 * 7/1982 ..... F02M 26/35
EP 3112655 A1 * 1/2017 ..... F02M 35/10268

(Continued)

OTHER PUBLICATIONS

English machine translation of description provided by ESPACENET of JP-58098651-A (Year: 2022).*

*Primary Examiner* — Michael A Kessler
(74) *Attorney, Agent, or Firm* — Oliff PLC

(57) ABSTRACT

An EGR system is configured to allow a part of exhaust gas discharged from an engine to an intake passage to flow as EGR gas to an intake passage through an EGR passage to return to the engine. In the EGR system, a heating film is provided on an inner wall or an outer wall of at least one of the intake passage through which the EGR gas is allowed to flow and the EGR passage. At least a pair of a positive electrode and a negative electrode is provided to energize the heating film.

18 Claims, 34 Drawing Sheets

(56) References Cited

U.S. PATENT DOCUMENTS

| | | | | |
|---|---|---|---|---|
| 2010/0095673 | A1* | 4/2010 | Vigild | F01N 9/00 60/605.2 |
| 2011/0232301 | A1* | 9/2011 | He | F02M 26/35 62/3.2 |
| 2013/0227932 | A1* | 9/2013 | Maione | F02M 35/10 60/273 |
| 2018/0179999 | A1 | 6/2018 | Yoshioka et al. | |
| 2020/0300151 | A1* | 9/2020 | Takase | B01D 46/2462 |
| 2021/0372352 | A1* | 12/2021 | Yoshioka | F02M 26/35 |

FOREIGN PATENT DOCUMENTS

| | | | | |
|---|---|---|---|---|
| JP | 58098651 | A * | 6/1983 | F02M 26/47 |
| JP | 2018-44518 | A | 3/2018 | |
| JP | 2018-105180 | A | 7/2018 | |

* cited by examiner

EGR SYSTEM

CROSS-REFERENCE TO RELATED APPLICATIONS

This application is based on and claims the benefit of priority from the prior Japanese Patent Applications No. 2020-036675 filed on Mar. 4, 2020, No. 2020-088748 filed on May 21, 2020, and No. 2020-148198 filed on Sep. 3, 2020, the entire contents of which are incorporated herein by reference.

BACKGROUND

Technical Field

This disclosure relates to an EGR system configured to allow a part of exhaust gas discharged from an engine to an exhaust passage to flow as EGR gas to an intake passage through an EGR passage to return to the engine.

Related Art

As the above type of technique, there has conventionally been known a technique disclosed in for example Japanese unexamined patent application publication No. 2018-44518 (JP 2018-44518A) (an intake manifold). In this technique, an intake manifold is provided with a gas distribution part for distributing auxiliary gas (EGR gas, PCV gas, etc.) to a plurality of branch pipes for distributing intake air to corresponding cylinders of an engine. Next to this gas distribution part, there is provided a hot water passage part through which hot water warmed through the use of cooling water for the engine. Further, a partition wall between the gas distribution part and the hot water passage part is formed of a material having good thermal conductivity (a resin material that contains carbon powder or an insert-molded metal plate). The gas distribution part is efficiently kept warm by the heat of hot water in the hot water passage part to prevent the generation of condensed water and the freezing thereof in the gas distribution part.

SUMMARY

Technical Problems

In the technique disclosed in JP 2018-44518A, however, even though the partition wall located between the gas distribution part and the hot water passage is formed of the material having a good thermal conductivity, the temperature of the hot water depends on a warm-up state of the engine and therefore it is difficult to increase the inside temperature of the gas distribution part with good responsivity and stably keep the inside temperature of the same.

The present disclosure has been made to address the above problems and has a purpose to provide an EGR system capable of increasing the temperature of the inner wall of at least one of an intake passage through which the EGR gas is allowed to flow and an EGR passage with good responsivity and stably keeping the temperature of the inner wall.

Means of Solving the Problems

To achieve the above-mentioned purpose, one aspect of the present disclosure provides an EGR system configured to allow a part of exhaust gas discharged from an engine to an exhaust passage to flow as an EGR gas to an intake passage through an EGR passage to return to the engine, wherein each of the intake passage through which the EGR gas is allowed to flow and the EGR passage includes an inner wall and an outer wall, the inner wall or the outer wall of at least one of the intake passage through which the EGR gas is allowed to flow and the EGR passage is provided with a heating film, and the EGR system further includes at least one pair of a positive electrode and a negative electrode to energize the heating film.

According to the above configuration, the temperature of the inner wall of at least one of the intake passage and the EGR passage, through each of which EGR gas flows, can be increased with good responsivity and kept stably.

DETAILED DESCRIPTION OF THE EXEMPLARY EMBODIMENTS

A detailed description of several embodiments of an EGR system, embodied as a gasoline engine system, will now be given.

First Embodiment

A first embodiment will be firstly described in detail with reference to the drawings.

(Engine System)

Figure 1:
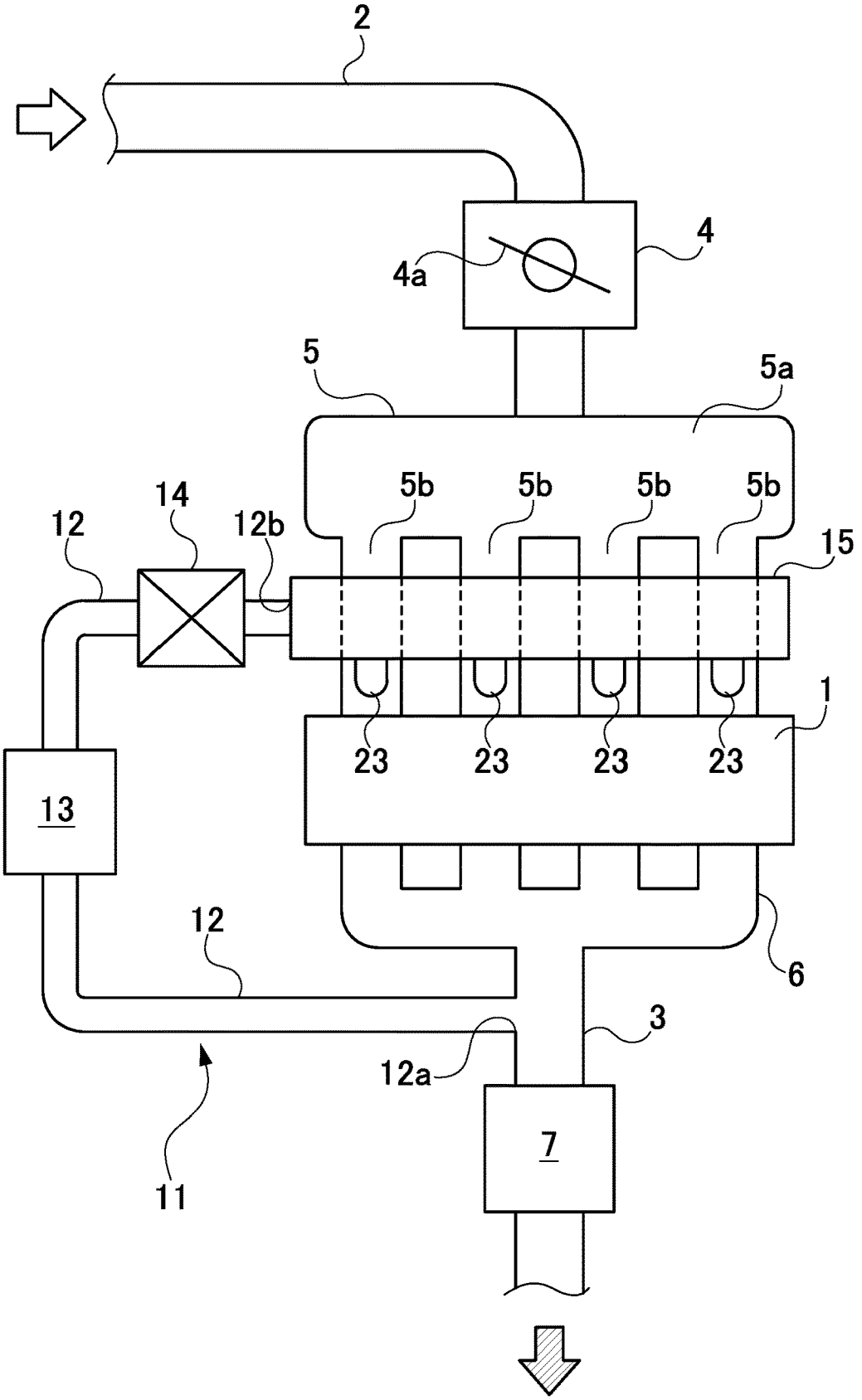
FIG. 1 is a schematic configuration view of an engine system in a first embodiment.

FIG. 1 is a schematic configuration view of a gasoline engine system (hereinafter, simply referred to as an engine system) in the present embodiment. This engine system which is mounted in an automobile includes an engine 1 having a plurality of cylinders. This engine 1 is a 4-cylinder, 4-cycle reciprocating engine, which includes well-known components, such as pistons, crankshafts, and others. The engine 1 is provided with an intake passage 2 for introducing intake air to the cylinders and an exhaust passage 3 for discharging exhaust gas from the cylinders of the engine 1. In the intake passage 2, there are provided a throttle device 4 and an intake manifold 5. In addition, this engine system includes a high-pressure loop exhaust gas recirculation device (EGR device) 11.

The throttle device 4 is placed in the intake passage 2 upstream of the intake manifold 5 and configured to drive a butterfly throttle valve 4*a* to open and close at a variable opening degree in response to the operation of an accelerator by a driver in order to adjust the amount of intake air flowing through the intake passage 2. The intake manifold 5 is mainly made of resin material and placed on the intake passage 2 just upstream of the engine 1. This intake manifold 5 includes a single surge tank 5*a* into which intake air is introduced and a plurality of (four) branch pipes 5*b* branched off from the surge tank 5*a* to distribute the intake air introduced in the surge tank 5*a* to each of the cylinders. In the exhaust passage 3, there are provided an exhaust manifold 6 and a catalyst 7 in this order from an upstream side. The catalyst 7 contains for example a three-way catalyst to purify exhaust gas.

The engine 1 is provided with fuel injection devices (not shown) configured to inject fuel in one-to-one correspondence with the cylinders. The fuel injection devices are configured to inject the fuel supplied from a fuel supply device (not shown) to the corresponding cylinders of the engine 1. In each of the cylinders, the fuel injected from the fuel injection device and the intake air introduced from the intake manifold 5 are mixed, forming a combustible air-fuel mixture.

The engine 1 is further provided with ignition devices (not shown) in one-to-one correspondence with the cylinders. The ignition devices are configured to ignite the combustible air-fuel mixture generated in the corresponding cylinders. The combustible air-fuel mixture in each cylinder is exploded and burnt by an igniting action of the ignition devices. The exhaust gas after burning is discharged to the outside through each cylinder, the exhaust manifold 6, and the catalyst 7. At that time, a piston (not shown) in each cylinder moves up and down, thereby rotating a crankshaft (not shown), generating power in the engine 1.

(EGR System)

This EGR system in the present embodiment is provided with an EGR device 11. The EGR device 11 is configured to allow part of exhaust gas discharged from each cylinder of the engine 1 to the exhaust passage 3 to flow as an exhaust gas recirculation gas (EGR gas) to the intake passage 2 to return to each cylinder of the engine 1. The EGR device 11 includes an exhaust gas recirculation passage (an EGR passage) 12, an exhaust gas recirculation cooler (an EGR cooler) 13 to cool EGR gas that flows through the EGR passage 12, an exhaust gas recirculation valve (an EGR valve) 14 to adjust the amount of EGR gas flowing through the EGR passage 12, and an exhaust gas recirculation gas distributor (an EGR gas distributor) 15 to distribute EGR gas to each of branch pipes 5*b* of the intake manifold 5 in order to distribute EGR gas flowing through the EGR passage 12 to each of the cylinders of the engine 1. The EGR passage 12 includes an inlet 12*a* and an outlet 12*b*. The inlet 12*a* of the EGR passage 12 is connected to the exhaust passage 3 upstream of the catalyst 7, while the outlet 12*b* of the EGR passage 12 is connected to the EGR gas distributor 15. In the present embodiment, the EGR gas distributor 15 constitutes a final stage of the EGR passage 12. In this EGR passage 12, the EGR valve 14 is provided downstream of the EGR cooler 13 and the EGR gas distributor 15 is placed downstream of the EGR valve 14.

In this EGR device 11, when the EGR valve 14 is opened, part of the exhaust gas flowing through the exhaust passage 13 is allowed to flow as EGR gas through the EGR passage 12 and is distributed to each branch pipe 5*b* of the intake manifold 5 through the EGR valve 14 and the EGR gas distributor 15, and further distributed to each cylinder of the engine 1 for recirculation.

(EGR Gas Distributor)

Figure 2:
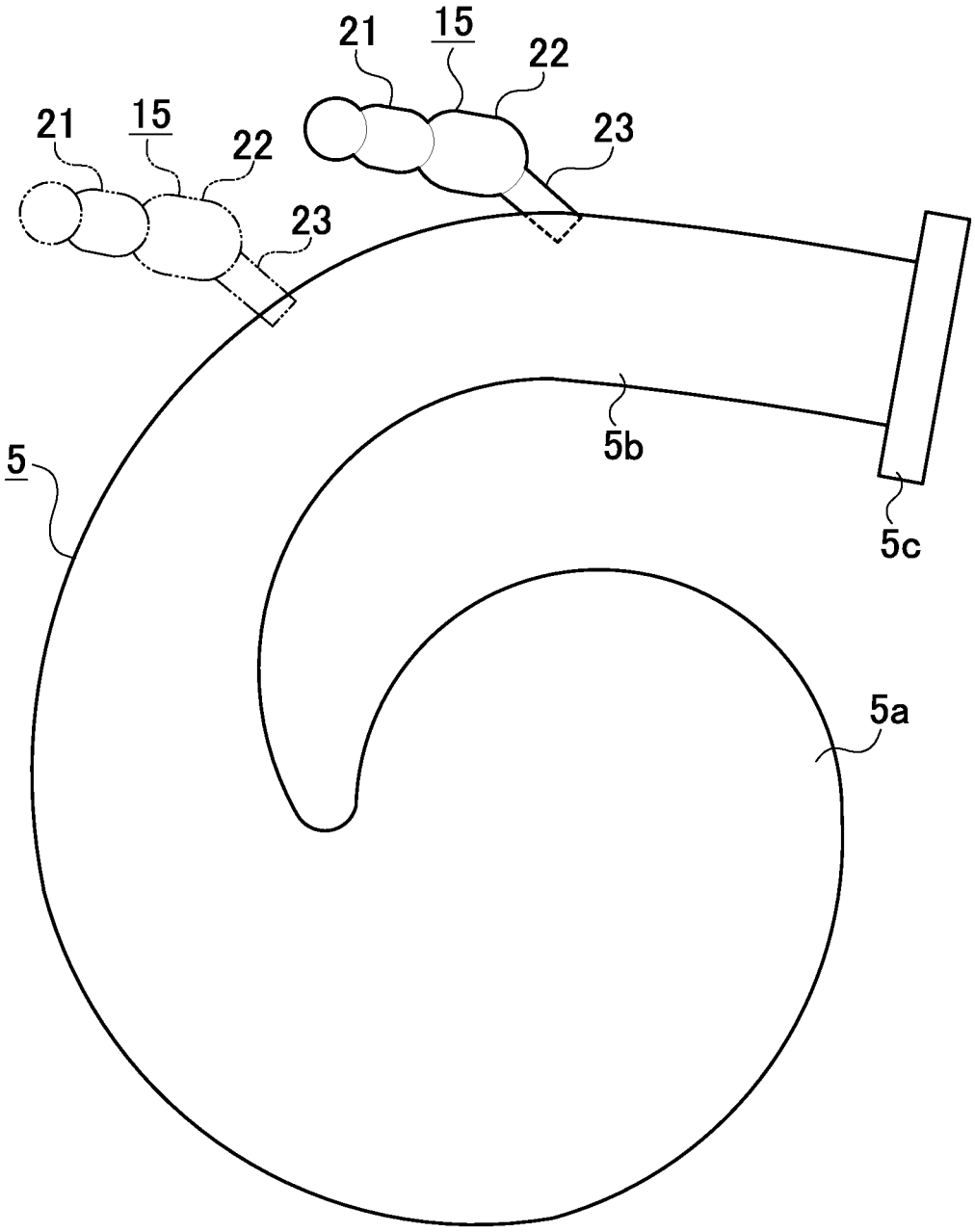
FIG. 2 is a schematic side view of an intake manifold provided with an EGR gas distributor in the first embodiment.

FIG. 2 is a schematic side view of the intake manifold 5 provided with the EGR gas distributor 15. The posture of the intake manifold 5 illustrated in FIG. 2 indicates the state of the intake manifold 5 when attached to the engine 1 in a vehicle so that the top and the bottom of the intake manifold 5 are oriented as shown in FIG. 2. The intake manifold 5 includes, in addition to the surge tank 5*a* and the plurality of branch pipes 5*b* (only one is shown), an outlet flange 5*c* for connection of outlets of the branch pipes 5*b* to the engine 1. In the present embodiment, the EGR gas distributor 15 is provided on the branch pipes 5*b* at positions close to the uppermost portions of the branch pipes 5*b* to distribute EGR gas to each branch pipe 5*b*.

Figure 3:
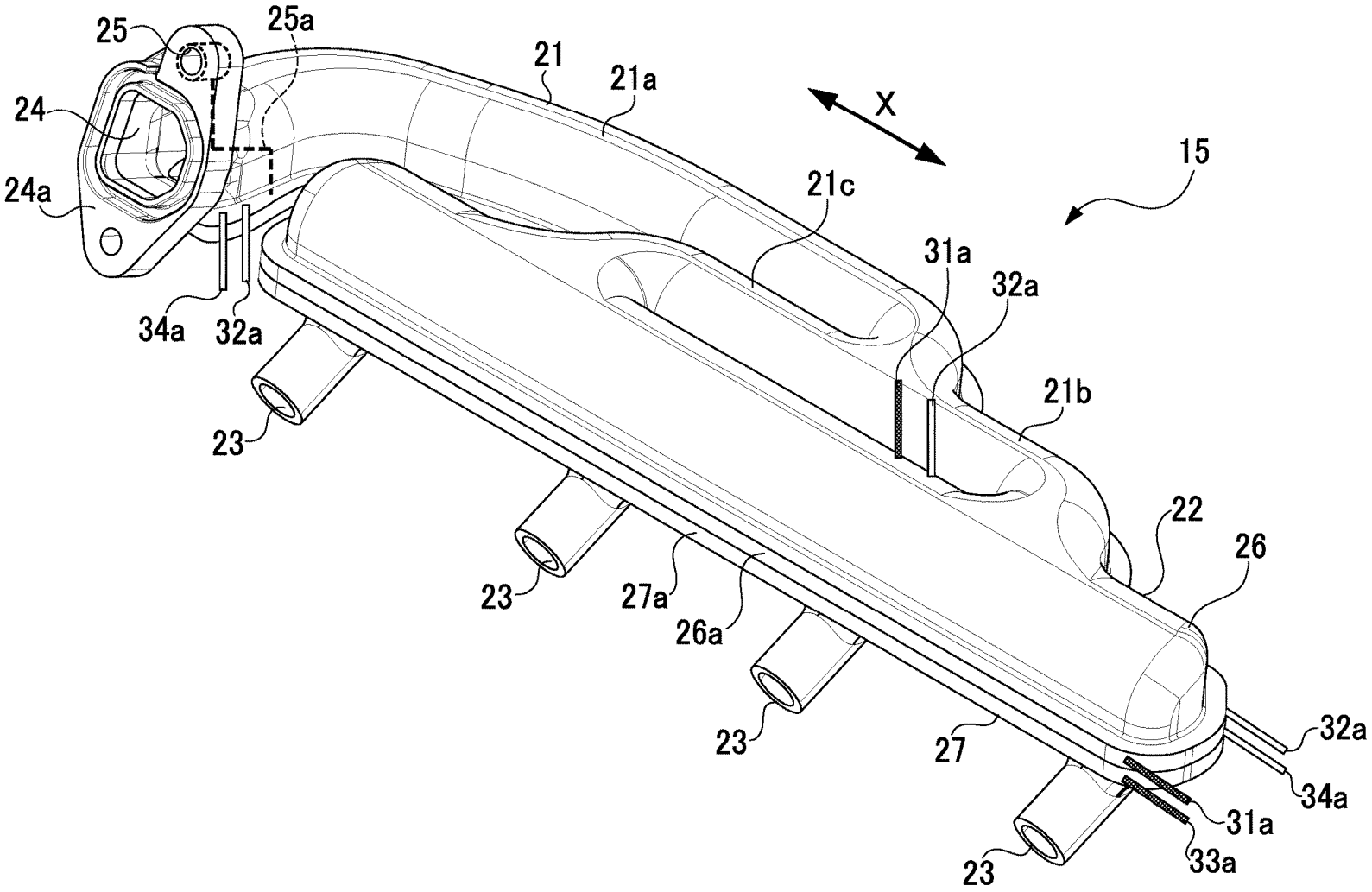
FIG. 3 is a perspective view of the EGR gas distributor seen from the front in the first embodiment.
Figure 4:
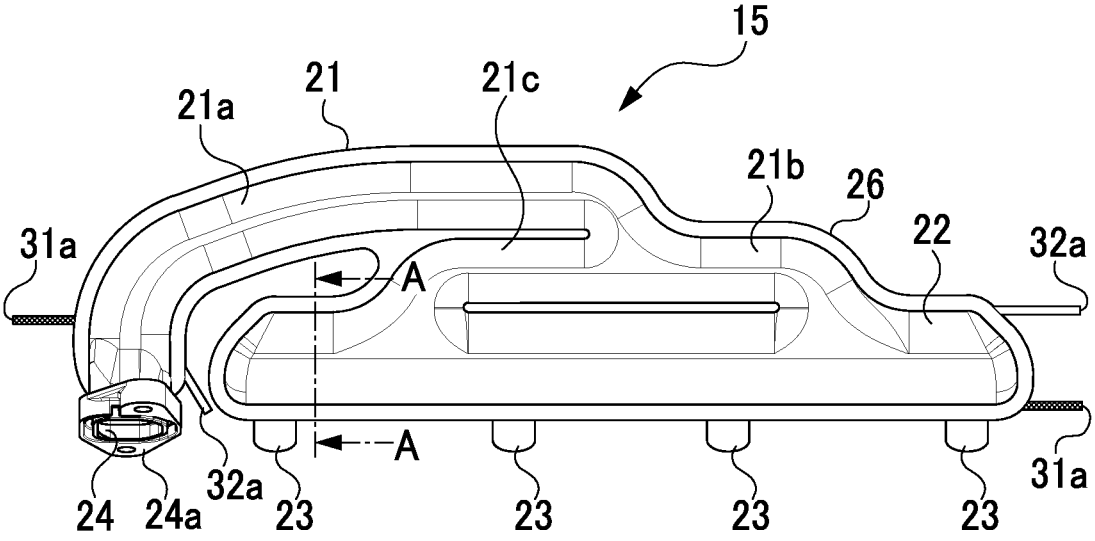
FIG. 4 is a plan view of the EGR gas distributor in the first embodiment.
Figure 5:
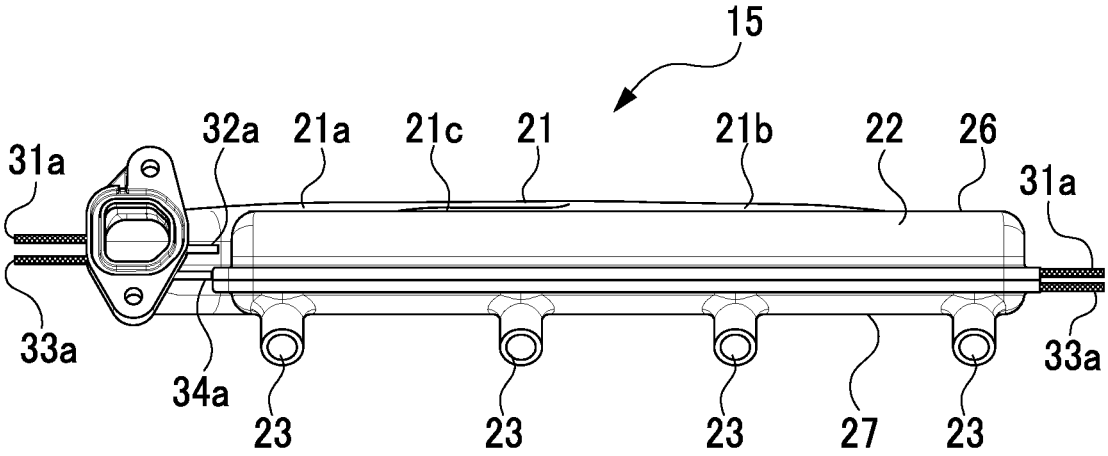
FIG. 5 is a front view of the EGR gas distributor in the first embodiment.
Figure 6:
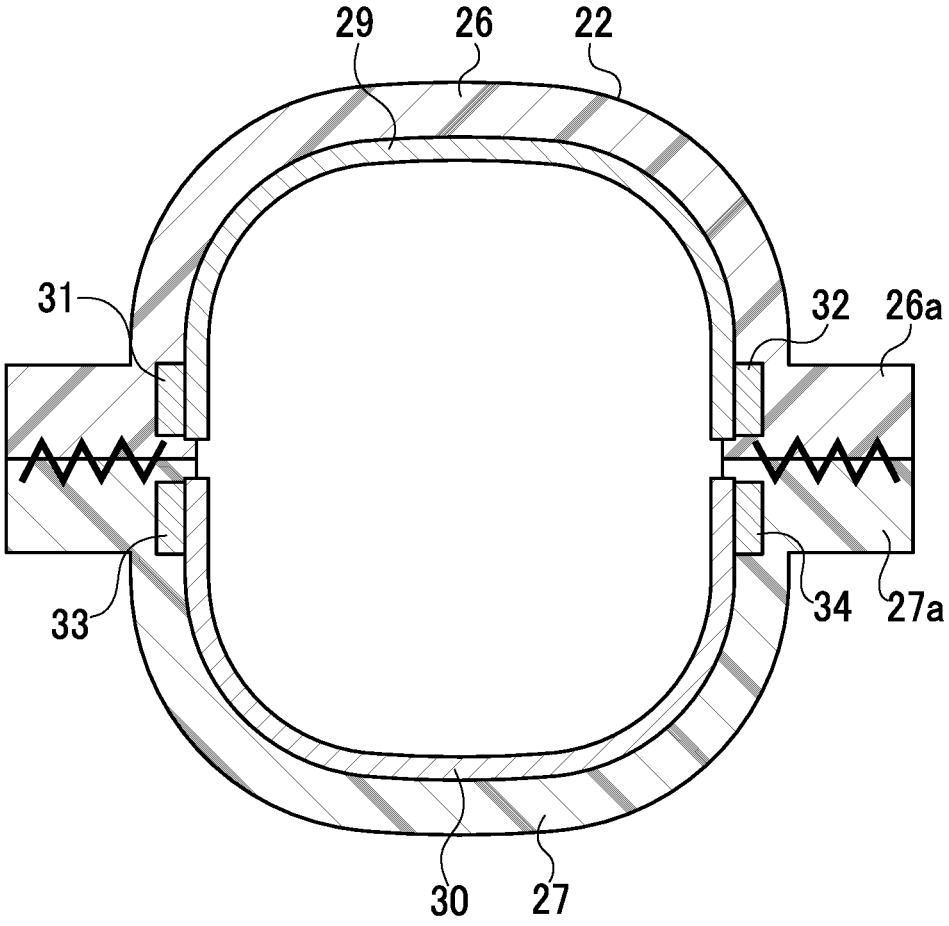
FIG. 6 is a cross-sectional view of a gas chamber of the EGR gas distributor, taken along a line A-A in FIG. 4, in the first embodiment.

FIG. 3 is a perspective view of the EGR gas distributor 15 seen from the front. FIG. 4 is a plan view of the EGR gas distributor 15. FIG. 5 is a front view of the EGR gas distributor 15. FIG. 6 is a cross-sectional view of a gas chamber of the EGR gas distributor 15, taken along a line A-A in FIG. 4. The outer appearances and constructions of the intake manifold 5 and the EGR gas distributor 15 shown in FIGS. 2 to 5 are mere examples of the present disclosure. As shown in FIGS. 3 to 5, the EGR gas distributor 15 is mainly made of resin material and has a laterally long shape and is placed to extend across the plurality of branch pipes 5*b* of the intake manifold 5 in a longitudinal direction X of the EGR gas distributor 15. The EGR gas distributor 15 is produced in advance separately from the intake manifold 5 and thereafter retrofitted onto the intake manifold 5. The EGR gas distributor 15 mainly includes three parts, that is, a gas inflow passage 21 configured to allow EGR gas to be introduced therein, a gas chamber 22 configured to collect EGR gas introduced into the gas inflow passage 21 (the inner diameter of the gas chamber 22 is larger than the inner diameter of the gas inflow passage 21), and a plurality of (four) gas distribution passages 23 branched off from the gas chamber 22 to distribute EGR gas from the gas chamber 22 to the corresponding branch pipes 5*b* (the inner diameter of each gas distribution passage 23 is smaller than the inner diameter of each of the gas inflow passage 21 and the gas chamber 22). The gas inflow passage 21 and the gas chamber 22 constitute one example of a gas passage in the present disclosure.

The gas inflow passage 21A has a gas inlet 24 through which EGR gas is introduced in this passage 21A. The gas inlet 24 is connected with the EGR passage 12. For this connection with the EGR passage 12, an inlet flange 24*a* is provided around the gas inlet 24. The gas inflow passage 21 includes a passage part 21*a* extending from the gas inlet 24 and branch passage parts 21*b* and 21*c* branched off in a bifurcated shape from the passage part 21*a*. The gas inlet 24 opens on the front side of the EGR gas distributor 15. The passage part 21*a* extends in a curve from the front side to the back side of the EGR gas distributor 15 and joins to each of the branch passage parts 21*b* and 21*c*. The gas chamber 22 has a tubular, laterally long shape. The gas chamber 22 serves to collect EGR gas introduced into the gas inflow passage 21 through the gas inlet 24. The plurality of gas distribution passages 23 branch off from the gas chamber 22 in the front of the gas chamber 22. In the present embodiment, each of the gas distribution passages 23 extends at a slant obliquely downward from the gas chamber 22 to each corresponding branch pipe 5*b* and opens therein.

In the present embodiment, as shown in FIG. 6, the EGR gas distributor 15 is constituted of two members; an upper casing 26 and a lower casing 27. The upper casing 26 has an upper flange 26*a* formed over the outer circumference of the upper casing 26. The lower casing 27 has a lower flange 27*a* formed over the outer circumference of the lower casing 27. The upper casing 26 and the lower casing 27 are integrally joined by welding of the upper flange 26*a* and the lower flange 27*a*, constituting the EGR gas distributor 15. The upper casing 26 corresponds to one example of a first casing in this disclosure and the lower casing 27 corresponds to one example of a second casing in this disclosure.

In the present embodiment, as shown in FIG. 6, the EGR gas distributor 15 is provided, on its inner wall, with heating films (heat-generation films or coatings) 29 and 30. Specifically, an upper heating film 29 is provided on the inner wall of a part of the upper casing 26 that forms the gas chamber 22, and a lower heating film 30 is provided on the inner wall of a part of the lower casing 27 that forms the gas chamber 22. The upper heating film 29 corresponds to one example of a first heating film in this disclosure. The lower heating film 30 corresponds to one example of a second heating film in this disclosure. Further, on both ends of the upper heating film 29 in its width direction (a lateral direction in FIG. 6), a pair of an upper positive electrode 31 and an upper negative electrode 32 is provided between the inner wall of the upper casing 26 and the upper heating film 29 to energize the upper heating film 29. On both ends of the lower heating film 30 in its width direction, a pair of a lower positive electrode 33 and a lower negative electrode 34 is provided between the inner wall of the lower casing 27 and the lower heating film 30 to energize the lower heating film 30. Each upper positive electrode 31 and each upper negative electrode 32 respectively correspond to one example of a first positive electrode and a first negative electrode in this disclosure. Each lower positive electrode 33 and each lower negative electrode 34 respectively correspond to one example of a second positive electrode and a second negative electrode in this disclosure. In the present embodiment, the upper heating film 29 and the lower heating film 30 have the same thickness and are provided to cover almost the entire inner walls of the part of the upper casing 26 and the part of the lower casing 27, the parts forming the gas chamber 22. In the present embodiment, even though it is not illustrated, the inner walls of a part of the upper casing 26 and a part of the lower casing 27, the parts forming the gas chamber 21, are also provided with the upper heating film 29 and the lower heating film 30, the upper positive electrodes 31 and the upper negative electrodes 32, and the lower positive electrodes 33 and the lower negative electrodes 34 as with the inner walls of the gas chamber 22. Furthermore, as shown in FIGS. 3 to 5, in the EGR gas distributor 15, an upper positive terminal 31*a* and an upper negative terminal 32*a*, and a lower positive terminal 33*a* and a lower negative terminal 34*a* extending from the positive electrodes 31 and 33 and the negative electrodes 32 and 34 are provided in each of an upstream end part (near the inlet flange 24*a*) and a downstream end part (the branch passage part 21*b*) of the gas inflow passage 21 and one end portion and a middle portion of the gas chamber 22. Each of the heating films 29 and 30 is energized through those terminals 31*a*, 32*a*, 33*a*, and 34*a* via respective electrodes 31, 32, 33, and 34, thereby causing each heating film 29 and 30 to generate heat, thus heating the inner walls of the gas inflow passage 21 and the gas chamber 22 of the EGR gas distributor 15.

Figure 7:
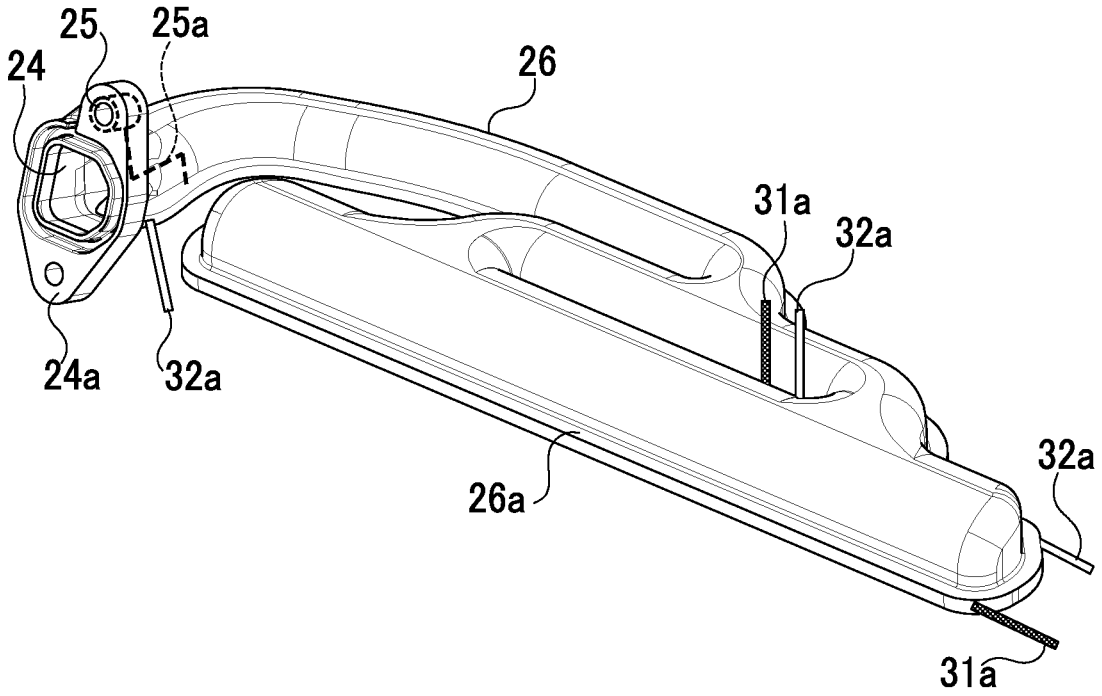
FIG. 7 is a perspective view showing the outside of an upper casing in the first embodiment.
Figure 8:
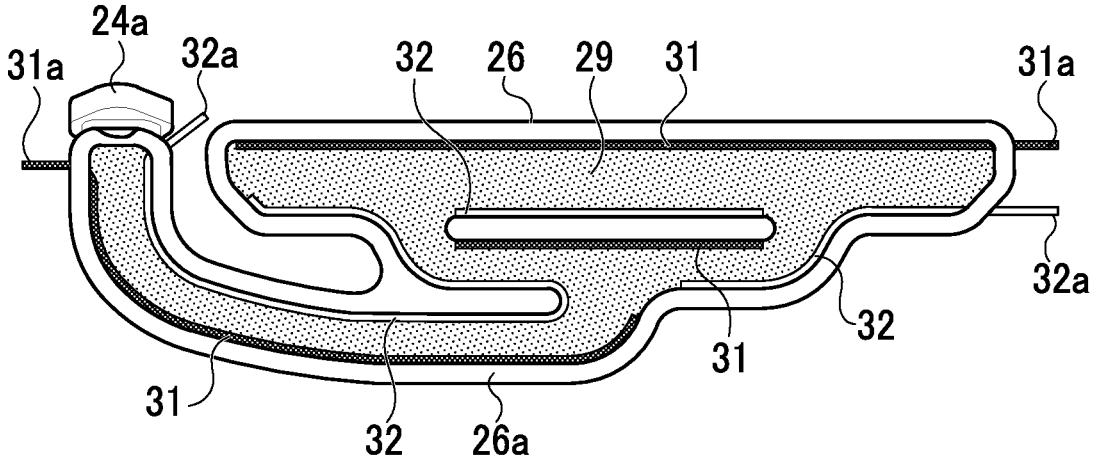
FIG. 8 is a plan view showing the inside of the upper casing in the first embodiment.
Figure 9:
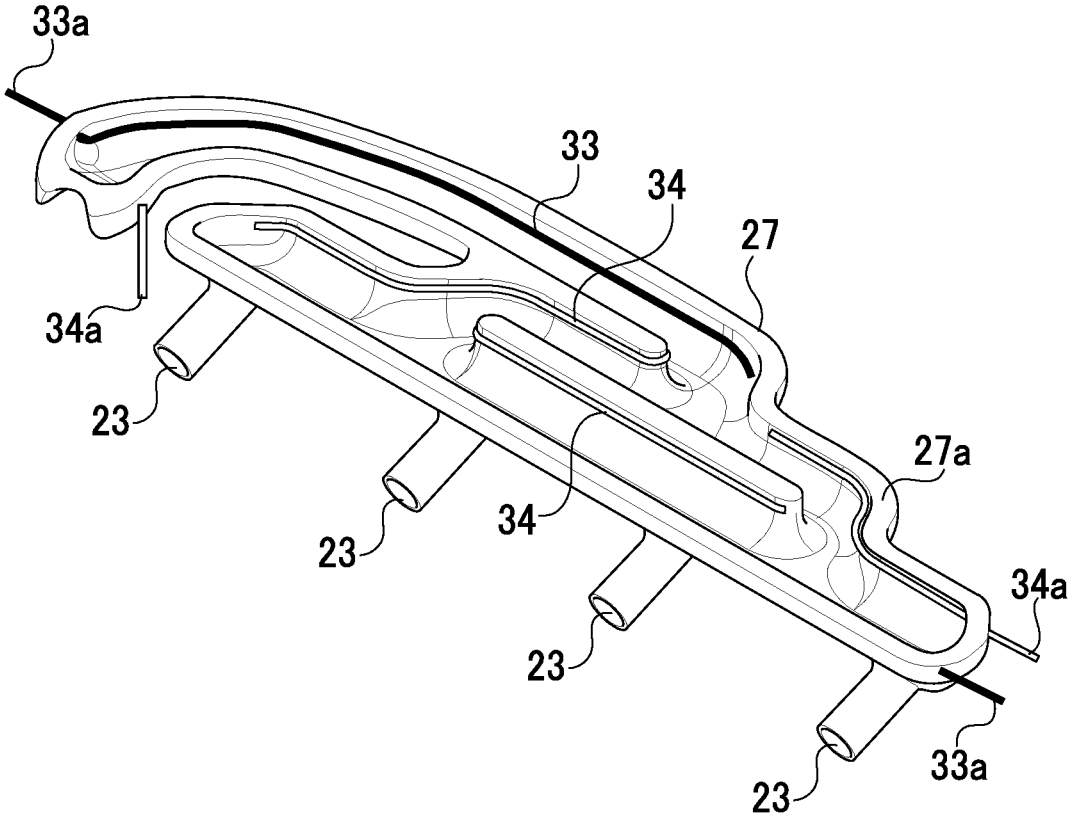
FIG. 9 is a perspective view showing the inside of a lower casing in the first embodiment.
Figure 10:
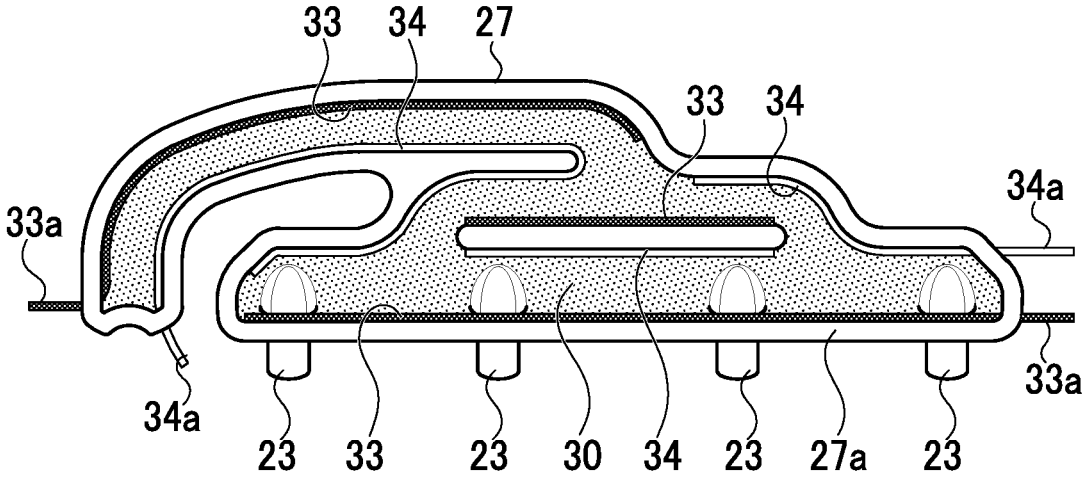
FIG. 10 is a plan view showing the inside of the lower casing in the first embodiment.

FIG. 7 is a perspective view showing the outside of the upper casing 26. FIG. 8 is a plan view showing the inside of the upper casing 26. FIG. 9 is a perspective view showing the inside of the lower casing 27. FIG. 10 is a plan view showing the inside of the lower casing 27. As shown in FIG. 8, the upper positive electrodes 31 (a black solid line) and the upper negative electrodes 32 (a hollow line) are provided on the inner wall of the upper casing 26 along the upper flange 26*a* so that they are opposed to each other. The upper heating film 29 as hatched with dots in FIG. 8 is provided between the opposed upper positive electrode 31 and upper negative electrode 32 so as to cover almost the entire surface of the inner wall of the upper casing 26. As shown in FIGS. 9 and 10, the lower positive electrodes 33 (a black solid line) and the lower negative electrodes 34 (a hollow line) are provided on the inner wall of the lower casing 27 along the lower flange 27*a*. The lower heating film 30 as hatched with dots in FIG. 10 is provided between the opposed lower positive electrode 33 and lower negative electrode 34 so as to cover almost the entire surface of the inner wall of the lower casing 27.

Each of the heating films 29 and 30 is provided with a ground wire. In this embodiment, the EGR gas distributor 15 is connected (attached) to the EGR passage 12 through the inlet flange 24*a*. As shown in FIG. 3, the inlet flange 24*a* is provided with a metal collar 25 having electric conductivity in a bolt hole. To this metal collar 25, a ground wire of each heating film 29 and 30 is connected. The inlet flange 24*a* is connected to a flange provided on the EGR passage 12 with a bolt inserted in the metal collar 25. In this case, the upstream side of the EGR passage 12 is connected to a vehicle through a conductive metal member and is grounded. Thus, connection of the inlet flange 24*a* to the flange of the EGR passage 12 enables to make a ground for the heating films 29 and 30. The inlet flange 24*a* corresponds to one example of a joint in this disclosure and the metal collar 25 corresponds to one example of a conductive member in this disclosure.

(Heating Films)

Herein, the heating films 29 and 30 will be described in detail. As the heating films 29 and 30, for example, "Heating film coating" made by Toyo Drilube Co., Ltd. can be used. This heating film is a drying film made by mixing and dispersing various kinds of conductive pigments in a special binder, and can generate heat over the entire surface when supplied with electric power through electrodes. Electric currents applied to the mixed conductive pigment (conductor) is converted into heat energy (Joule heat) to obtain a heating efficiency. The characteristics of this heating film are as below:

(1) It can develop the heating property with low voltage;
(2) It generates heat from the entire surface and thus can generate heat more generated uniformly as compared with nichrome wire;
(3) It can be thinned in thickness and reduced in weight;
(4) It has superior flexibility and can be made in a film shape; and
(5) It can provide arbitrary heating property by adjustment of a coated film thickness, an electrode length, an interelectrode distance (i.e., a distance between electrodes), and others.

(Operations and Effects of EGR System)

According to the EGR system configured as above in the present embodiment, EGR gas flowing through the EGR passage 12 is introduced into the gas inflow passage 21 of the EGR gas distributor 15, flows through the gas inflow passage 21 while branching off and collects in the gas chamber 22, and is appropriately distributed from the plurality of gas distribution passages 23 to each corresponding branch pipe 5*b* of the intake manifold 5, and then distributed to each cylinder of the engine 1 for recirculation.

Herein, the generation of condensed water is problematic for the EGR gas distributor 15 (the EGR passage). In the EGR gas distributor 15, however, when the heating films 29 and 30 are energized through the positive electrodes 31 and 33 and the negative electrodes 32 and 34, these heating films 29 and 30 generate heat, thereby heating the inner walls of the gas inflow passage 21 and the gas chamber 22 (the gas passage). Thus, arbitrarily controlling the energization of the heating films 29 and 30 adjusts the temperature and the temperature rise of the inner walls of the gas inflow passage 21 and the gas chamber 22 provided with the heating films 29 and 30. This configuration can increase the temperature of the inner walls of the EGR gas distributor 15 (the EGR passage) with good responsivity and keep the temperature stable. Consequently, it is possible to prevent generation of condensed water and freezing of the same inside the EGR gas distributor 15.

According to the present embodiment configured as above, the negative electrodes 32 and 34 of the heating films 29 and 30 and the ground wire 25*a* are connected to the metal collar 25 provided in the inlet flange 24*a* (the joint) of the EGR gas distributor 15 (the EGR passage). Thus, the ground wire 25*a* does not need to be separately and independently grounded. This configuration can apply grounding to each of the heating films 29 and 30 without installing wiring outside the EGR gas distributor 15.

The present embodiment configured as above can prevent the generation of condensed water in the EGR gas distributor 15 as described above. Thus, the condensed water is less likely to flow from the EGR gas distributor 15 to each branch pipe 5*b*. This configuration can offer greater flexibility of placement to the EGR gas distributor 15 with respect to the intake manifold 5. For instance, the EGR gas distributor 15 can be placed on the intake manifold 5 (the branch pipes 5*b*) at a position far from the outlet flange 5*c* (the engine) as shown by a two-dot chain line in FIG. 2, which is away from the present position illustrated by a solid line in FIG. 2 (i.e., the position close to the outlet flange 5*c*). In this case, the EGR gas distributor 15 is apart from the engine 1, so that it is possible to prevent adhesion and accumulation of deposits on distal ends of the gas distribution passages 23, and design the gas distribution passages 23 with a reduced inner diameter to suppress the attenuation of pulsation of intake air, thereby enabling to prevent lowering of engine power. Further, the open ends of the gas distribution passages 23 can be made flush with the inner walls of the branch pipes 5*b*, thus enabling to minimize the resistance of intake air flow.

Second Embodiment

Next, a second embodiment will be described in detail with reference to the accompanying drawings. In the following description, similar or identical components to those in the first embodiment are assigned the same reference signs as in the first embodiment and their details are omitted. The following description will be given with a focus on differences from the first embodiment.

(EGR Gas Distributor)

This second embodiment differs from the first embodiment in the configurations of the heating films 29 and 30 in the EGR gas distributor 15 (the EGR passage). Herein, the heating temperature of each heating film increases as the electric current flows with a higher current value through the heating film. When the heating films have the same thickness as each other, one heating film having a shorter interelectrode distance between a positive electrode and a negative electrode (a shortest distance) than other heating films more greatly rises in heating temperature than the other heating films. Furthermore, when the heating films have the same interelectrode distance between the positive electrode and the negative electrode, one heating film having a larger thickness than other heating films more greatly rises in heating temperature than the other heating films. In the present embodiment, therefore, in the EGR gas distributor 15, the gas inflow passage 21 (the passage part 21*a* and each branch passage part 21*b* and 21*c*) and the gas chamber 22 are provided with the heating films 29 and 30 different in thickness according to the inner diameters or inner circumferential lengths of the gas inflow passage 21 (the passage part 21*a* and each branch passage part 21*b* and 21*c*) and the gas chamber 22 in order to ensure a uniform temperature of the inner walls heated by the heating films 29 and 30.

Figure 11:
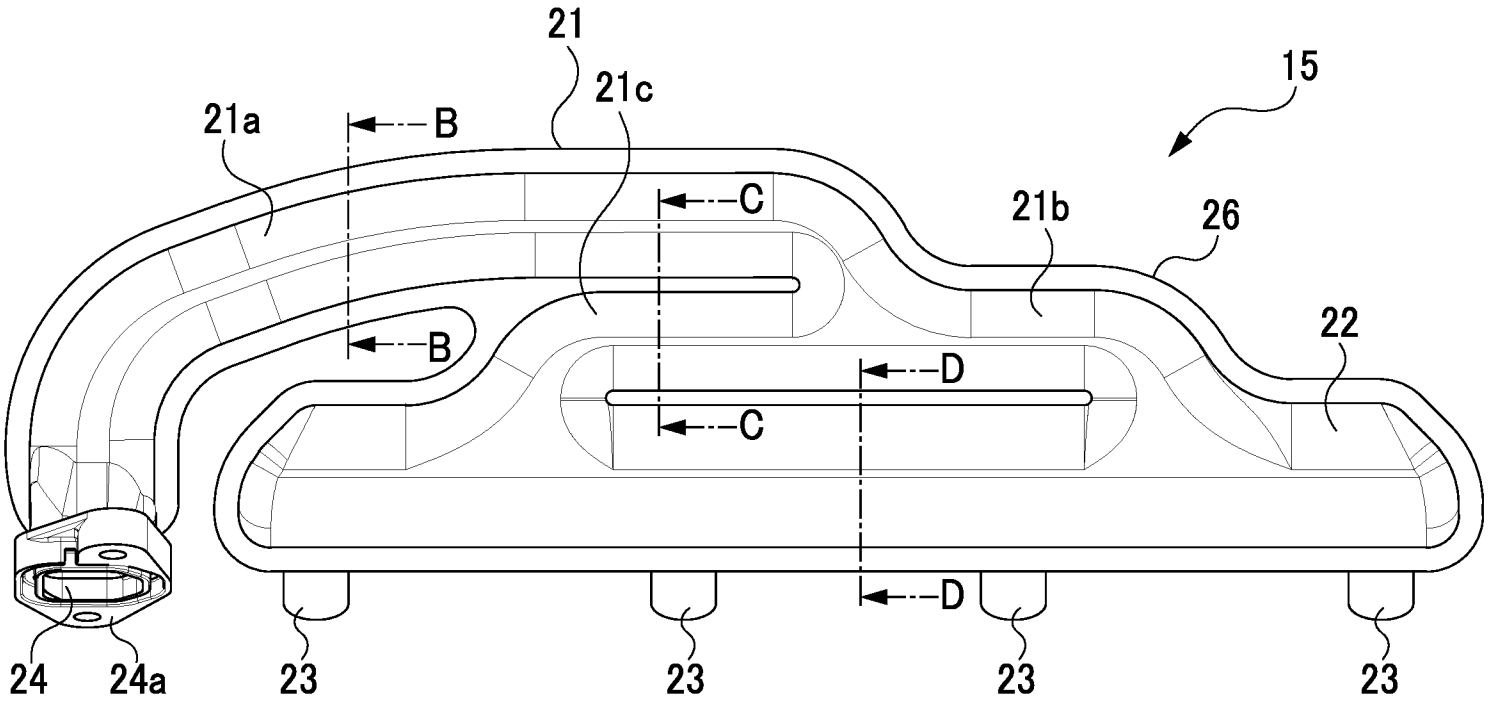
FIG. 11 is a plan view of an EGR gas distributor in a second embodiment.
Figure 12:
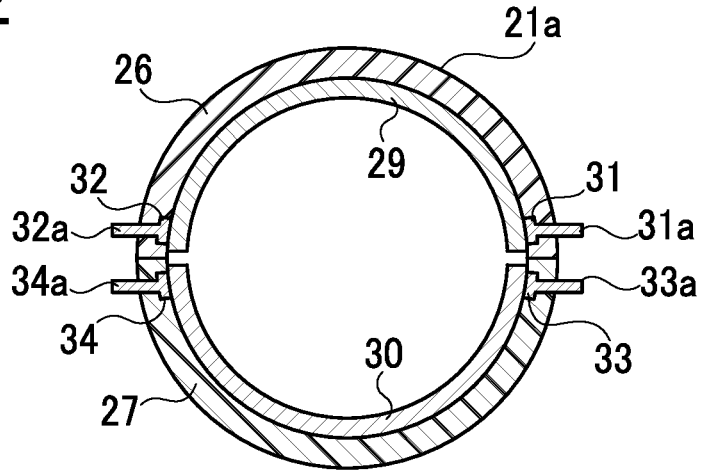
FIG. 12 is a cross-sectional view of a passage part of the EGR gas distributor taken along a line B-B in FIG. 11 in the second embodiment.
Figure 13:
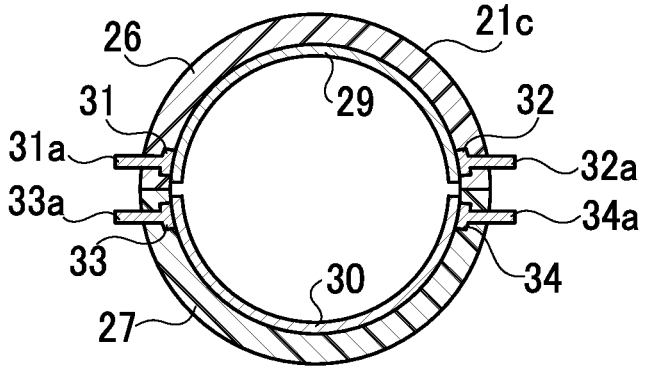
FIG. 13 is a cross-sectional view of a branch passage part of the EGR gas distributor taken along a line C-C in FIG. 11 in the second embodiment.
Figure 14:
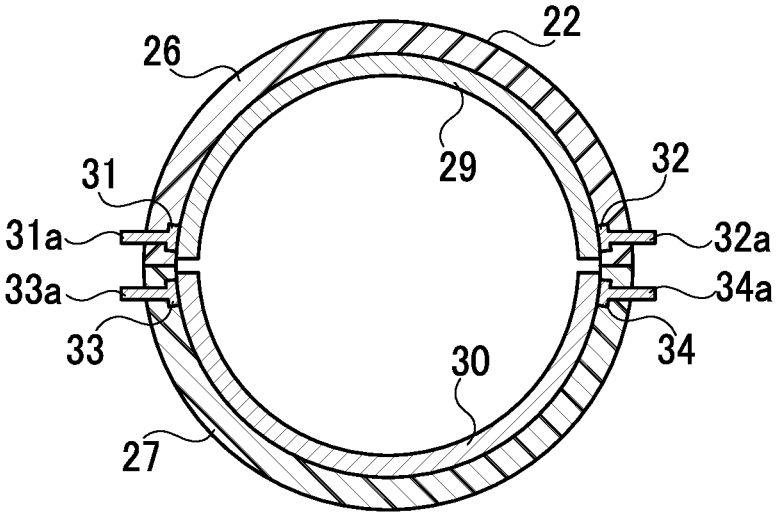
FIG. 14 is a cross-sectional view of a gas chamber of the EGR gas distributor taken along a line D-D in FIG. 11 in the second embodiment.

Specifically, FIG. 11 is a plan view of the EGR gas distributor 15. FIG. 12 is a cross-sectional view of the passage part 21*a* of the EGR gas distributor 15 taken along a line B-B in FIG. 11. FIG. 13 is a cross-sectional view of the branch passage part 21*c* (which has the same shape as the branch passage part 21*b*) of the EGR gas distributor 15 taken along a line C-C in FIG. 11. FIG. 14 is a cross-sectional view of the gas chamber 22 of the EGR gas distributor 15 taken along a line D-D in FIG. 11. FIGS. 12 to 14 conceptually illustrate the passage parts 21*a* and 21*c* (21*b*) and the gas chamber 22 in a circular cross-section. In the present embodiment, as shown in FIGS. 12 to 14, when the upper heating film 29 and the lower heating film 30 are provided vertically symmetrically in each of the passage part 21*a*, the branch passage parts 21*b* and 21*c*, and the gas chamber 22 and have the same interelectrode distance as each other, the thicknesses of those heating films 29 and 30 are set equal to each other. In contrast, the inner diameter or inner circumferential length of each of the passage parts 21*a* and 21*c* (21*b*) and the gas chamber 22, that is, the interelectrode distance (i.e., the shortest distance between the upper positive electrode 31 and the upper negative electrode 32 and the shortest distance between lower positive electrode 33 and the lower negative electrode 34) is largest in the gas chamber 22 shown in FIG. 14 and second-largest in the passage part 21*a* shown in FIG. 12 and smallest in the branch passage part 21*c* (21*b*) shown in FIG. 13. In the present embodiment, therefore, the thickness of the heating films 29 and 39 is set to be largest in the gas chamber 22 and second-largest in the passage part 21*a*, and smallest in the branch passage parts 21*b* and 21*c* according to the magnitude of their interelectrode distances.

(Operations and Effects of EGR System)

The EGR system configured in the present embodiment described above can provide the following operations and effects in addition to the operations and effects in the first embodiment. To be concrete, even when the passage part 21*a*, branch passage parts 21*b* and 21*c*, and gas chamber 22 (a plurality of different portions) in the EGR gas distributor 15 (the EGR passage) have the inner walls different in inner diameter or inner circumferential length, the heating films 29 and 30 can be designed with different thicknesses according to those differences. Accordingly, controlling energization of each of the heating films 29 and 30 can evenly adjust the temperatures of the inner walls of the passage part 21*a*, the branch passage parts 21*b* and 21*c*, and the gas chamber 22, each provided with the heating films 29 and 30. Thus, even when the inner walls of the passage part 21*a*, branch passage parts 21*b* and 21*c*, and gas chamber 22 (the plurality of different portions) in the EGR gas distributor 15 (the EGR passage) are different in one of the inner diameter and the inner circumferential length, the temperatures of the inner walls can be increased uniformly.

Third Embodiment

Next, a third embodiment will be described in detail with reference to the accompanying drawings.

(EGR Gas Distributor)

Figure 15:
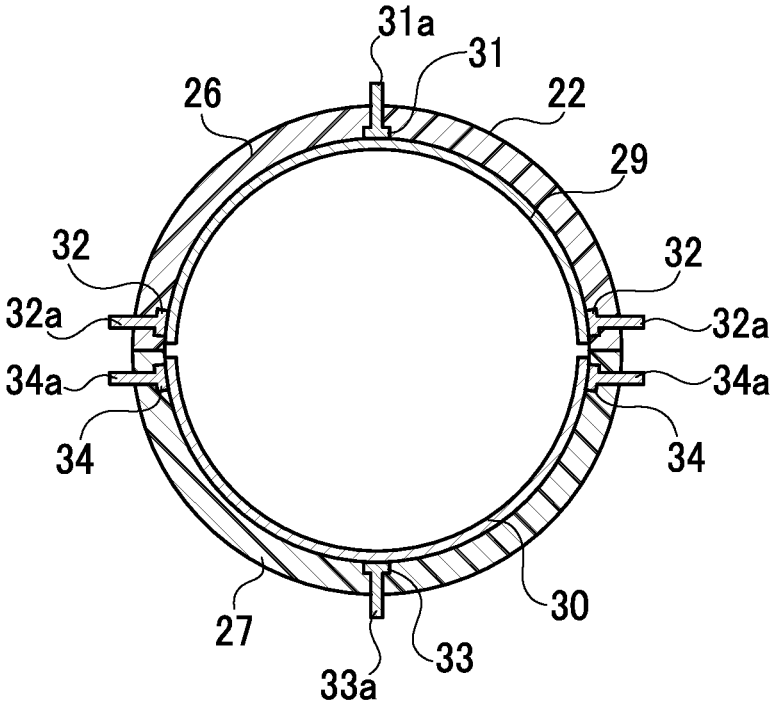
FIG. 15 is a cross-sectional view conforming to FIG. 14 and showing a gas chamber of an EGR gas distributor in a third embodiment.

This third embodiment differs from the second embodiment in the configurations of the heating films 29 and 30, positive electrodes 31 and 33, and negative electrodes 32 and 34 in the passage part 21*a*, branch passage parts 21*b* and 21*c*, and gas chamber 22 (the plurality of different portions) of the EGR gas distributor 15. FIG. 15 is a cross-sectional view conforming to FIG. 14 and showing the gas chamber 22 of the EGR gas distributor 15. Other portions, that is, the passage part 21*a* and the branch passage parts 21*b* and 21*c*, are configured as shown in FIGS. 12 and 13. In the present embodiment, the inner diameter or inner circumferential length of each of the passage part 21*a*, the branch passage parts 21*c* and 21*b*, and the gas chamber 22 is largest in the gas chamber 22 shown in FIG. 15 and is second-largest in the passage part 21*a* shown in FIG. 12 and smallest in the branch passage parts 21*c* and 21*b* shown in FIG. 13. In the present embodiment, therefore, the EGR gas distributor 15 is designed so that the thickness of the heating films 29 and 30 and the interelectrode distance (the shortest distance) between the positive electrode 31 and the negative electrode 32 and between the positive electrode 33 and the negative electrode 34 are set different among the passage part 21*a*, the branch passage parts 21*c* and 21*b*, and the gas chamber 22 according to their inner diameters or inner circumferential lengths in order to make uniform the temperatures of the inner walls heated by the heating films 29 and 30.

In the present embodiment, specifically, the thickness of each heating film 29, 30 in the gas chamber 22 (a specific portion) is set smaller than that of the passage part 21*a* and the branch passage parts 21*b* and 21*c* (other portions) and, instead, the interelectrode distance (the shortest distance) between the positive electrode 31 and the negative electrode 32 and between the positive electrode 33 and the negative electrode 34 in the gas chamber 22 are set smaller than the interelectrode distances in the passage part 21*a* and the branch passage parts 21*b* and 21*c* as shown in FIG. 15. To be concrete, as shown in FIG. 15, upper negative electrodes 32 are provided one on either end of the upper heating film 29 in the circumferential direction and a single upper positive electrode 31 is provided between those upper negative electrodes 32. Similarly, lower negative electrodes 34 are provided one on either end of the lower heating film 30 in the circumferential direction and a single lower positive electrode 33 is provided between those lower negative electrodes 34. In other words, on the upper heating film 29, the upper positive electrode 31 and the upper negative electrodes 32 are alternately arranged in a specific direction of the upper heating film 29. Similarly, on the lower heating film 30, the lower positive electrode 33 and the lower negative electrodes 34 are alternately arranged in a specific direction of the lower heating film 30. Accordingly, the interelectrode distance in each of the heating films 29 and 30 in the gas chamber 22 is set short.

In the second embodiment, specifically, in order to make uniform the temperatures of the inner walls of the passage part 21*a*, branch passage parts 21*b* and 21*c*, and gas chamber 22 (the plurality of different portions) heated by the heating films 29 and 30, the thickness of each of the heating films 29 and 30 in the gas chamber 22 (the specific portion) having the largest inner diameter or inner circumferential length is set largest among those different portions. In contrast, in the present embodiment, in order to make uniform the temperatures of the inner walls of the passage part 21*a*, the branch passage parts 21*b* and 21*c*, and the gas chamber 22 heated by the heating films 29 and 30, instead of setting the thickness of each heating film 29, 30 small in the gas chamber 22 (the specific portion) having the largest inner diameter or inner circumferential length, the interelectrode distance (the shortest distance) related to the electrodes 31 to 34 provided on the heating films 29 and 30 in the gas chamber 22 is set shorter than the interelectrode distances in the passage part 21*a* and the branch passage parts 21*b* and 21*c* (other portions).

(Operations and Effects of EGR System)

According to the EGR system configured in the present embodiment described above, the EGR gas distributor 15 (the EGR passage) is configured such that, in the gas chamber 22 (the specific portion) having the largest inner diameter or inner circumferential length, the upper heating film 29 has a shorter interelectrode distance (the shortest distance) between the adjacent upper positive electrode 31 and upper negative electrode 32, allowing an electric current to easily flow through the upper heating film 29 between the electrodes 31 and 32. This configuration can enhance the heating property of the upper heating film 29. Similarly, the lower heating film 30 in the gas chamber 22 has a shorter interelectrode distance (the shortest distance) between the adjacent lower positive electrode 33 and lower negative electrode 34, allowing an electric current to easily flow through the lower heating film 30 between the electrodes 33 and 34. This configuration can enhance the heating property of the lower heating film 30. Consequently, the equivalent operations and effects to those in the second embodiment can be obtained.

Fourth Embodiment

Next, a fourth embodiment will be described in detail with reference to the accompanying drawings.

(EGR Gas Distributor)

Figure 16:
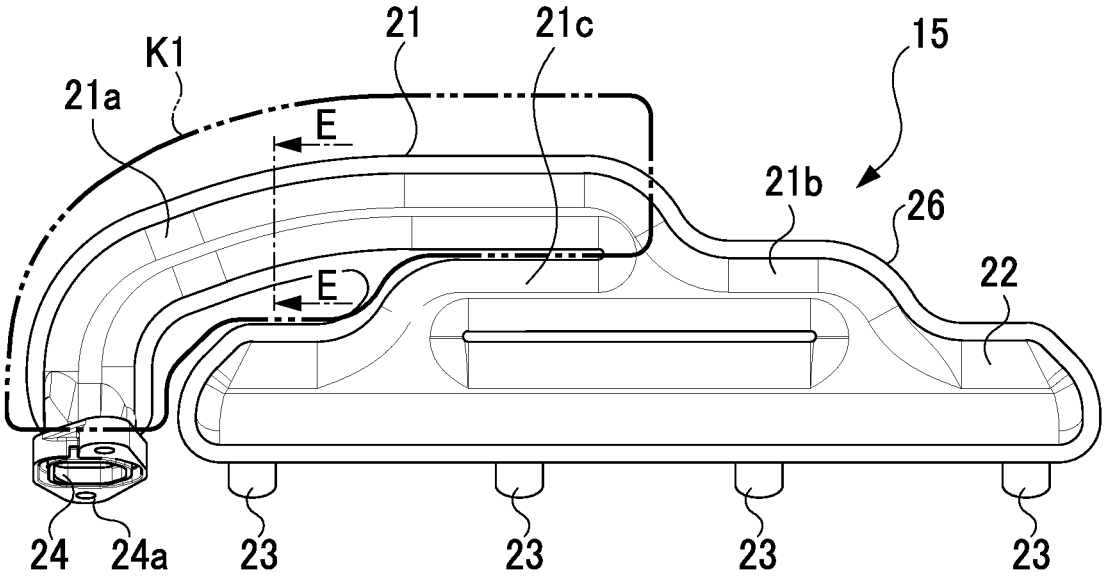
FIG. 16 is a plan view of a EGR gas distributor in a fourth embodiment.
Figure 17:
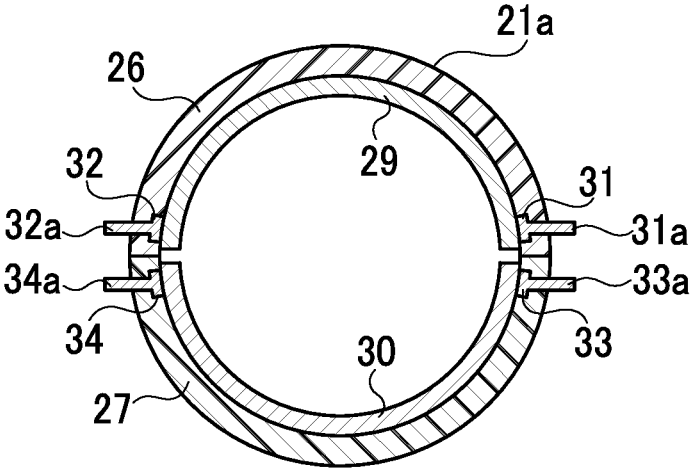
FIG. 17 is a cross-sectional view of a passage part of the EGR gas distributor taken along a line E-E in FIG. 16 in the fourth embodiment.

The present embodiment differs from each of the foregoing embodiments in the configurations of the heating films 29 and 30 in the EGR gas distributor 15. FIG. 16 is a plan view of the EGR gas distributor 15. FIG. 17 is a cross-sectional view of the passage part 21*a* of the EGR gas distributor 15 taken along a line E-E in FIG. 16. When this EGR gas distributor 15 is mounted in a vehicle, the part of the passage part 21*a* enclosed by a two-dot chain line K1 in FIG. 16 is most likely to be exposed to the outside air (traveling wind of a vehicle) and is positioned farthest from the engine 1. As a result, this passage part 21*a* (the specific portion) in the EGR gas distributor 15 is most likely to get cold as compared with other portions. In the present embodiment, therefore, in order to adjust the temperatures of the inner walls of the passage part 21*a*, branch passage parts 21*b* and 21*c*, and gas chamber 22 (the plurality of different portions) in the EGR gas distributor 15 to a required temperature of each of those passage parts and others 21*a*, 21*b*, 21*c*, and 22, the heating films 29 and 30 are designed with different thicknesses according to the inner diameter or inner circumferential length of the corresponding passage parts and others 21*a*, 21*b*, 21*c*, and 22. In other words, the thickness of each heating film 29 and 30 in the passage part 21*a* (the specific portion) is set to the dimension shown in FIG. 17 and the thickness of each heating film 29 and 30 in the branch passage parts 21*b* and 21*c* and the gas chamber 22 (other portions) is set to be equal to or smaller than that of the passage part 21*a*. Herein, the interelectrode distance (the shortest distance) in each heating film 29 and 30 in the passage part 21*a*, branch passage parts 21*b* and 21*c*, and gas chamber 22 (the plurality of different portions) is set to be equal to that in the second embodiment.

(Operations and Effects of EGR System)

The EGR system configured in the present embodiment described as above can provide the following operations and effects in addition to the operations and effects in the first embodiment. In the present embodiment, specifically, in order to adjust the temperatures of the inner walls of the passage part 21*a*, branch passage parts 21*b* and 21*c*, and gas chamber 22 (the plurality of different portions) in the EGR gas distributor 15 to the required temperature of each of the passage parts and others 21*a*, 21*b*, 21*c*, and 22 even when these passage parts and others 21*a*, 21*b*, 21*c*, and 22 are different in temperature condition from each other, the heating films 29 and 30 are designed with different thicknesses according to the inner diameter or inner circumferential length of the corresponding passage parts and others 21*a*, 21*b*, 21*c*, and 22. Accordingly, controlling the energization of each heating film 29 and 30 in the passage part 21*a*, branch passage parts 21*b* and 21*c*, and gas chamber 22 adjusts the temperatures of the inner walls of the corresponding passage parts and others 21*a*, 21*b*, 21*c*, and 22 each provided with the heating films 29 and 30 to the required temperatures of the passage parts and others 21*a*, 21*b*, 21*c*, and 22. Thus, even when the passage part 21*a*, branch passage parts 21*b*, 21*c*, and gas chamber 22 (the plurality of different portions) of the EGR gas distributor 15 (the EGR passage) are different in temperature condition, the temperatures of their inner walls can be increased to the required temperatures of the passage parts and others 21*a*, 21*b*, 21*c*, and 22.

In the present embodiment, for the passage part 21*a*, branch passage parts 21*b* and 21*c*, and gas chamber 22 (the plurality of different portions) of the EGR gas distributor 15, the heating films 29 and 30 can be designed with different thicknesses according to the inner diameter or inner circumferential length of the corresponding passage parts and others 21*a*, 21*b*, 21*c*, and 22. As a modified example thereof, the interelectrode distance (the shortest distance) between a positive electrode and a negative electrode may be set different according to the inner diameter or inner circumferential length of each of the plurality of different portions or alternatively both the thickness of each heating film and the interelectrode distance may be set different among the different portions. In these cases, the same operations and effects as above can be obtained.

Fifth Embodiment

Next, a fifth embodiment will be described in detail with reference to the accompanying drawings.

(EGR Gas Distributor)

Figure 18:
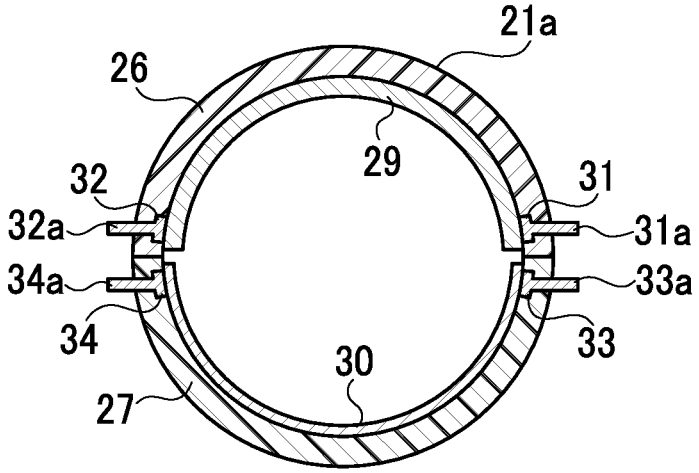
FIG. 18 is a cross-sectional view conforming to FIG. 12 and showing a passage part of an EGR gas distributor in a fifth embodiment.

The present embodiment differs from the fourth embodiment in the configurations of the heating films 29 and 30 in the EGR gas distributor 15. FIG. 18 is a cross-sectional view conforming to FIG. 12 and showing the passage part 21*a* of the EGR gas distributor 15. In the present embodiment, in the passage part 21*a* that is likely to get cold due to the outside air (the traveling wind of a vehicle), the upper heating film 29 in the upper casing 26 that is more likely to get cold than the lower casing 27 is set thicker than the lower heating film 30. In this configuration, the interelectrode distance in the upper heating film 29 and the interelectrode distance in the lower heating film 30 are equal to each other.

(Operations and Effects of EGR System)

The EGR system configured in the present embodiment described as above can provide the following operations and effects in addition to the operations and effects in the first embodiment. In the present embodiment, specifically, in order to adjust the temperatures of the inner walls of the upper side and the lower side (different side portions) of the passage part 21*a* (the specific portion) of the EGR gas distributor 15 (the EGR passage) to a required temperature of each of the upper side and the lower side even when the upper side and the lower side of the passage part 21*a* are different in temperature condition from each other, the heating films 29 and 30 can be designed with different thicknesses according to the inner diameter or inner circumferential length of the corresponding passage part and others 21*a*, 21*b*, 21*c*, and 22. Accordingly, controlling the energization of the heating films 29 and 30 in the upper side and the lower side of the passage part 21*a* (the different side portions) adjusts the temperatures of the inner walls of the upper side and the lower side of the passage part 21*a* provided with the heating films 29 and 30 to the required temperatures. Thus, even when the upper side and the lower side of the passage part 21*a* (the specific portion) of the EGR gas distributor 15 (the EGR passage) are different in temperature condition, the above configuration in the present embodiment can increase the temperatures of their inner walls to the required temperature.

Sixth Embodiment

Next, a sixth embodiment will be described in detail with reference to the accompanying drawings.

(EGR Gas Distributor)

Figure 19:
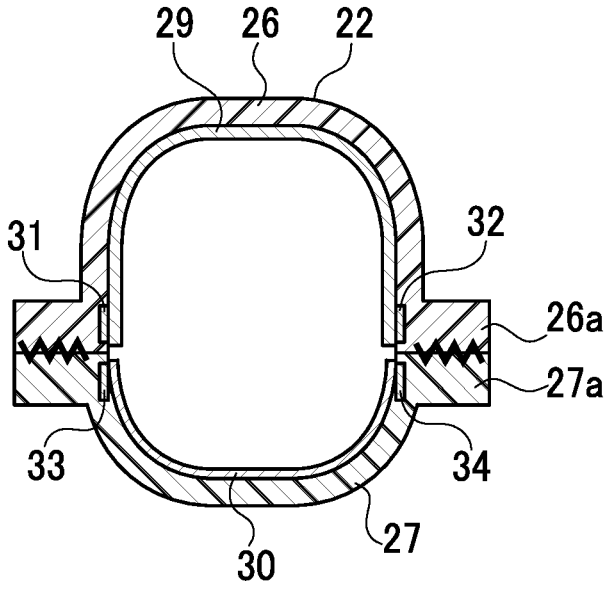
FIG. 19 is a cross-sectional view conforming to FIG. 6 and showing a gas chamber of an EGR gas distributor in a sixth embodiment.

The present embodiment differs from each of the foregoing embodiments in the configurations of the heating films 29 and 30 provided in the EGR gas distributor 15. FIG. 19 is a cross-sectional view conforming to FIG. 6 and showing the gas chamber 22 of the EGR gas distributor 15. In the present embodiment, the EGR gas distributor 15 is configured such that the upper casing 26 (a first casing) has a longer length in the circumferential direction (an inner circumferential length) and a larger surface area of an inner wall than the lower casing 27 (a second casing). Accordingly, the inner circumferential length of the upper heating film 29 (a first heating film) provided on the inner wall of the upper casing 26 is longer than the inner circumferential length of the lower heating film 30 (a second heating film). Thus, the upper interelectrode distance (a first interelectrode distance) along the surface of the upper heating film 29 between the upper positive electrode 31 (a first positive electrode) and a upper negative electrode 32 (a first negative electrode) provided at both ends of the upper heating film 29 in the circumferential direction is larger than the lower interelectrode distance (a second interelectrode distance) along the surface of the lower heating film 30 between the lower positive electrode 33 (a second positive electrode) and the lower negative electrode 34 (a second negative electrode) provided at both ends of the lower heating film 30 in the circumferential direction. In the present embodiment, therefore, in order to make uniform the temperatures of the inner walls of the upper casing 26 and the lower casing 27 or adjust the temperatures of the inner walls to the required temperatures of the upper casing 26 and the lower casing 27, the thickness of the upper heating film 29 provided in the upper casing 26 and the thickness of the lower heating film 30 provided in the lower casing 27 are set according to a difference between the upper interelectrode distance and the lower interelectrode distance. To be concrete, the thickness of the upper heating film 29 having the larger interelectrode distance is set larger than the thickness of the lower heating film 30.

(Operations and Effects of EGR System)

The EGR system configured in the present embodiment described as above can provide the following operations and effects in addition to the operations and effects in the first embodiment. In the present embodiment, specifically, the EGR gas distributor 15 is constituted of the upper casing 26 and the lower casing 27. The upper casing 26 is provided with the upper heating film 29, while the lower casing 27 is provided with the lower heating film 30. In the present embodiment, the thickness of the upper heating film 29 and the thickness of the lower heating film 30 are set according to a difference between the upper interelectrode distance between the upper positive electrode 31 and the upper negative electrode 32 of the upper heating film 29 and the lower interelectrode distance between the lower positive electrode 33 and the lower negative electrode 34 of the lower heating film 30. Thus, controlling the energization of the heating films 29 and 30 makes uniform the temperatures of the inner walls of the upper casing 26 and the lower casing 27 or adjusts the temperatures of the inner walls to the required temperatures of the upper casing 26 and the lower casing 27. Even when there is a difference between the upper interelectrode distance (the first interelectrode distance) in the upper heating film 29 (the first heating film) in the upper casing 26 (the first casing) and the lower interelectrode distance (the second interelectrode distance) in the lower heating film 30 (the second heating film) in the lower casing 27 (the second casing), the configuration in the present embodiment can make uniform the temperatures of the inner walls between the upper casing 26 and the lower casing 27 or adjust the temperatures of the inner walls to the required temperature of the upper casing 26 and the lower casing 27.

Seventh Embodiment

Next, a seventh embodiment will be described in detail with reference to the accompanying drawings.

(EGR Gas Distributor)

The present embodiment differs from each of the foregoing embodiments in the configurations of the heating films 29 and 30 in the EGR gas distributor 15. Herein, in the EGR gas distributor 15 (the EGR passage), condensed water generated therein collects in the gas chamber 22 together with EGR gas. If this condensed water can be evaporated, the condensed water will not directly flow from each of the gas distribution passages 23 to each cylinder of the engine 1 through each corresponding branch pipe 5*b*. In the present embodiment, therefore, in the passage part 21*a*, branch passage parts 21*b* and 21*c*, and gas chamber 22 (the plurality of different portions) provided with the heating films 29 and 30, in order to set the temperature of the inner wall of the lower casing 27 (the second casing) of the gas chamber 22 (the specific portion) higher than the temperature of the inner wall of the upper casing 26 (the first casing) of the gas chamber 22 and the temperatures of the inner walls of passage part 21*a* and branch passage parts 21*b* and 21*c* (other portions), the thickness of the lower heating film 30 in the gas chamber 22 is set larger than the thickness of the upper heating film 29 in the gas chamber 22 and further larger than the thickness of each of the heating films 29 and 30 in each of the passage part 21*a* and the branch passage parts 21*b* and 21*c*.

Figure 20:
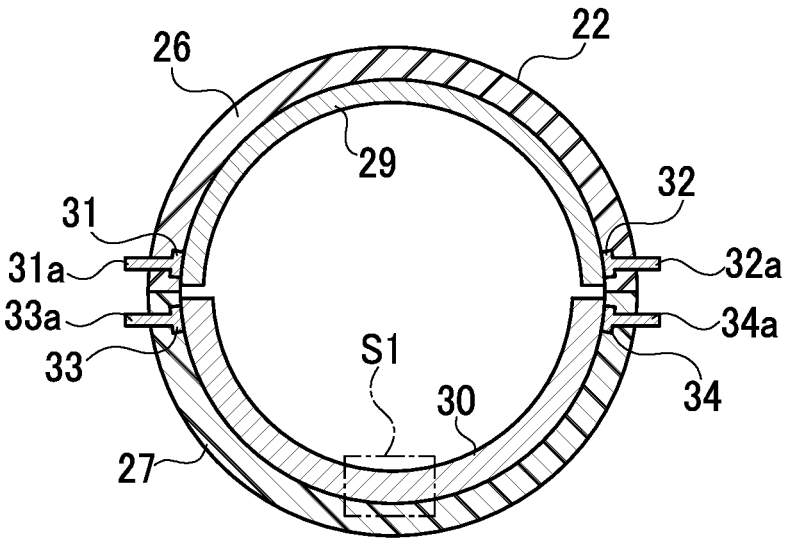
FIG. 20 is a cross-sectional view conforming to FIG. 14 and showing a gas chamber of a EGR gas distributor in a seventh embodiment.

FIG. 20 is a cross-sectional view conforming to FIG. 14 and showing the gas chamber 22 of the EGR gas distributor 15. In the present embodiment, as shown in FIG. 20, the thickness of the lower heating film 30 in the gas chamber 22 is set to a thickness that is larger than the thickness of the upper heating film 29 and further can heat the inner wall of the gas chamber 22 to 100° C. or higher, so that the heat generated by the lower heating film 30 can evaporate the condensed water collects in the lower side of the gas chamber 22. The thickness of the upper heating film 29 in the gas chamber 22 and the thicknesses of heating films 29 and 30 in each of the passage part 21*a* and the branch passage parts 21*b* and 21*c* are set to a thickness capable of heating respective inner walls to less than 100° C.

Figure 21:
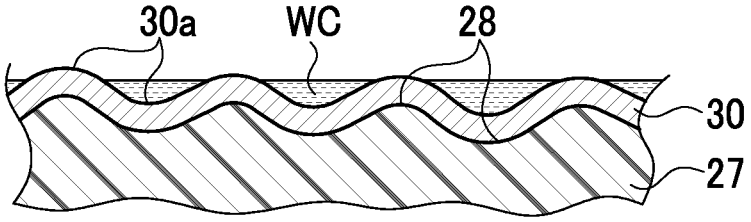
FIG. 21 is an enlarged cross-sectional view conceptually showing a part rectangularly enclosed by a chain line in FIG. 20 in the seventh embodiment.

FIG. 21 is an enlarged cross-sectional view conceptually showing a part rectangularly enclosed by a chain line in FIG. 20. In the present embodiment, the specific portion of the EGR gas distributor 15 (the EGR passage), which is a part of the gas passage located at the most downstream position, that is, the gas chamber 22, is provided with continuous microscopic projections and depressions 30*a*, corrugated in cross-section, on the surface of the lower heating film 30 provided on the inner wall of the lower casing 27 as shown in FIG. 21. In other words, the inner wall of the lower casing 27 has an uneven surface formed with corrugated microscopic projections and depressions 28 and the lower heating film 30 is formed on the microscopic projections and depressions 28, so that the surface of the lower heating film 30 is provided with the continuous microscopic projections and depressions 30*a*. In FIG. 21, collected condensed water WC is illustrated on the lower heating film 30.

Figure 22:
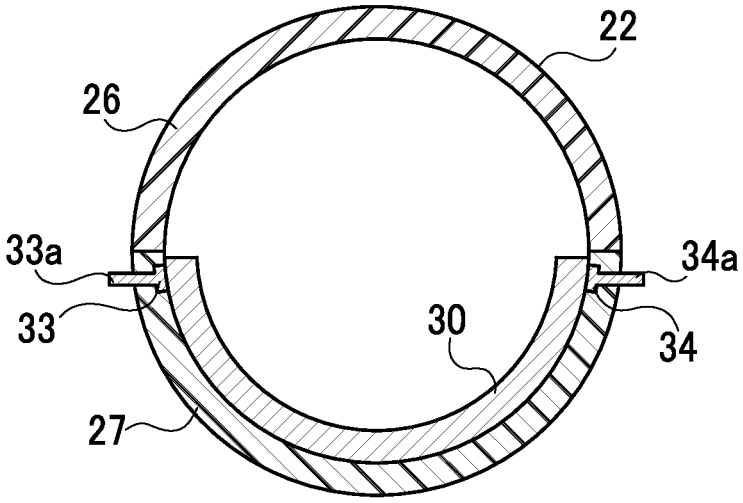
FIG. 22 is a cross-sectional view conforming to FIG. 14 and showing the gas chamber of the EGR gas distributor in the seventh embodiment.

Herein, FIG. 21 is a cross-sectional view conforming to FIG. 14 and showing a modified example of a gas chamber 22 of the EGR gas distributor 15 of FIG. 20. In this modified example, as shown in FIG. 22, the gas chamber 22 is provided with only the lower heating film 30, without including the upper heating film 29, and the thickness of the lower heating film 30 can be set to a thickness capable of heating the inner wall of the lower casing 27 to 100° C. or higher. The surface of the inner wall of the lower casing 27 in FIG. 22 is similarly provided with microscopic projections and depressions 28 shown in FIG. 21, so that the surface of the lower heating film 30 located on the microscopic projections and depressions 28 can be provided with continuous microscopic projections and depressions 30*a*.

(Operations and Effects of EGR System)

The EGR system configured in the present embodiment described as above can provide the following operations and effects in addition to the operations and effects in the first embodiment. In the present embodiment, specifically, among the passage part 21*a*, branch passage parts 21*b* and 21*c*, and gas chamber 22 (the plurality of different portions) of the EGR gas distributor 15, provided with the heating films 29 and 30, the thickness of each of the heating films 29 and 30 in the gas chamber 22 (the specific portion) is set larger than the thickness of each of the heating films 29 and 30 in the passage part 21*a* and the branch passage parts 21*b* and 21*c* (other portions). Accordingly, controlling the energization of the heating films 29 and 30 in the passage part 21*a*, branch passage parts 21*b* and 21*c*, and gas chamber 22 can adjust the temperature of the inner wall of the gas chamber 22 to a temperature higher than the temperatures of the inner walls of the passage part 21*a* and branch passage parts 21*b* and 21*c*. In the present embodiment, particularly, the thickness of the lower heating film 30 in the gas chamber 22 is set to a thickness capable of heating the inner wall of the lower casing 27 to 100° C. or higher. Thus, it is possible to increase the heating temperature of the condensed water accumulated on the lower heating film 30 in the gas chamber 22 (the specific portion) of the EGR gas distributor 15 (the EGR passage) to 100° C. or higher, thereby prompting evaporation of the condensed water.

According to the preset embodiment configured as above, in the gas chamber 22 (the specific portion) of the EGR gas distributor 15, that is, in the passage part 21*a*, the branch passage parts 21*b* and 21*c*, and the lower casing 27 (a most downstream portion) of the gas chamber 22 (the gas passage), the surfaces of their inner walls are provided with the microscopic projections and depressions 28. Accordingly, the lower heating film 30 is placed on the microscopic projections and depressions 28, so that the lower heating film 30 is formed with the microscopic projections and depressions 30*a*, resulting in increased surface area, and the condensed water WC is trapped in microscopic depressions of the surface of the lower heating film 30. This can enhance the evaporation efficiency of condensed water in the gas chamber 22 (the specific portion) of the EGR gas distributor 15 (the EGR passage).

In the present embodiment, among the passage part 21*a*, branch passage parts 21*b* and 21*c*, and gas chamber 22 (the plurality of different portions) of the EGR gas distributor 15, provided with the heating films 29 and 30, the thickness of each of the heating films 29 and 30 in the gas chamber 22 (the specific portion) is set larger than the thickness of each of the heating films 29 and 30 in the passage part 21*a* and branch passage parts 21*b* and 21*c* (other portions). As an alternative, it may be arranged such that the interelectrode distance (the shortest distance) between the positive electrode 31 and the negative electrode 32 provided on the heating film 29 and between the positive electrode 33 and the negative electrode 34 provided on the heating film 30 in the gas chamber 22 of the EGR gas distributor 15 may be set shorter than the interelectrode distance between the positive electrode 31 and the negative electrode 32 provided on the heating film 29 and between the positive electrode 33 and the negative electrode 34 provided on the heating film 30 in each of the passage part 21*a* and branch passage parts 21*b* and 21*c* (other portions). In this case, the foregoing operations and effects can also be obtained.

Eighth Embodiment

Next, an eighth embodiment will be described in detail with reference to the accompanying drawings.

(EGR Gas Distributor)

Figure 23:
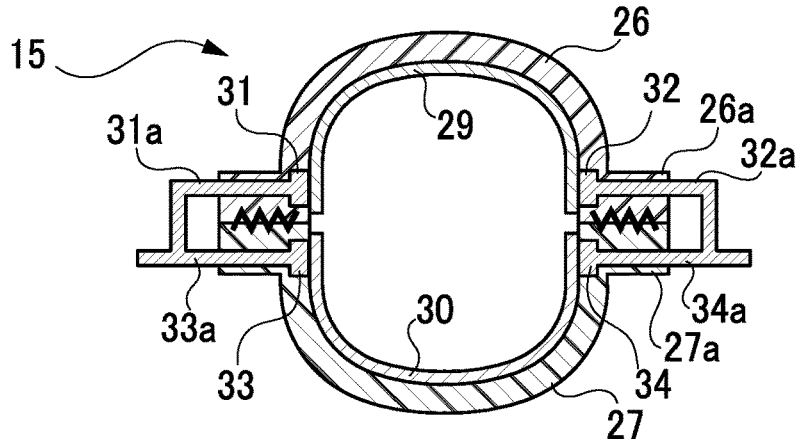
FIG. 23 is a cross-sectional view conforming to FIG. 6 and showing an EGR gas distributor in an eighth embodiment.

The present embodiment differs from each of the foregoing embodiments in the placement of the heating films in the EGR gas distributor 15. FIG. 23 is a cross-sectional view conforming to FIG. 6 and showing the EGR gas distributor 15. In each of the foregoing embodiments, for example, the upper heating film 29 and the lower heating film 30 are respectively provided in the upper casing 26 and the lower casing 27 constituting the EGR gas distributor 15 as shown in FIG. 23. This EGR gas distributor 15 may be required to be simplified in structure in some cases. In the present embodiment, therefore, when the EGR gas distributor 15 is constituted of a plurality of members, a heating film is provided in one of the plurality of members.

Figure 24:
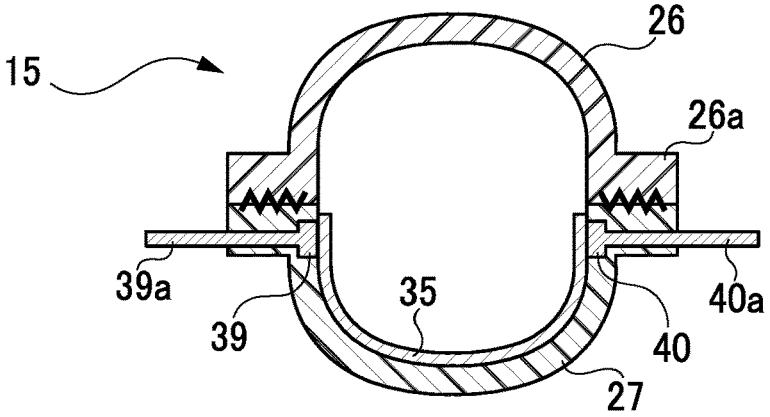
FIG. 24 is a cross-sectional view conforming to FIG. 23 and showing the EGR gas distributor in the eighth embodiment.

Specifically, FIG. 24 is a cross-sectional view conforming to FIG. 23 and showing the EGR gas distributor 15. In this embodiment, as shown in FIG. 24, in the EGR gas distributor 15 constituted of the upper casing 26 and the lower casing 27, a heating film 35 is provided on only the inner wall of the lower casing 27. Further, a positive electrode 39 and a negative electrode 40 are provided one on each end of the heating film 35 in the circumferential direction at a position between the lower casing 27 and the heating film 35. The positive electrode 39 is provided with a positive terminal 39*a* and the negative electrode 40 is provided with a negative terminal 40*a*.

Figure 25:
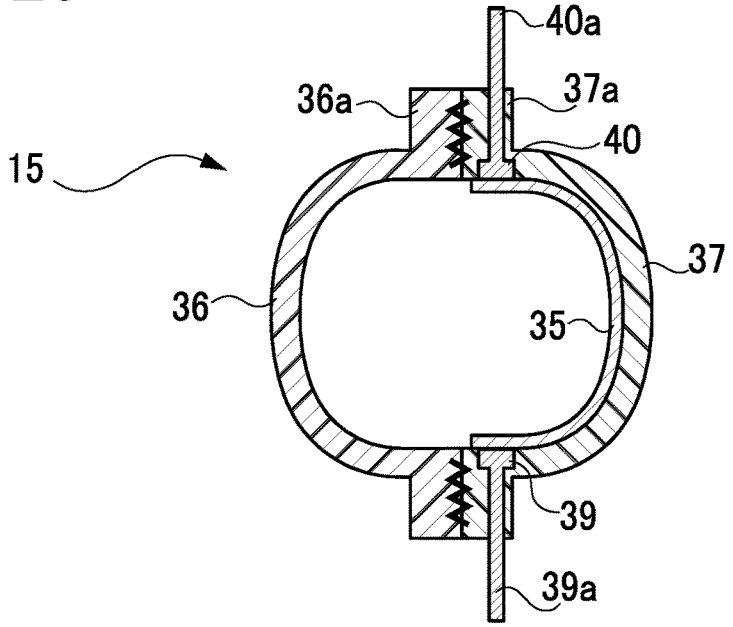
FIG. 25 is a cross-sectional view conforming to FIG. 24 and showing the EGR gas distributor in the eighth embodiment.

Herein, FIG. 25 is a cross-sectional view conforming to FIG. 24 and showing a modified example of the EGR gas distributor 15 of FIG. 24. In this modified example, as shown in FIG. 25, the EGR gas distributor 15 is constituted of a left casing 36 having a left flange 36*a* and a right casing 37 having a right flange 37*a*. Further, the heating film 35 is provided on only the inner wall of the right casing 37, which is one of the casings. The heating film 35 is also provided with the positive electrode 39 and the positive terminal 39*a*, and the negative electrode 40 and the negative terminal 40*a*, as in FIG. 24.

(Operations and Effects of EGR System)

The EGR system configured in the present embodiment described as above can provide the following operations and effects in addition to the operations and effects in the first embodiment. In the present embodiment, specifically, the heating film 35 is provided on the inner wall of one (the lower casing 27 or alternatively the right casing 37) of the plurality members (the upper casing 26 and the lower casing 27, or alternatively, the left casing 36 and the right casing 37) constituting the EGR gas distributor 15. This configuration can minimize the provision of the heating film 35. Thus, the EGR gas distributor 15 (the EGR passage) can be simplified in structure for heating.

Ninth Embodiment

Next, a ninth embodiment will be described in detail with reference to the accompanying drawings.

(EGR Gas Distributor)

Figure 26:
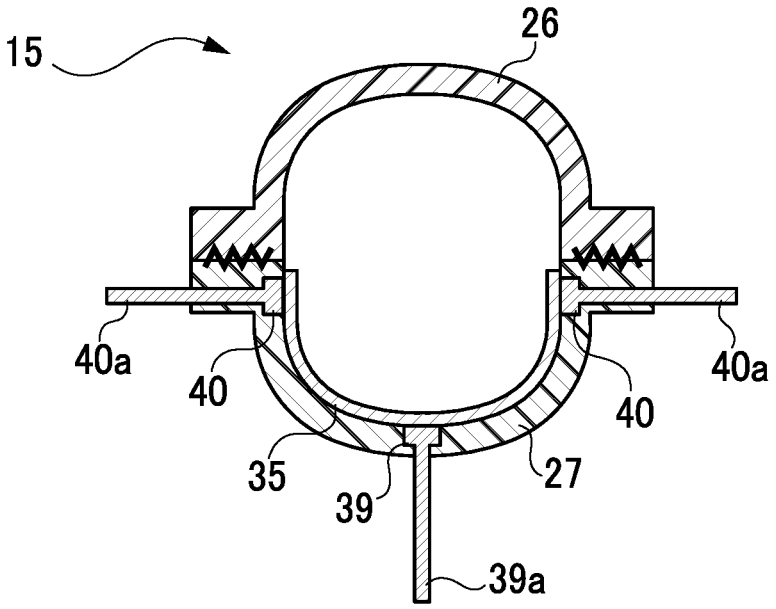
FIG. 26 is a cross-sectional view conforming to FIG. 24 and showing a EGR gas distributor in a ninth embodiment.

The present embodiment differs from the foregoing eighth embodiment in placement of electrodes with respect to the heating films in the EGR gas distributor 15. FIG. 26 is a cross-sectional view conforming to FIG. 24 and showing the EGR gas distributor 15. In the present embodiment, two negative electrodes 40 are provided one at each end of the heating film 35 in the circumferential direction in order to enhance the heating temperature of the heating film 35 without increasing the thickness of the heating film 35. Further, a single positive electrode 39 is provided between the two negative electrodes 40. This configuration can set a short interelectrode distance (the shortest distance) between the positive electrode 35 and each negative electrode 40 on the heating film 35.

In FIG. 26, the two negative electrodes 40 are provided at both ends of the heating film 35 in the circumferential direction and the single positive electrode 39 is provided between those two negative electrodes 40. Alternatively, a modified example may be configured such that two positive electrodes are provided at both ends of a heating film in the circumferential direction and a single negative electrode is provided between those two positive electrodes.

(Operations and Effects of EGR System)

The EGR system configured in the present embodiment described as above can provide the following operations and effects in addition to the operations and effects in the eighth embodiment. In the present embodiment, specifically, the interelectrode distance (the shortest distance) between the adjacent positive electrode 39 and negative electrode 40 on the heating film 35 is short, allowing an electric current to easily flow through the heating film 35 between the electrodes 39 and 40. This can enhance the heating property of the heating film 35.

Tenth Embodiment

Next, a tenth embodiment will be described in detail with reference to the accompanying drawings.

(EGR Gas Distributor)

Figure 27:
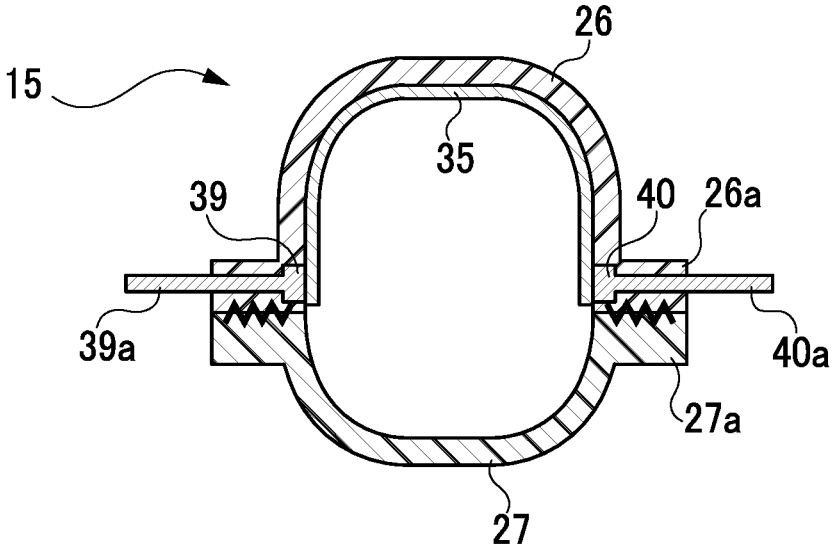
FIG. 27 is a cross-sectional view conforming to FIG. 24 and showing a EGR gas distributor in a tenth embodiment.

The present embodiment differs from the foregoing eighth embodiment in the placement of a heating film in the EGR gas distributor 15. FIG. 27 is a cross-sectional view conforming to FIG. 24 and showing the EGR gas distributor 15. In the present embodiment, the EGR gas distributor 15 is configured such that the upper casing 26 has a longer inner circumferential length and a larger surface area of the inner wall than the lower casing 27. In the present embodiment, therefore, the heating film 35 is provided on only the inner wall of the upper casing 26 having the inner wall of a larger surface area in order to provide the heating film 35 in one of the upper casing 26 and the lower casing 27 in response to a demand for a simplified configuration.

(Operations and Effects of EGR System)

The EGR system configured in the present embodiment described above can obtain the same operations and effects as in the eighth embodiment.

Eleventh Embodiment

Next, an eleventh embodiment will be described in detail with reference to the accompanying drawings.

(EGR Gas Distributor)

Figure 28:
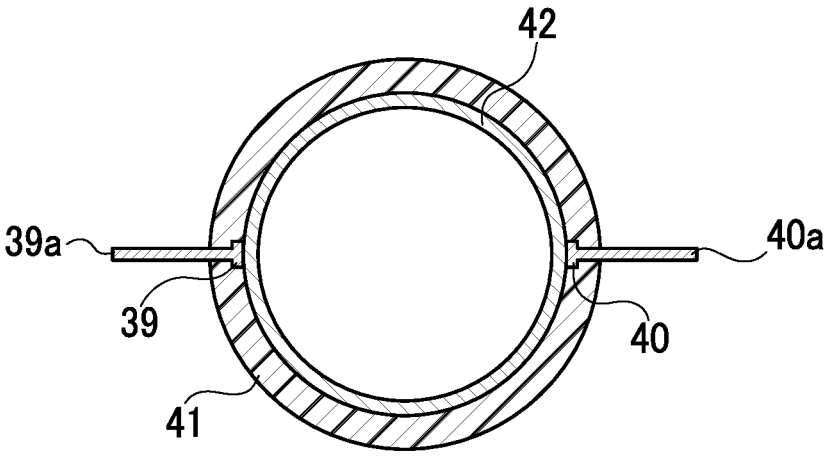
FIG. 28 is a cross-sectional view of a certain portion in a simplified circular form, of an EGR gas distributor in an eleventh embodiment.

The present embodiment differs from each of the foregoing embodiments in the configurations of the heating film, positive electrode, and negative electrode in the EGR gas distributor 15. FIG. 28 is a cross-sectional view of a certain portion of the EGR gas distributor 15 in a simplified circular form. In the present embodiment, a heating film 42 is circumferentially provided over the entire inner wall of a casing 41 made of resin or rubber having heat insulating property and electric insulating property. On the heating film 42, at two diametrically-opposed positions, there are provided a positive electrode 39 and a negative electrode 40 each placed between the heating film 42 and the casing 41. The lamination structure of the heating film 42 and the electrodes 39 and 40 in FIG. 28 shows a modeled lamination structure in each of the foregoing embodiments. In this lamination structure, meanwhile, in which the heating film 42 is partly overlaid on the electrodes 39 and 40, there is a possibility that a pinhole or pinholes are formed in such an overlaid part of the heating film 42. If condensed water enters in the heating film 42 through the pinhole(s), each electrode 39 and 40 may corrode. In the present embodiment, therefore, the following protective structure is provided to prevent corrosion of each electrode 39 and 40.

Figure 29:
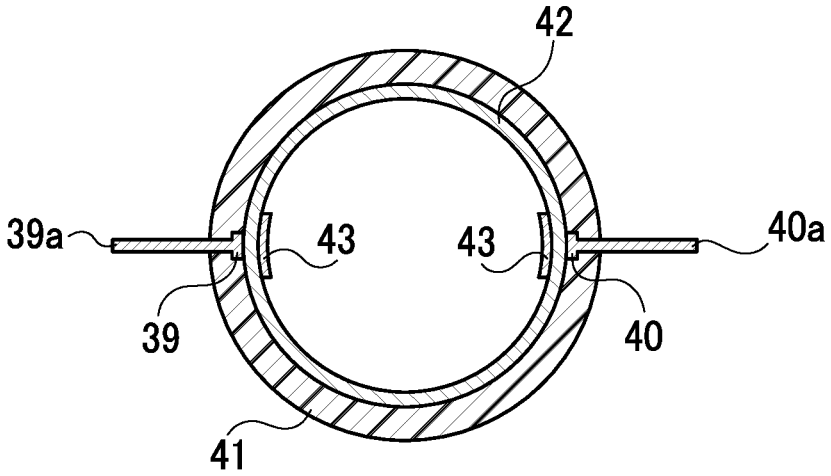
FIG. 29 is a cross-sectional view conforming to FIG. 28 and showing a certain portion of the EGR gas distributor in the eleventh embodiment.

Specifically, FIG. 29 is a cross-sectional view conforming to FIG. 28 and showing a certain portion of the EGR gas distributor 15. In the protective structure in the present embodiment, the heating film 42 is configured so that each portion contacting with the positive electrode 39 and the negative electrode 40 is formed in multiple layers (in two layer). In the present embodiment, specifically, the positive electrode 39, the negative electrode 40, and the heating film 42 are placed on the inner wall 41, and then heating films 43 forming a second layer are overlaid on the heating film 42 at positions corresponding to the positive electrode 39 and the negative electrode 40.

In the above-described configuration, the second-layer heating films 43 are overlaid on the heating film 42 at only the positions corresponding to the positive electrode 39 and the negative electrode 40. As an alternative, this second-layer heating film may be provided over the entire surface of a heating film forming an under layer.

(Operations and Effects of EGR System)

The EGR system configured in the present embodiment described as above can provide the following operations and effects in addition to the operations and effects in each of the foregoing embodiments. In the present embodiment, specifically, the heating film 42 has a multi-layer structure in the parts corresponding to the positive electrode 39 and the negative electrode 40. In other words, the heating films 43 are overlaid on the heating film 42. Accordingly, in case a pinhole(s) is formed in the part(s) of the under-layer heating film 42 at a position(s) corresponding to the positive electrode 39 and the negative electrode 40, the pinhole(s) is closed by the upper-layer heating film(s) 43. This makes it possible to prevent corrosion of the positive electrode 39 and the negative electrode 40 due to penetration of condensed water through the pinhole(s) of the heating film 42.

Twelfth Embodiment

Next, a twelfth embodiment will be described in detail with reference to the accompanying drawings.

(EGR Gas Distributor)

The present embodiment differs from each of the foregoing embodiments in the configurations of a heating film, a positive electrode, and a negative electrode in the EGR gas distributor 15. In this embodiment, similarly, the following protective structure is provided to prevent corrosion of each electrode 39 and 40.

Figure 30:
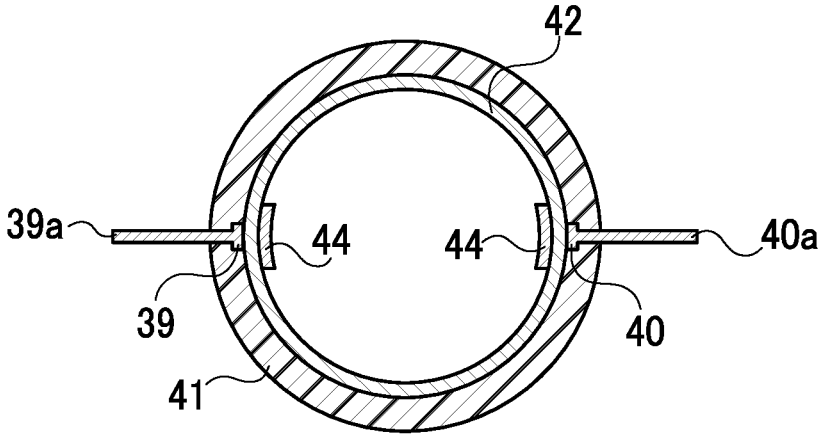
FIG. 30 is a cross-sectional view conforming to FIG. 28 and showing a certain portion of an EGR gas distributor in a twelfth embodiment.

Specifically, FIG. 30 is a cross-sectional view conforming to FIG. 28 and showing a certain portion of the EGR gas distributor 15. In the protective structure in the present embodiment, the heating film 42 is provided with corrosion-resistant materials 44 on the surface at positions corresponding to the positive electrode 39 and the negative electrode 40 as shown in FIG. 30. In the present embodiment, specifically, the positive electrode 39, the negative electrode 40, and the heating film 42 are placed on the inner wall of the casing 41, and then the corrosion-resistant materials 44 are overlaid on the heating film 42 at the positions corresponding to the positive electrode 39 and the negative electrode 40. As the corrosion-resistant materials 44, resin materials can be used.

In the foregoing configuration, the corrosion-resistant materials 44 are overlaid on the heating film 42 at only the positions corresponding to the positive electrode 39 and the negative electrode 40. As an alternative, this corrosion-resistant material 44 may be provided over the entire surface of an under-layer heating film.

(Operations and Effects of EGR System)

The EGR system configured in the present embodiment described as above can provide the following operations and effects in addition to the operations and effects in each of the foregoing embodiments. In the present embodiment, specifically, the heating film 42 is provided with the corrosion-resistant materials 44 placed on the surface at the positions corresponding to the positive electrode 39 and the negative electrode 40. The heating film 42 is thus prevented from corroding in parts contacting with the positive electrode 39 and negative electrode 40. This can further prevent corrosion of the positive electrode 39 and the negative electrode 40 due to penetration of condensed water from a corroded part of the heating film 42.

Thirteenth Embodiment

Next, a thirteenth embodiment will be described in detail with reference to the accompanying drawings.

(EGR Gas Distributor)

The present embodiment differs from each of the foregoing embodiments in the configurations of a heating film, a positive electrode, and a negative electrode in the EGR gas distributor 15. In the present embodiment, similarly, the following protective structure is provided to prevent corrosion of each electrode 39 and 40.

Figure 31:
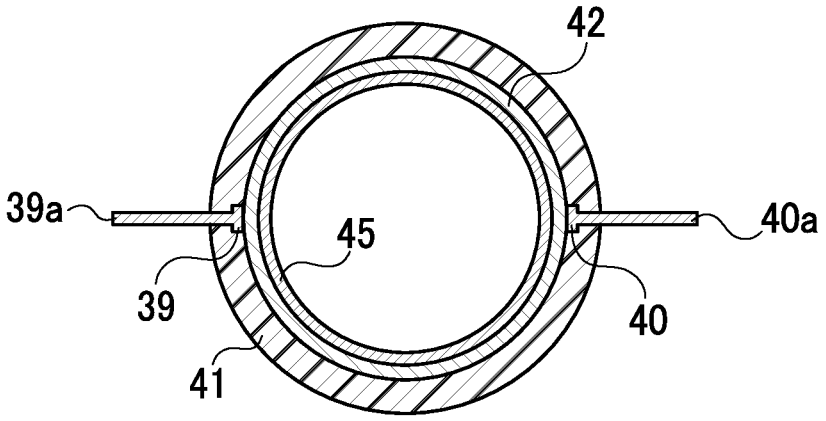
FIG. 31 is a cross-sectional view conforming to FIG. 28 and showing a certain portion of an EGR gas distributor in a thirteenth embodiment.

Specifically, FIG. 31 is a cross-sectional view conforming to FIG. 28 and showing a certain portion of the EGR gas distributor 15. In the protective structure in the present embodiment, the heating film 42 is provided, over its entire surface, with an insulating material 45 as shown in FIG. 31. In the present embodiment, specifically, the positive electrode 39, the negative electrode 40, and the heating film 42 are provided on the inner wall of the casing 41, and then the insulating material 45 is overlaid over the entire surface of the heating film 42.

(Operations and Effects of EGR System)

The EGR system configured in the present embodiment described as above can provide the following operations and effects in addition to the operations and effects in each of the foregoing embodiments. In the present embodiment, specifically, in which the insulating material 45 is provided over the entire surface of the heating film 42, the surface of the heating film 42 is prevented from direct adhesion of carbon (carbon particles) and condensed water, resulting in reduction of electric leakage from the heating film 42. This can prevent a decrease in the amount of heating caused by electric leakage from the heating film 42.

Fourteenth Embodiment

Next, a fourteenth embodiment will be described in detail with reference to the accompanying drawings.

(EGR Gas Distributor)

The present embodiment differs from each of the foregoing embodiments in the configurations of a heating film, a positive electrode, and a negative electrode in the EGR gas distributor 15. In the present embodiment, similarly, the following protective structure is provided to prevent corrosion of each electrode 39 and 40.

Figure 32:
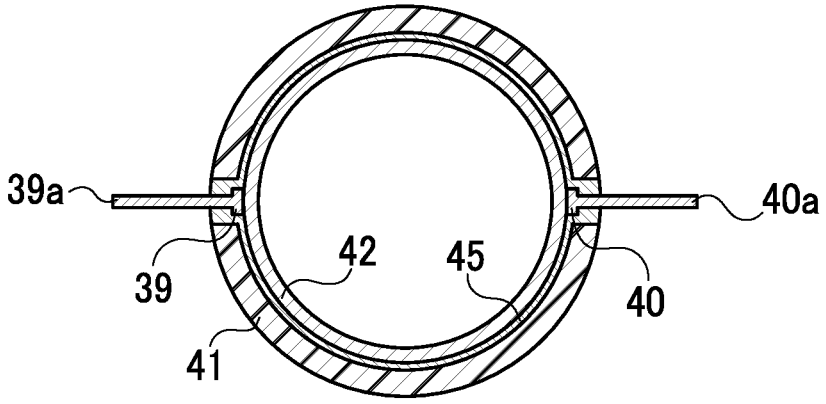
FIG. 32 is a cross-sectional view of a certain portion conforming to FIG. 28 and showing an EGR gas distributor in a fourteenth embodiment.

Specifically, FIG. 32 is a cross-sectional view conforming to FIG. 28 and showing a certain portion of the EGR gas distributor 15. In the present embodiment, the casing 41 is made of resin or rubber having heat-insulating property and electric conductivity. In the lamination structure in the present embodiment, the insulating material 45 is provided in a film form over the entire surface of the inner wall of the casing 41, and the heating film 42 is provided on this insulating material 45, as shown in FIG. 32. The insulating material 45 is further provided between the casing 41 and the positive electrode 39 and between the casing 41 and the negative electrode 40. In the present embodiment, specifically, the insulating material 45 is provided on the inner wall of the casing 41, and then the positive electrode 39, the negative electrode 40, and the heating film 42 are overlaid on the insulating material 45.

(Operations and Effects of EGR System)

The EGR system configured in the present embodiment described as above can provide the following operations and effects in addition to the operations and effects in each of the foregoing embodiments. In the present embodiment, specifically, in the EGR gas distributor 15 (the EGR passage) including the casing 41 made of resin, rubber, or metal, having electric conductivity (a conductive material), the electric conduction of the heating film 42 to the casing 41 is blocked by the insulating material 45, thereby reducing electric leakage from the heating film 42. This can prevent a decrease in the heating amount caused by electric leakage from the heating film 42 when the EGR gas distributor 15 (the EGR passage) is made of a conductive material.

Fifteenth Embodiment

Next, a fifteenth embodiment will be described in detail with reference to the accompanying drawings.

(EGR Gas Distributor)

The present embodiment differs from each of the foregoing embodiments in the joining structure of a casing and a heating film in the EGR gas distributor 15. A heating film may be deformed by heating and thus the heating film may come unstuck from a casing. In the present embodiment, therefore, the following joining structure is provided to prevent unsticking of the heating film in addition to each structure in the first to thirteenth embodiments.

Figure 33:
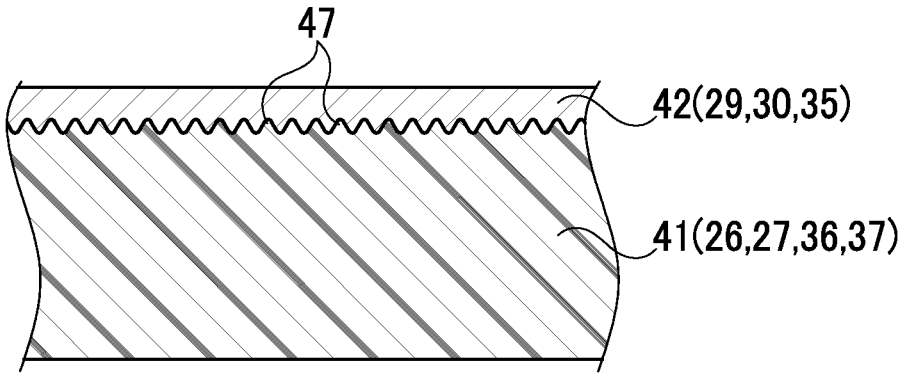
FIG. 33 is an enlarged cross-sectional view of a certain inside portion of an EGR gas distributor in a fifteenth embodiment.

FIG. 33 is an enlarged cross-sectional view of a certain inside portion of the EGR gas distributor 15. In the present embodiment, the inner wall of the casing 41 (26, 27, 36, 37) has an uneven surface formed with microscopic projections and depressions 47 indented in cross-section. The heating film 42 (29, 30, 35) is placed on the microscopic projections and depressions 47. These microscopic projections and depressions 47 can be made in such a way that the surface of the casing 41 is subjected to a mechanical processing such as cutting or a chemical treatment using chemicals or the like. Accordingly, the heating film 42 (29, 30, 35) provided in the casing 41 (26, 27, 36, 37) engages and joins with the inner wall of the casing 41 (26, 27, 36, 37) through the microscopic projections and depressions 47. The foregoing microscopic projections and depressions 47 correspond to one example of a close contact means to hold a close contact relation between the inner wall of the casing 41 (26, 27, 36, 37) and the heating film 42 (29, 30, 35) in the present disclosure.

(Operations and Effects of EGR System)

The EGR system configured in the present embodiment described as above can provide the following operations and effects in addition to the operations and effects in the foregoing first to thirteenth embodiments. In the present embodiment, specifically, the inner wall of the casing 41 (26, 27, 36, 37) of the EGR gas distributor 15 provided with the heating film 42 (29, 30, 35) and the heating film 42 (29, 30, 35) are held in a close contact relation through the microscopic projections and depressions 47. This configuration can strongly join the heating film 42 (29, 30, 35) with the inner wall of the casing 41 (26, 27, 36, 37) of the EGR gas distributor 15 (the EGR passage), thereby preventing the heating film 42 (29, 30, 35) from unsticking from the inner wall of the casing 41 (26, 27, 36, 37).

Sixteenth Embodiment

Next, a sixteenth embodiment will be described in detail with reference to the accompanying drawings.

(EGR Gas Distributor)

The present embodiment differs from the fifteenth embodiment in the joining structure of a casing and a heating film in the EGR gas distributor 15.

Figure 34:
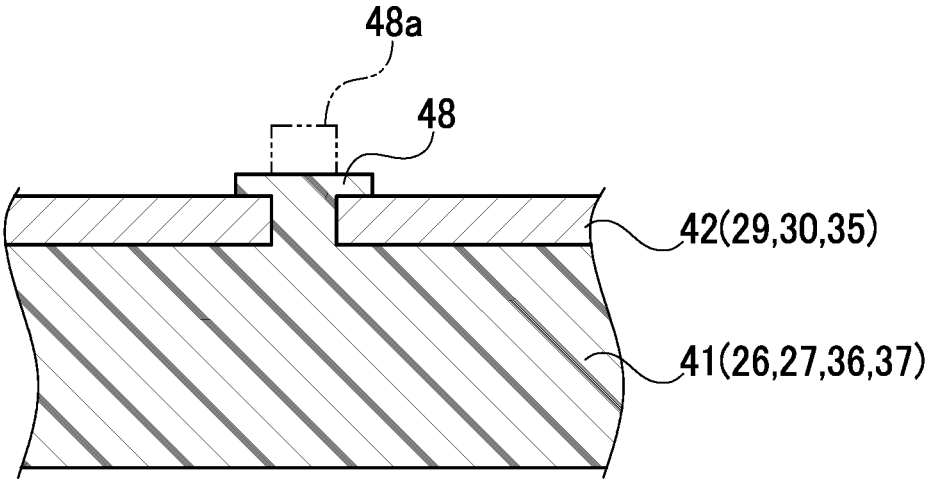
FIG. 34 is an enlarged cross-sectional view of a certain inside portion of an EGR gas distributor in a sixteenth embodiment.

FIG. 34 is an enlarged cross-sectional view of a certain inside portion of the EGR gas distributor 15. In the present embodiment, the heating film 42 (29, 30, 35) provided on the inner wall of the casing 41 (26, 27, 36, 37) is secured by an upset part 48 provided in the casing 41 (26, 27, 36, 37), as shown in FIG. 34. In other words, the inner wall of the casing 41 (26, 27, 36, 37) is provided with a plurality of protrusions 48*a*. The heating film 42 (29, 30, 35) is placed on the inner wall of the casing 41 (26, 27, 36, 37) and then the head of each protrusion 48*a* is heated and squashed, thereby securing the heating film 42 (20, 30, 35) to the casing 41 (26, 27, 36, 37) with the upset parts 48. These upset parts 48 correspond to one example of a close contact means to hold a close contact relation between the inner wall of the casing 41 (26, 27, 36, 37) and the heating film 42 (29, 30, 35) in the present disclosure.

(Operations and Effects of EGR System)

The EGR system configured in the present embodiment described as above can provide the following operations and effects in addition to the operations and effects in the foregoing first to thirteenth embodiments. In the present embodiment, specifically, the inner wall of the casing 41 (26, 27, 36, 37) of the EGR gas distributor 15 provided with the heating film 42 (29, 30, 35) and the heating film 42 (29, 30, 35) are held in a close contact relation through the upset parts 48*a*. This configuration can strongly join the heating film 42 (29, 30, 35) with the inner wall of the casing 41 (26, 27, 36, 37) of the EGR gas distributor 15 (the EGR passage), thereby preventing the heating film 42 (29, 30, 35) from unsticking from the inner wall of the casing 41 (26, 27, 36, 37).

Seventeenth Embodiment

Next, a seventeenth embodiment will be described in detail with reference to the accompanying drawings.

In each of the foregoing embodiments, each of the casings 26 and 27 made of a resin material has a relatively small coefficient of heat conductivity, whereas the heat of each heating film 29 and 30 partly escapes to the casings 26 and 27. This results in an increase in power consumption required to increase the temperature of each heating film 29 and 30 by just the amount of escaped heat. Thus, the present embodiment is different from each of the aforementioned embodiments in addition of the configuration for suppressing heat escape from each heating film 29 and 30 to each casing 26 and 27.

(EGR Gas Distributor)

Figure 35:
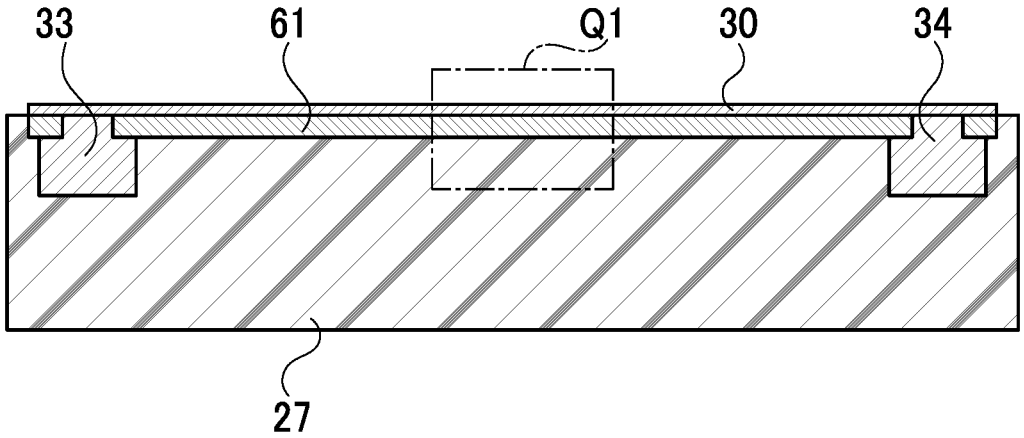
FIG. 35 is a cross-sectional view schematically showing arrangement of a lower casing constituting an EGR gas distributor, and a lower positive electrode, a lower negative electrode, a lower heating film, and others, which are provided in the lower casing, in a seventeenth embodiment.
Figure 36:
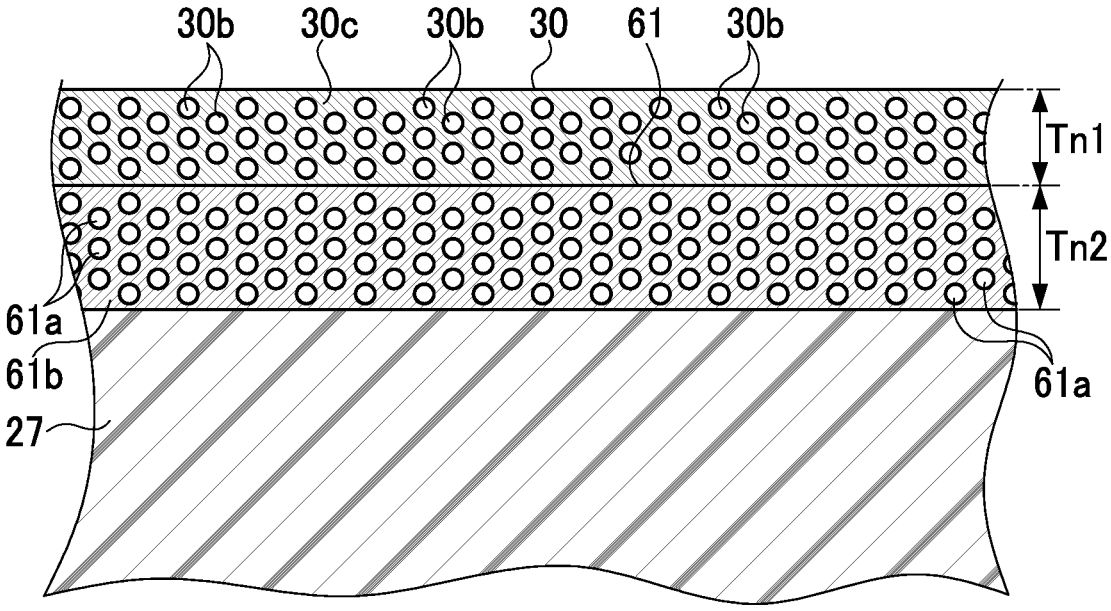
FIG. 36 is an enlarged cross-sectional view showing a part rectangularly enclosed by a chain line in FIG. 35 in the seventeenth embodiment.

FIG. 35 is a cross-sectional view schematically showing arrangement of the lower casing 27 constituting the EGR gas distributor 15, the lower positive electrode 33, lower negative electrode 34, heating film 30, and others provided in the lower casing 27. FIG. 36 is an enlarged cross-sectional view showing a part rectangularly enclosed by a chain line Q1 in FIG. 35. In the present embodiment, the upper casing 26, and the upper positive electrode 31, upper negative electrode 32, upper heating film 29, and others, which are provided on the upper casing 26, are identical to those in the arrangement of the lower casing 27 and thus their details are omitted (the same applies to the following eighteenth to twentieth embodiments).

In the present embodiment, the lower positive electrode 33 and the lower negative electrode 34 are insert-molded in the lower casing 27 as shown in FIG. 35. Further, the upper surfaces of the electrodes 33 and 34 are made to be flush with the surface of the inner wall of the lower casing 27. In the present embodiment, as shown in FIGS. 35 and 36, a heat-insulating film 61 for insulating heat is provided over almost the entire region between the lower heating film 30 and the inner wall of the lower casing 27 provided with the lower heating film 30. In the present embodiment, the heat-insulating film 61 is also provided to partly overlap each of the lower positive electrode 33 and the lower negative electrode 34 as shown in FIG. 35. As an alternative, the heat-insulating film 61 may be provided between the electrodes 33 and 34 without overlapping these electrodes 33 and 34. In the present embodiment, as shown in FIG. 36, the thickness Tn1 of the lower heating film 30 is set smaller than the thickness Tn2 of the heat-insulating film 61. For example, assuming that the thickness Tn1 of the lower heating film 30 is set to 25 μm or more, the thickness Tn2 of the heat-insulating film 61 can be set to 50 μm or more. As the lower heating film 30 is thinner, the heat-insulating film 60 is more necessary in order to suppress heat escape to the lower casing 27. The thickness Tn2 of the heat-insulating film 61 can be set to be equal to or more than the thickness Tn1 of the lower heating film 30.

In the present embodiment, as shown in FIG. 36, the lower heating film 30 contains conductive pigments 30*b* and a binder 30*c*. Further, the heat-insulating film 61 contains hollow pigments 61*a* and a binder 61*b*. In the present embodiment, the binder 30*c* of the lower heating film 30 and the binder 61*b* of the heat-insulating film 61 are made of the same kind of material, for example, fluoro-rubber.

(Operations and Effects of EGR System)

The EGR system configured in the present embodiment described above can provide the following operations and effects in addition to the operations and effects in each of the foregoing embodiments. In the present embodiment, specifically, the heat-insulating film 61 is provided between the inner wall of each casing 26 and 27 of the EGR gas distributor 15 (the EGR passage) and each heating film 29 and 30. This heat-insulating films 61 suppress escape of heat from the heating films 29 and 30 to the corresponding casings 26 and 27. This configuration can enhance the temperature rising efficiency and also reduce power consumption required for such temperature rise.

In a case where different kinds of films are heated and formed into a lamination structure, usually, a heating formation treatment is separately needed for each of various kinds of films. This need for such an additional process for heating formation treatment results in an increased manufacturing cost by just that much. In the present embodiment, the different kinds of films, that is, each heating film 29, 30 and the heat-insulating film 61, are made using the binder 30*c* and the binder 61*b* made of the same kind of material (e.g., fluoro-rubber). Thus, the temperature condition for forming and heating each heating film 29, 30 and the temperature condition for forming and heating the heat-insulating film 61 can be set equal to each other. Accordingly, the heat-insulating films 61 are applied onto the inner walls of the casings 26 and 27 having the insert-molded electrodes 31 to 34, and further the heating films 29 and 30 are individually applied thereon, and then each of the heating films 29 and 30 and the heat-insulating film 61 can be simultaneously formed by heating. Thus, the heating formation process can be completed at one time.

Eighteenth Embodiment

Next, an eighteenth embodiment will be described in detail with reference to the accompanying drawings.

(EGR Gas Distributor)

The present embodiment differs from the seventeenth embodiment in the arrangement of the heat-insulating films 61 in the EGR gas distributor 15.

Figure 37:
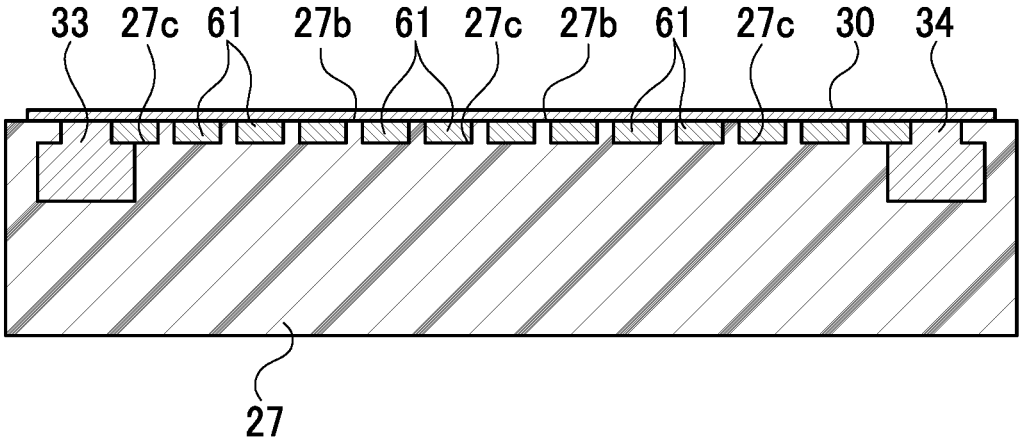
FIG. 37 is a cross-sectional view schematically showing arrangement of a lower casing constituting an EGR gas distributor, and a lower positive electrode, a lower negative electrode, a lower heating film, heat-insulating films, and others, which are provided in the lower casing, in an eighteenth embodiment.
Figure 38:
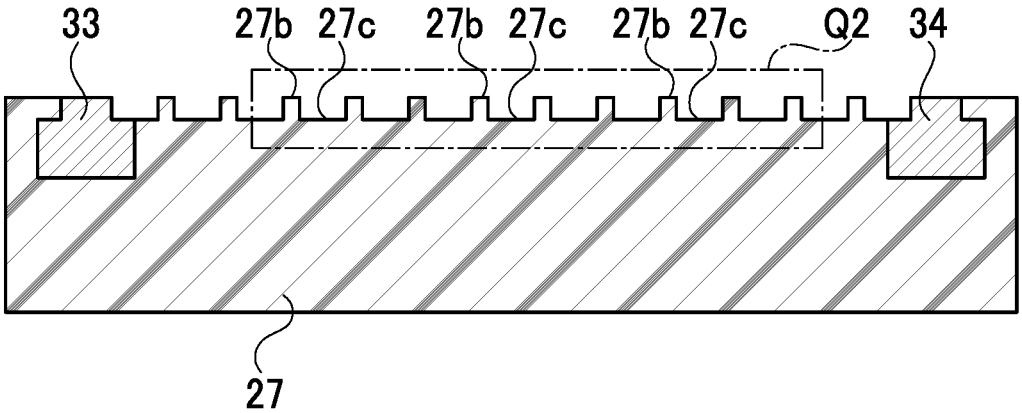
FIG. 38 is a cross-sectional view schematically showing a state where the heating film and the heat-insulating films are omitted from FIG. 37 in the eighteenth embodiment.
Figure 39:
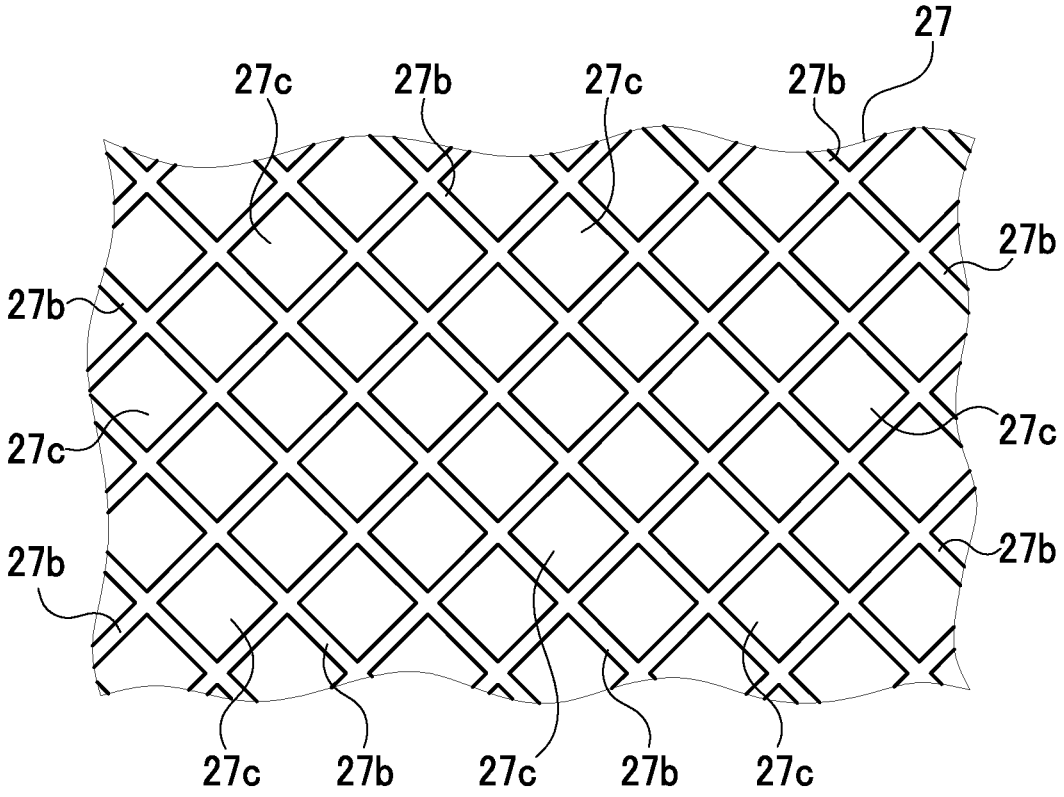
FIG. 39 is an enlarged plan view showing a part rectangularly enclosed by a chain line in FIG. 38 in the eighteenth embodiment.

FIG. 37 is a cross-sectional view schematically showing arrangement of the lower casing 27 constituting the EGR gas distributor 15, and the lower positive electrode 33, lower negative electrode 34, lower heating film 30, and heat-insulating films 61, which are provided in the lower casing 27. FIG. 38 is a cross-sectional view schematically showing a state where the heating film 30 and the heat-insulating films 61 are removed from FIG. 37. FIG. 39 is an enlarged plan view showing a part Q2 rectangularly enclosed by a chain line in FIG. 38. In the present embodiment, as shown in FIGS. 37 to 39, the surface of the inner wall of the lower casing 27 provided with the heat-insulating films 61 is formed to be uneven with a plurality of projections 27*b* and a plurality of depressions 27*c*. In the present embodiment, as shown in FIG. 39, the plurality of projections 27*b* are continuous in a net-like pattern so that each mesh forms a depression 27*c*. In the present embodiment, the surface (the upper end) of each projection 27*b* and the surface (the upper end) of each electrode 33 and 34 are designed with the same height. As an alternative, the height of each projection 27*b* may be set slightly smaller than the height of each electrode 33 and 34. The heat-insulating films 61 are placed in the plurality of depressions 27*c* and also the lower heating film 30 is held over those depressions 27*c*. The heat-insulating films 61 are formed by filling a coating material in the depressions 27*c*.

(Operations and Effects of EGR System)

The EGR system configured in the present embodiment described above can provide the following operations and effects in addition to the operations and effects in the seventeenth embodiment. In the present embodiment, specifically, the surface of the inner wall of each of the casings 26 and 27 (i.e., the inner wall provided with the heat-insulating film) is formed with projections 27*b* and depressions 27*c* and the heat-insulating films 61 are placed in the plurality of depressions 27*c* partitioned by the plurality of projections 27*b*. Accordingly, the heat-insulating films 61 are prevented from freely moving. This configuration can facilitate application and formation of the heat-insulating films 61 in the inclined inner wall of each casing 26 and 27 (the inclined inner wall provided with the heat-insulating films). Further, the heating films 29 and 30 are each held on the plurality of projections 27*b*. Thus, even when the heat-insulating films 61 are uneven (irregular) in thickness, the thickness of each heating film 29 and 30 is not influenced by such an irregular thickness. Accordingly, the thickness of each heating film 29 and 30 can be kept uniform.

Nineteenth Embodiment

Next, a nineteenth embodiment will be described in detail with reference to the accompanying drawings.

In the foregoing eleventh embodiment, there is described that when the heating film 42 is overlaid on each of the electrodes 39 and 40 in FIG. 28, a pinhole(s) may be formed in the relevant part(s) of the heating film 42, leading to corrosion of each electrode 39 and 40 due to penetration of condensed water in the heating film 42 through the pinhole(s). In the forgoing twelfth embodiment, therefore, as shown in FIG. 30, the corrosion-resistant material 44 is overlaid on the heating film 42 at only the positions corresponding to the positive electrode 39 and the negative electrode 40 to prevent corrosion of the electrodes 39 and 40. The present embodiment differs from the twelfth embodiment in the positions at which the corrosion-resistant materials 44 are placed.

(EGR Gas Distributor)

Figure 40:
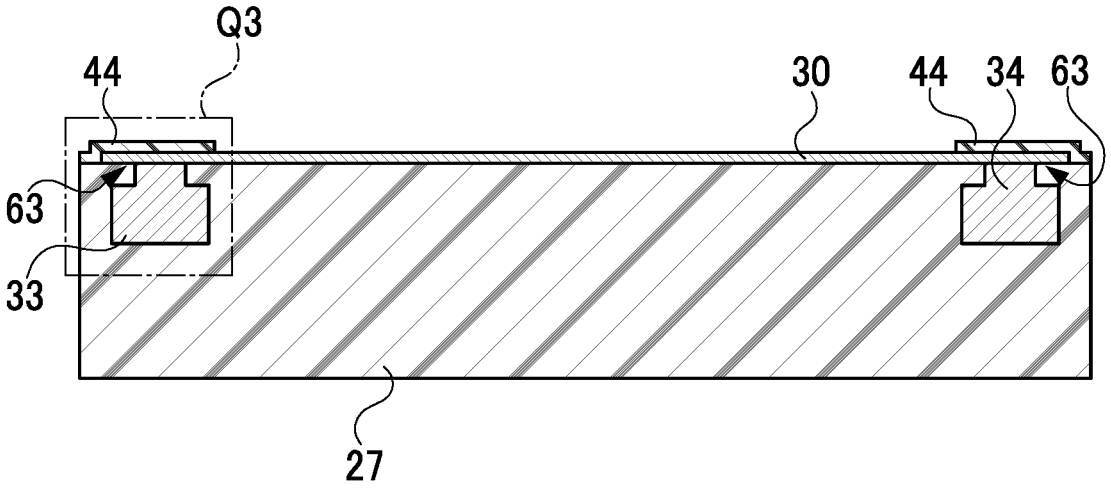
FIG. 40 is a cross-sectional view conforming to FIG. 35 and schematically showing arrangement of a lower casing constituting an EGR gas distributor, and a lower positive electrode, a lower negative electrode, a lower heating film, a corrosion-resistant material, which are provided in the lower casing, in a nineteenth embodiment.
Figure 41:
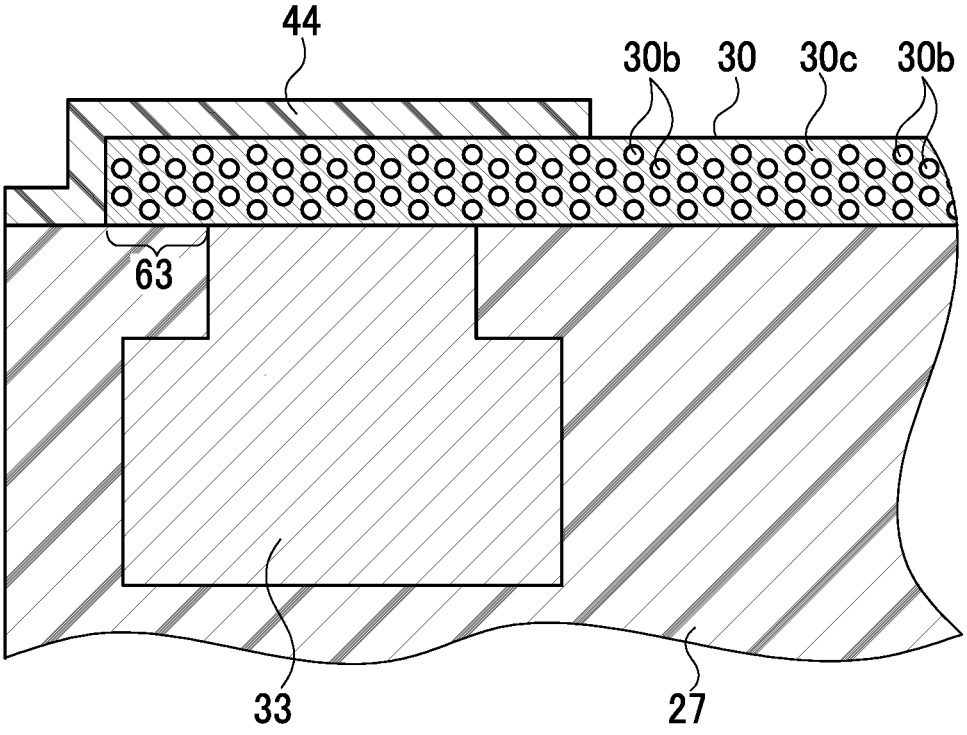
FIG. 41 is an enlarged cross-sectional view of a part rectangularly enclosed by a chain line in FIG. 40 in the nineteenth embodiment.

FIG. 40 is a cross-sectional view conforming to FIG. 35 and schematically showing arrangement of the lower casing 27 constituting the EGR gas distributor 15, and the lower positive electrode 33, lower negative electrode 34, lower heating film 30, and corrosion-resistant material 44, which are provided in the lower casing 27. FIG. 41 is an enlarged cross-sectional view of a part Q3 rectangularly enclosed by a chain line in FIG. 40. In this embodiment, similarly, the electrodes 33 and 34 are insert-molded in the lower casing 27 so that the upper surfaces of the electrodes 33 and 34 are flush with the surface of the inner wall of the lower casing 27 as shown in FIGS. 40 and 41. In the present embodiment, different from the foregoing seventeenth and eighteenth embodiments, the heat-insulating films 61 are not provided between the lower casing 27 and the lower heating film 30. However, the present embodiment is also applicable to the configuration provided with the heat-insulating films, but the details of this configuration provided with the heat-insulating films is omitted herein.

In the present embodiment, as shown in FIGS. 40 and 41, corrosion-resistant materials 44 are individually provided at positions corresponding to the electrodes 33 and 34 and further provided on the portions including an edge of the lower heating film 30 and an interface 63 between the lower heating film 30 and the inner wall of the lower casing 27. In the present embodiment, especially, the end of the corrosion-resistant material 44 is provided to continuously extend onto the upper surface of the lower casing 27. In the present embodiment, as the corrosion-resistant material 44, Teflon™ is used. In the present embodiment, the lower heating film 30 is applied onto the inner wall of the lower casing 27 having the electrodes 33 and 34 insert-molded, and further the corrosion-resistant material 44 is applied onto portions of the applied lower heating film 30 including the portions corresponding to the electrodes 33 and 34 and the interface 63, and then the lower heating film 30 and the corrosion-resistant materials 44 are simultaneously heated and formed. Thus, the heating-forming process is completed at once.

(Operations and Effects of EGR System)

The EGR system configured in the present embodiment described above can provide the following operations and effects in addition to the operations and effects in the twelfth embodiment. In the present embodiment, specifically, the corrosion-resistant materials 44 are provided on the portions of the heating film 29 each including the interface 63 between the edge of the heating film 29 and the inner wall of the casing 26 and the portions of the heating film 30 each including the interface 63 between the edge of the heating film 30 and the inner wall of the casing 27. Thus, these portions including the interface 63 between the edge of each heating film 29, 30 and the inner wall of each casing 26 and 27 can be prevented from corrosion. This can prevent corrosion of each electrode 31 to 34 due to penetration of condensed water from a corroded portion of the portions including the interface 63 between the edge of each heating film 29, 30 and the inner wall of each casing 26 and 27.

Twentieth Embodiment

Next, a twentieth embodiment will be described in detail with reference to the accompanying drawings.

The present embodiment differs from each of the foregoing seventeenth to nineteenth embodiments in how to provide the heating films 29 and 30 to a portion corresponding to each electrode 31 to 34.

(EGR Gas Distributor)

Figure 42:
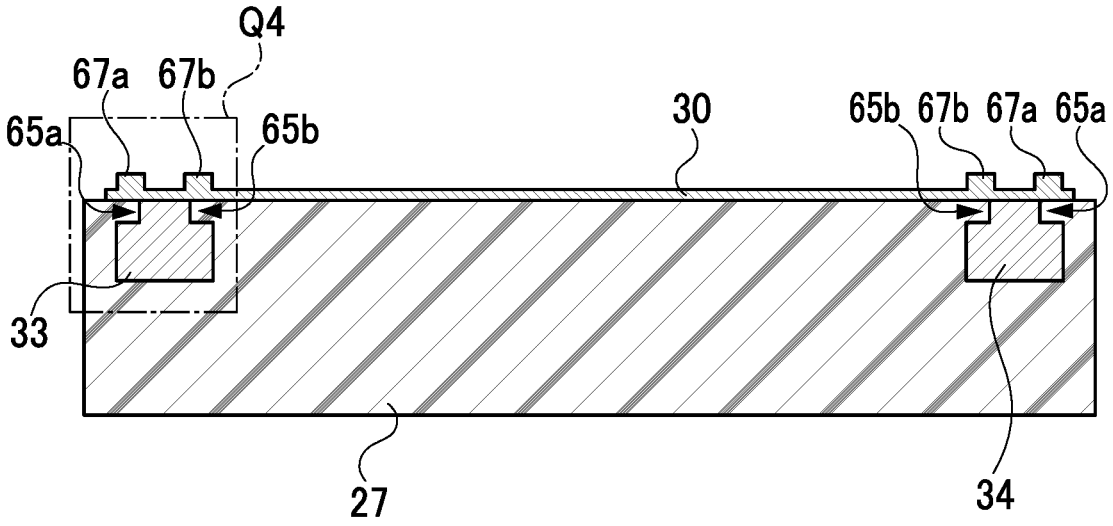
FIG. 42 is a cross-sectional view conforming to FIG. 40 and schematically showing arrangement of a lower casing constituting an EGR gas distributor, and a lower positive electrode, a lower negative electrode, and a lower heating film, which are provided in the lower casing, in a twentieth embodiment.
Figure 43:
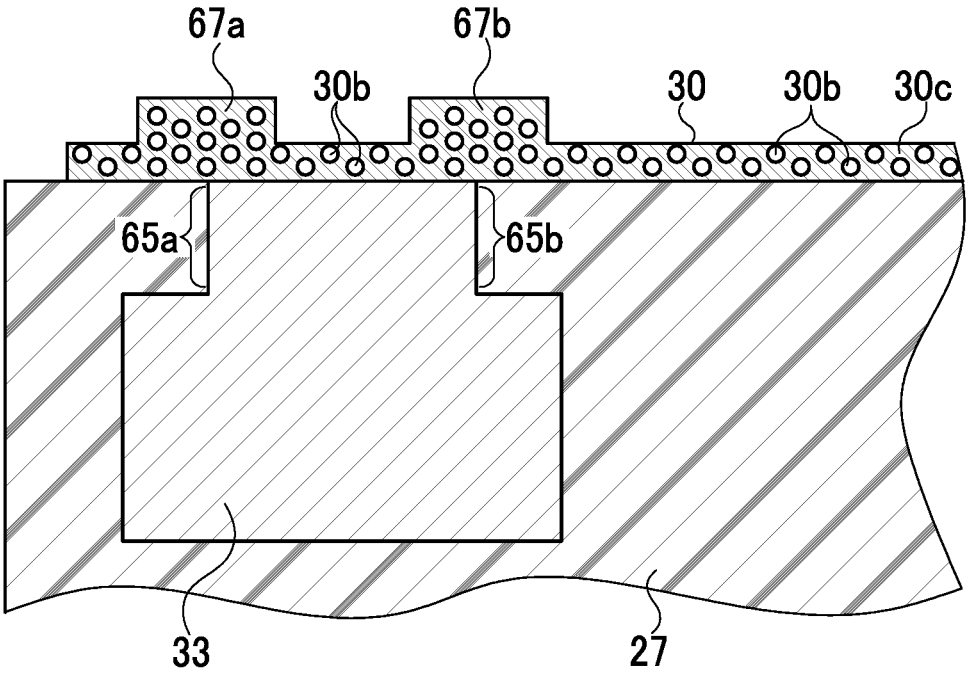
FIG. 43 is an enlarged cross-sectional view showing a part rectangularly enclosed by a chain line in FIG. 42 in the twentieth embodiment.

FIG. 42 is a cross-sectional view conforming to FIG. 40 and schematically showing arrangement of the lower casing 27 constituting the EGR gas distributor 15, and the lower positive electrode 33, the lower negative electrode 34, and a lower heating film 30, which are provided in the lower casing 27. FIG. 43 is an enlarged cross-sectional view showing a part Q4 rectangularly enclosed by a chain line in FIG. 42. In the present embodiment, as shown in FIGS. 42 and 43, each of the electrodes 33 and 34 is insert-molded in the lower casing 27 so that the upper surfaces of the electrodes 33 and 34 are flush with the surface of the inner wall of the lower casing 27. In the present embodiment, as in the foregoing nineteenth embodiment, the heat-insulating films 61 are not provided between the lower casing 27 and the lower heating film 30. However, the present embodiment is also applicable to the configuration provided with the heat-insulating films, but the details of this configuration provided with the heat-insulating films is omitted herein.

In the present embodiment, as shown in FIGS. 42 and 43, the electrodes 33 and 34 are provided with their upper surfaces exposed at the surface of the inner wall of the lower casing 27 so that the upper surfaces of the electrodes 33 and 34 are flush with the surface of the inner wall of the lower casing 27. Herein, mating surfaces 65*a* and 65*b* of the lower casing 27 with each of the electrodes 33 and 34 may fracture due to a heat expansion difference between each electrode 33, 34 and the lower casing 27. This may cause fracture(s) or crack(s) in the lower heating film 30, resulting in deterioration in local resistance between each lower electrode 33, 34 and the lower heating film 30. In the present embodiment, therefore, the lower positive electrode 33 and the lower negative electrode 34 are provided to be exposed at the surface of the inner wall of the lower casing 27 and also the lower heating film 30 is provided to cover the electrodes 33 and 34. Furthermore, the mating surfaces of the inner wall of the lower casing 27 with the lower positive electrode 33 include the inside mating surface 65*b* on the inner side facing inward to the lower negative electrode 34 and the outside mating surface 65*a* on the opposite side to the inside mating surface 65*b*. Similarly, the mating surfaces of inner wall of the lower casing 27 with the lower negative electrode 34 include the inside mating surface 65*b* on the inner side facing inward to the lower positive electrode 33 and the outside mating surface 65*a* on the opposite side to the inside mating surface 65*b*. In the present embodiment, furthermore, the lower heating film 30 is provided with the thickness larger on the portions of the inner wall including the two mating surfaces 65*a* and 65*b* with respect to the lower positive electrode 33 and on the portions of the inner wall including the two mating surfaces 65*a* and 65*b* with respect to the lower negative electrode 34 than on other portions of the inner wall. In the present embodiment, for each of the electrodes 33 and 34, the lower heating film 30 includes an outside thick film portion 67*a* and an inside thick film portion 67*b* which are thicker than other portions of the lower heating film 30 and located at positions corresponding to the two mating surfaces 65*a* and 65*b* respectively.

In the present embodiment, the thick film portions 67*a* and 67*b* each having a thick thickness are formed together with other portions of the lower heating film 30 which are not thick in thickness than the thick film portions 67*a* and 67*b* by simultaneous coating of a coating material. As an alternative, each of the thick film portions 67*a* and 67*b* may be formed in two layers by double coating of a coating material for only the thick film portions 67*a* and 67*b* to have a thicker thickness than other portions. In the present embodiment, for each of the electrodes 33 and 34, the lower heating film 30 is provided with a thicker thickness on the portion including the outside mating surface 65*a* and the inside mating surface 65*b* than other portions. As an alternative, for each of the electrodes 33 and 34, the lower heating film 30 may be provided with a thicker thickness only on the portion including the inside mating surface 65*b* than other portions.

(Operations and Effects of EGR System)

The EGR system configured in the present embodiment described above can provide the following operations and effects in addition to the operations and effects in the first to eleventh embodiments. In the present embodiment, specifically, each of the heating electrodes 29 and 30 is provided to cover the electrodes 31 to 34 and also each heating film 29 and 30 includes the thick film portions 67*a* and 67*b* that are located on the portions including the mating surfaces 65*a* and 65*b* between each electrode 31 to 34 and the inner wall of each casing 26 and 27 and have a thicker thickness than other portions of the heating films 29 and 30. This configuration can prevent deformation and thinning of each heating film 29 and 30 due to heat expansion difference at the mating surface 65*a* and 65*b* between each electrode 31 to 34 and the inner wall of each casing 26 and 27. Accordingly, each of the heating films 29 and 30 can have enhanced failure-bearing capability against heat expansion difference at the mating surfaces 65*a* and 65*b* between each electrode 31 to 34 and the inner wall of each casing 26 and 27 and also prevent deterioration in local resistance due to thinning of the film.

Figure 44:
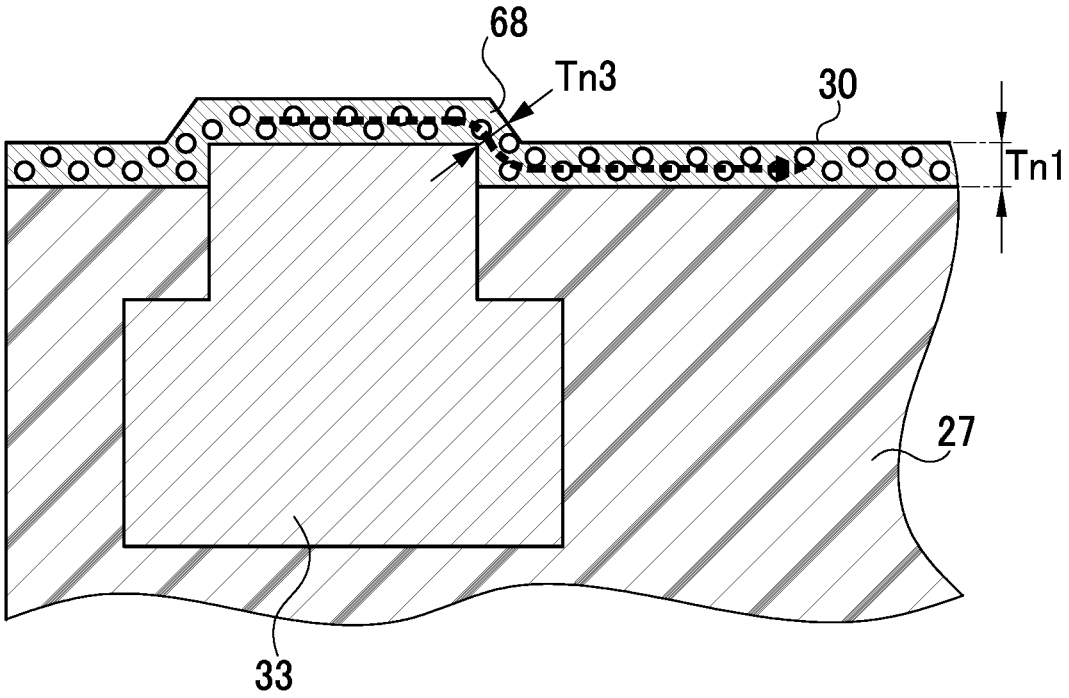
FIG. 44 is an enlarged cross-sectional view conforming to FIG. 43 and showing a part of the lower heating film on a positive electrode in the twentieth embodiment.

Meanwhile, when the electrodes 33 and 34 are insert-molded in the lower casing 27, production variations and other reasons may cause some defects that the upper surface of the positive electrode 33 protrudes out of the upper surface of the lower casing 27 as shown in FIG. 44 or the upper surface of the positive electrode 33 is dented than the upper surface of the lower casing 27. If the upper surface of the positive electrode 33 protrudes as shown in FIG. 44, when the lower heating film 30 is coated on the lower casing 27, this coating film sags downward at a protruding corner of the positive electrode 33. Thus, this sagging film portion may cause thinning of the lower heating film 30 (the thickness of the sagging portion 68 is assumed as Tn3). In this case, an electric current applied to the lower heating film 30 flows as indicated by a broken arrow in FIG. 44, in which the electric resistance increases in the sagging portion 68, and thus this electric resistance becomes a maximum resistance of the lower heating film 30. This results in deterioration in heating performance of the lower heating film 30, so that the heating performance by the original thickness Tn1 of the lower heating film 30 could not be exhibited. FIG. 44 is an enlarged cross-sectional view conforming to FIG. 43 and showing the portion of the lower heating film 30 on the positive electrode 33.

Figure 45:
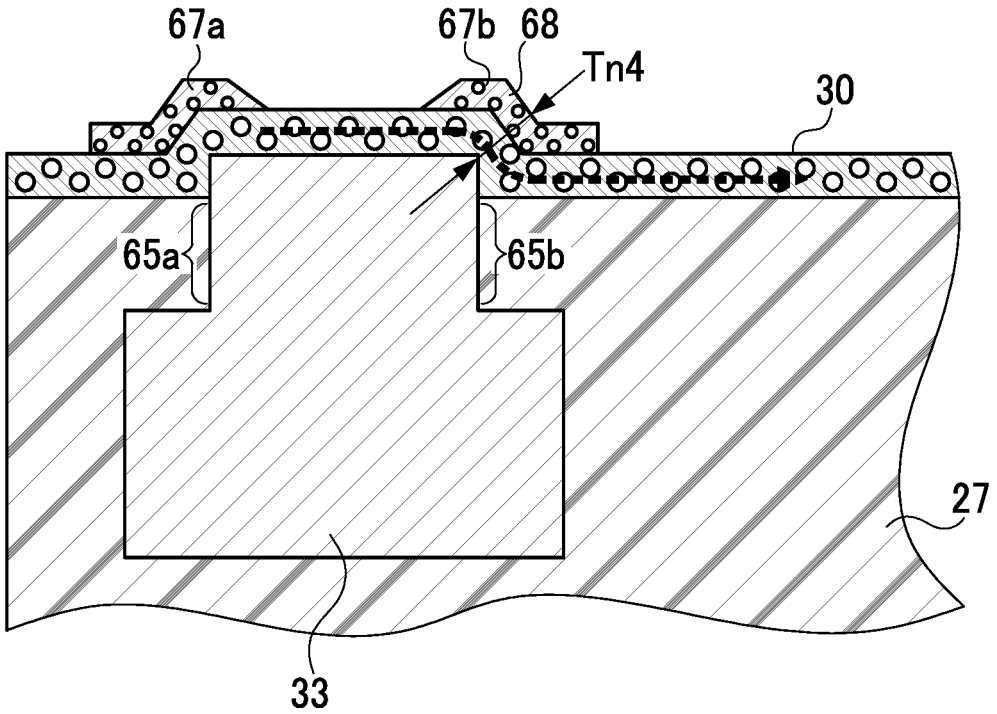
FIG. 45 is an enlarged cross-sectional view conforming to FIG. 44 and showing a part of the lower heating film on the positive electrode in the twentieth embodiment.

In the present embodiment, the thick film portions 67*a* and 67*b* are provided in the lower heating film 30 at positions corresponding to the mating surfaces 65*a* and 65*b* of the inner wall mating with the electrodes 33 and 34, thereby enabling to prevent deterioration in the foregoing heating performance. FIG. 45 is an enlarged cross-sectional view conforming to FIG. 44 and showing the portion of the lower heating film 30 on the positive electrode 33. FIG. 45 illustrates the configuration that the lower heating film 30 is formed in a two-layer structure including each thick film portion 67*a* and 67*b*. Since the lower heating film 30 is provided with the thick film portions 67*a* and 67*b* at positions respectively corresponding to the mating surfaces 65*a* and 65*b* of the inner wall mating with each electrode 33, 34 as shown in FIG. 45, even on the sagging portion 68 corresponding to the protruding corner of the positive electrode 33, the thickness Tn4 of the lower heating film 30 with the thick film portion 67*b* is also larger than the original thickness Tn1. As a result, the sagging portion 68 of the lower heating film 30 does not become a maximum resistance site, thus preventing the deterioration in heating performance of the lower heating film 30.

In the present embodiment, the outside thick film portion 67*a* and the inside thick film portion 67*b* are separately provided on the lower heating film 30 for the positive electrode 33; alternatively, the outside thick film portion 67*a* and the inside thick film portion 67*b* may be continuously provided. In the present embodiment, furthermore, both the outside thick film portion 67*a* and the inside thick film portion 67*b* are provided on the lower heating film 30 for the positive electrode 33; alternatively, either one of the outside thick film portion 67*a* and the inside thick film portion 67*b* may be provided. Herein, when only the outside thick film portion 67*a* is provided, it is possible to prevent fracture of the lower heating film 30 due to a heat expansion difference at the outside mating surface 65*a* between the positive electrode 33 and the inner wall and also prevent corrosion of the positive electrode 33 at a fractured site. In contrast, when only the inside thick film portion 67*b* is provided, it is possible to prevent fracture of the lower heating film 30 and corrosion of the positive electrode 33 at a fractured site and additionally prevent deterioration in heating performance of the lower heating film 30.

Twenty-First Embodiment

Next, a twenty-first embodiment will be described in detail with reference to the accompanying drawings.

(Intake Passage)

The present embodiment differs from each of the foregoing embodiments in that a portion or portions of the engine system is provided with a heating film. Each foregoing embodiment describes the heating film 42 (29, 30, 35) provided on the inner wall of the casing 41 (26, 27, 36, 37) of the EGR gas distributor 15 (the EGR passage) and a related structure to the heating film. This twenty-first embodiment, in contrast, describes that the heating film 42 (29, 30, 35) provided in each foregoing embodiment and a related structure to each heating film are provided in an intake passage through which the EGR gas is allowed to flow, not in the EGR gas distributor 15.

Figure 46:
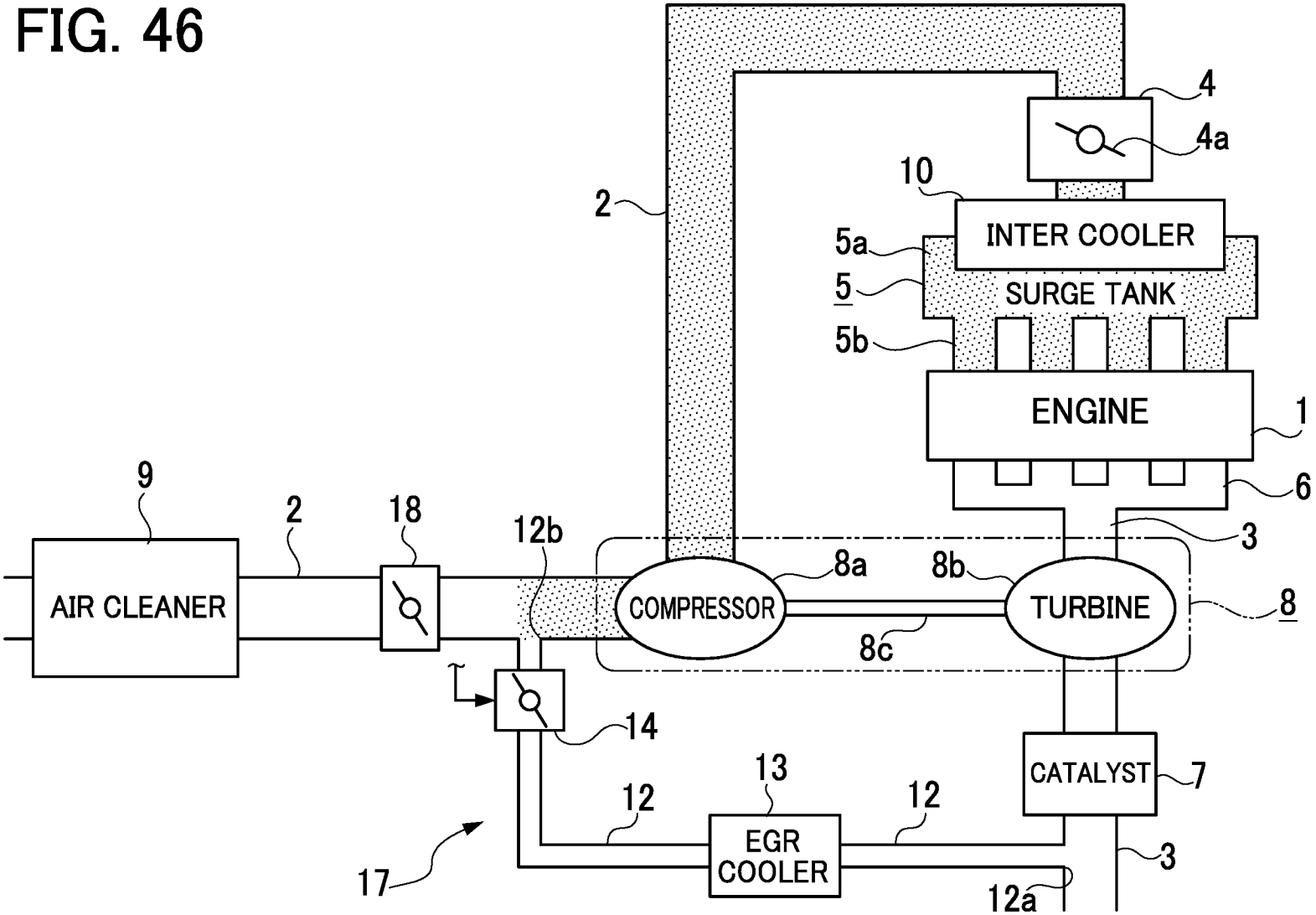
FIG. 46 is a schematic configuration view showing another engine system in a twenty-first embodiment.

Specifically, FIG. 46 is a schematic configuration view of another engine system. This engine system is configured such that a supercharger 8 is placed in an intake passage 2 and an exhaust passage 3 of an engine 1, and a low-pressure loop EGR device 17 is placed between the intake passage 2 and the exhaust passage 3, as shown in FIG. 46. The supercharger 8 includes a compressor 8*a* provided in the intake passage 2, a turbine 8*b* provided in the exhaust passage 3, and a rotary shaft 8*c* with which the compressor 8*a* and the turbine 8*b* are rotated together. The compressor 8*a* is placed in the intake passage 2 upstream of a throttle device 4. In the intake passage 2 upstream of the compressor 8*a*, an intake throttle valve 18 and an air cleaner 9 are provided. The turbine 8*b* is placed in the exhaust passage 3 between an exhaust manifold 6 and a catalyst 7. The surge tank 5*a* is provided with an intercooler 10. An EGR passage 12 constituting the EGR device 17 includes an inlet 12*a* connected to the exhaust passage 3 downstream of the catalyst 7 and an outlet 12*b* connected to the intake passage 2 between the compressor 8*a* and the intake throttle valve 18. In the EGR passage 12, an EGR cooler 13 and an EGR valve 14 are provided.

In FIG. 46, such parts of the intake passage 2 as provided with the heating film 42 (29, 30, 35) and its related structure in each foregoing embodiment are hatched with dots. In the present embodiment, specifically, the heating film 42 (29, 30, 35) and its related structure in each foregoing embodiment are provided in the part of the intake passage 2 between the outlet 12*b* of the EGR passage 12 and the compressor 8*a* and in the part of the intake passage 2 between the compressor 8*a* and the engine 1, and further in the intake manifold 5.

(Operations and Effects of EGR System)

The EGR system configured in the present embodiment described above can provide the equivalent operations and effects to those in each of the foregoing embodiments in relation to the parts of the intake passage 2 and the intake manifold 5, each provided with the heating film 42 (29, 30, 35) and its related structure.

Twenty-Second Embodiment

Next, a twenty-second embodiment will be described in detail with reference to the accompanying drawings.

The present embodiment differs from each of the foregoing first to sixteenth, nineteenth, and twentieth embodiments in the position of the heating film provided in the EGR gas distributor. Specifically, the first to twentieth embodiments describe the heating film 42 (29, 30, 35) and its related structure provided in the inner wall of the casing 41 (26, 27, 36, 37) of the EGR gas distributor 15. In contrast, the present embodiment describes the configuration that a heating film is provided on an outer wall of the EGR gas distributor, not on an inner wall.

(Intake Manifold Provided with the EGR Gas Distributor)

Figure 47:
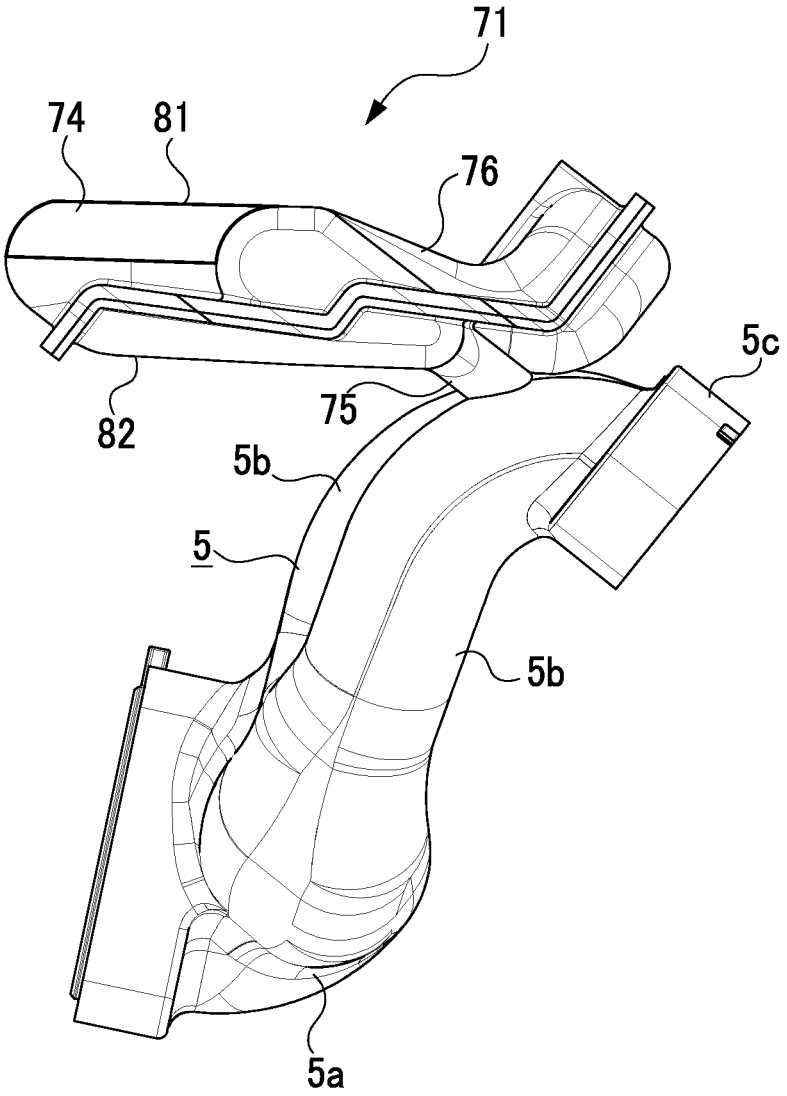
FIG. 47 is a side view of an intake manifold provided with an EGR gas distributor in a twenty-second embodiment.
Figure 48:
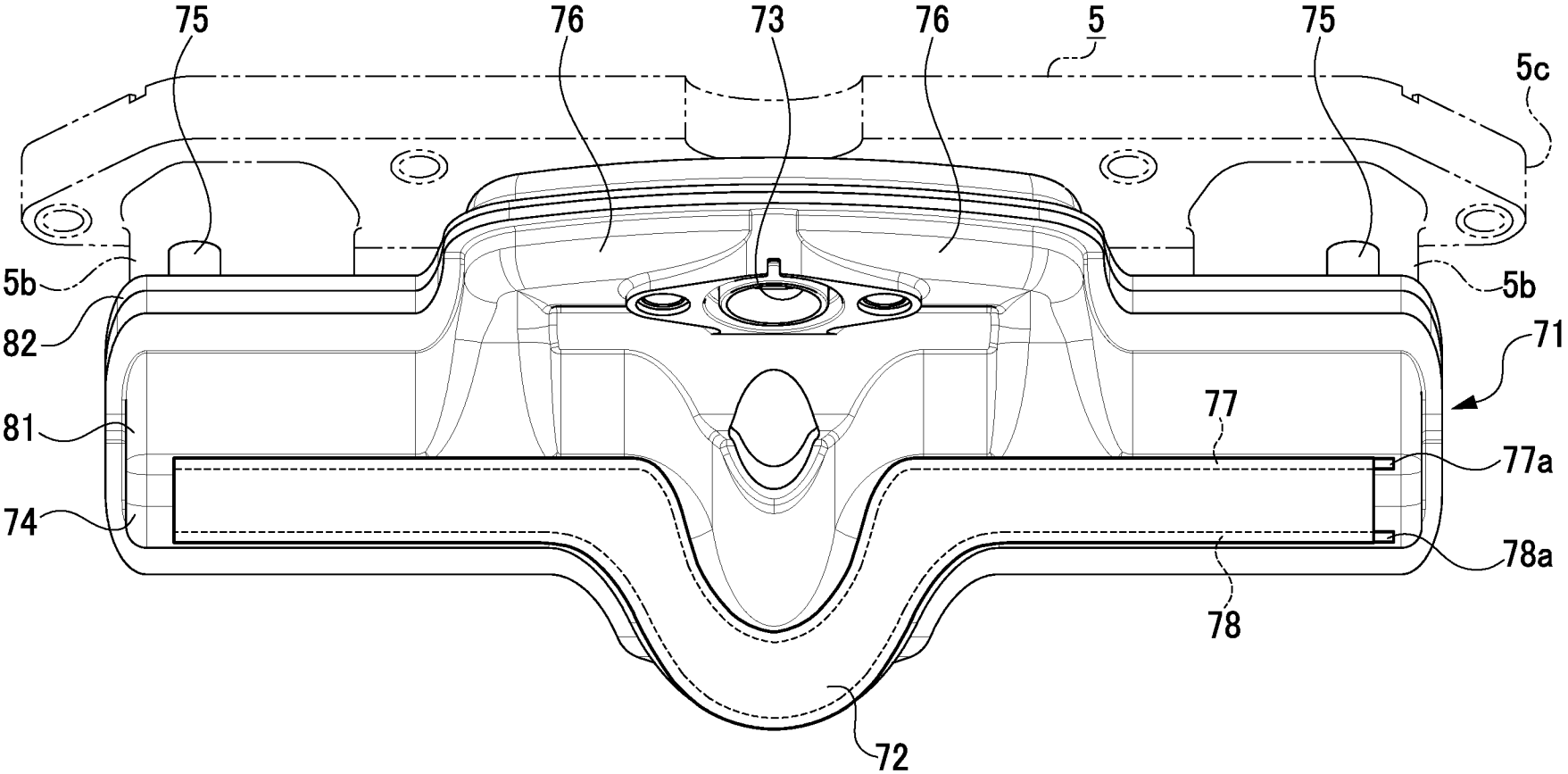
FIG. 48 is a plan view of an EGR gas distributor provided in the intake manifold in the twenty-second embodiment.

FIG. 47 is a side view of the intake manifold 5 provided with an EGR gas distributor 71 in the present embodiment. FIG. 48 is a plan view of the EGR gas distributor 71 provided on the intake manifold 5. In the present embodiment, the intake manifold 5 and the EGR gas distributor 71 are also produced separately and thereafter the completed EGR gas distributor 71 is retrofitted onto the completed intake manifold 5. In this embodiment, the EGR gas distributor 71 is also placed on the upper side of a plurality of branch pipes 5*b* of the intake manifold 5.

(EGR Gas Distributor)

Figure 49:
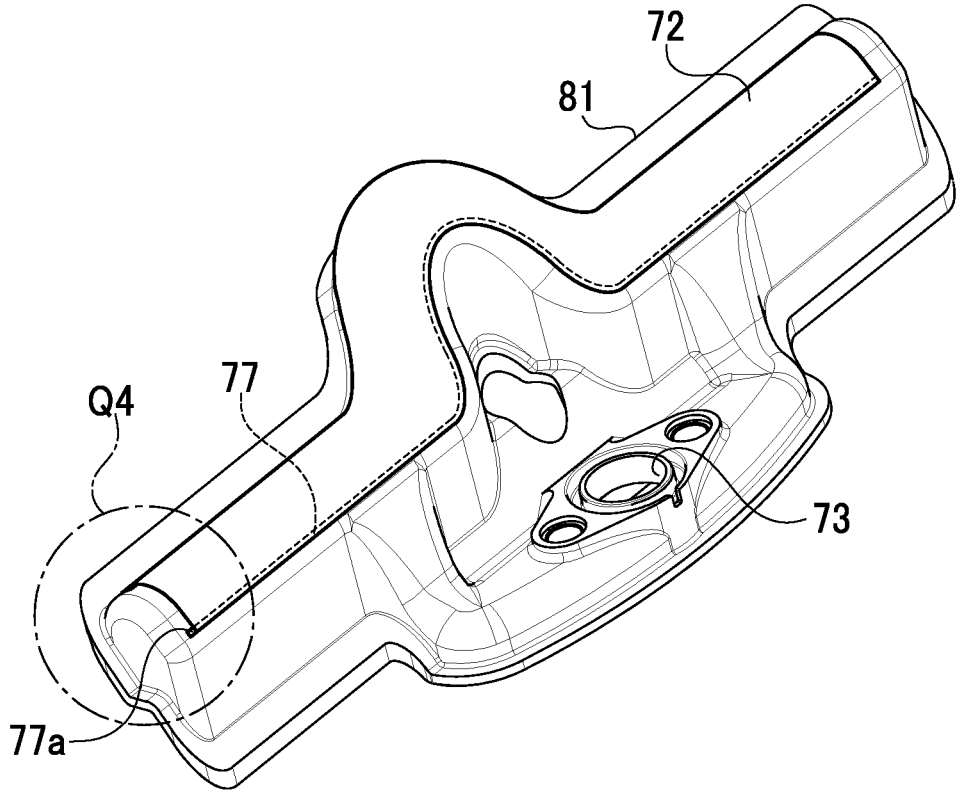
FIG. 49 is a perspective view showing the outside of an upper casing in the twenty-second embodiment.
Figure 50:
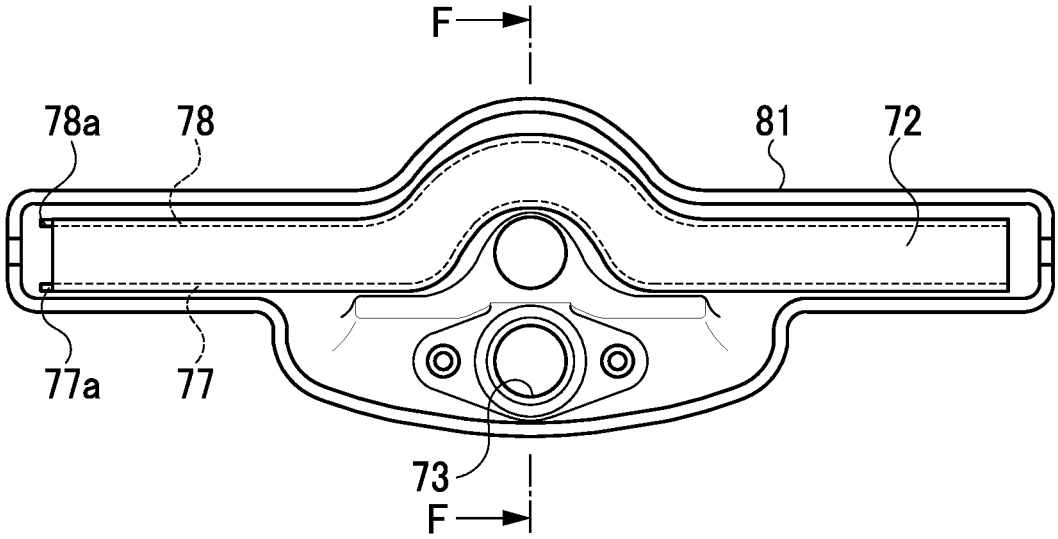
FIG. 50 is a plan view showing the outside of the upper casing in the twenty-second embodiment.

The EGR gas distributor 71 is constituted of an upper casing 81 and a lower casing 82 which form the outer shape of the EGR gas distributor 71 as shown in FIGS. 47 and 48. FIG. 49 is a perspective view showing the outside of the upper casing 81 and FIG. 50 is a plan view showing the outside of the upper casing 81. In the present embodiment, the upper casing 81 and the lower casing 82 are each made of resin material. On each of the outer wall of the upper casing 81 and the outer wall of the lower casing 82, a heating film 72 is provided to heat the EGR gas distributor 71. This EGR gas distributor 71 includes a gas inlet 73 for introducing EGR gas, a gas chamber 74 configured to collect the EGR gas introduced therein through the gas inlet 73 and placed across the plurality of branch pipes 5*b*, a plurality of (four) gas distribution passages 75 (some of which are shown in FIGS. 47 and 48) branched off from the gas chamber 74 and communicated with each corresponding branch pipe 5*b* of the intake manifold 5, and branch passages 76 bifurcated at the gas inlet 73 and communicated with the gas chamber 74. In the present embodiment, as shown in FIGS. 47 to 50, the upper casing 81 and the lower casing 82, which form the gas chamber 74, each include a protruding central portion curved in a mountain-like shape or a U-shaped form. In the present embodiment, the heating films 72 are individually provided on the outer wall of the upper casing 81 and the outer wall of the lower casing 82 which constitute the gas chamber 74 (the heating film 72 provided to the lower casing 82 is not illustrated).

Figure 51:
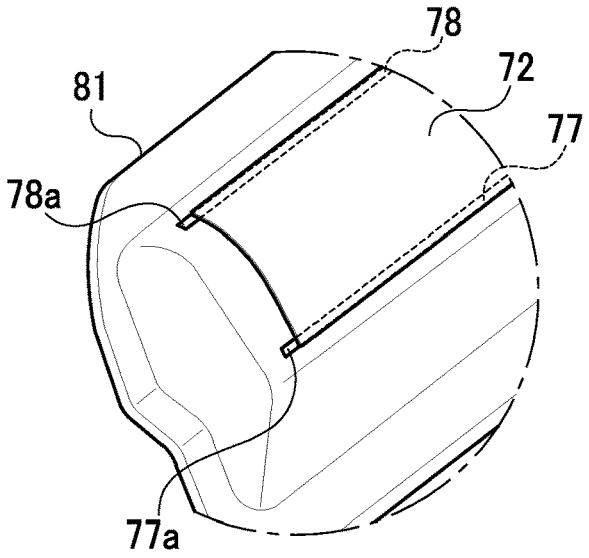
FIG. 51 is an enlarged perspective view of a part of the upper casing, circularly enclosed by a chain line in FIG. 49, in the twenty-second embodiment.
Figure 52:
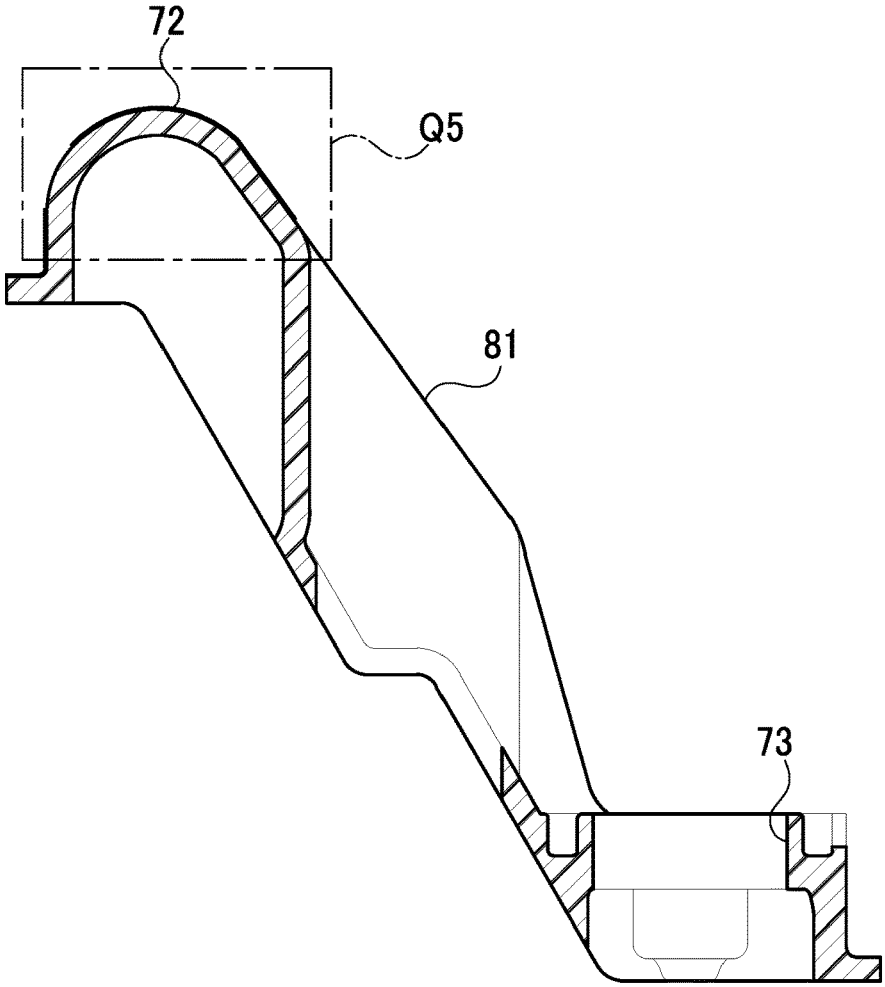
FIG. 52 is a cross-sectional view of the upper casing taken along a line F-F in FIG. 50, in the twenty-second embodiment.
Figure 53:
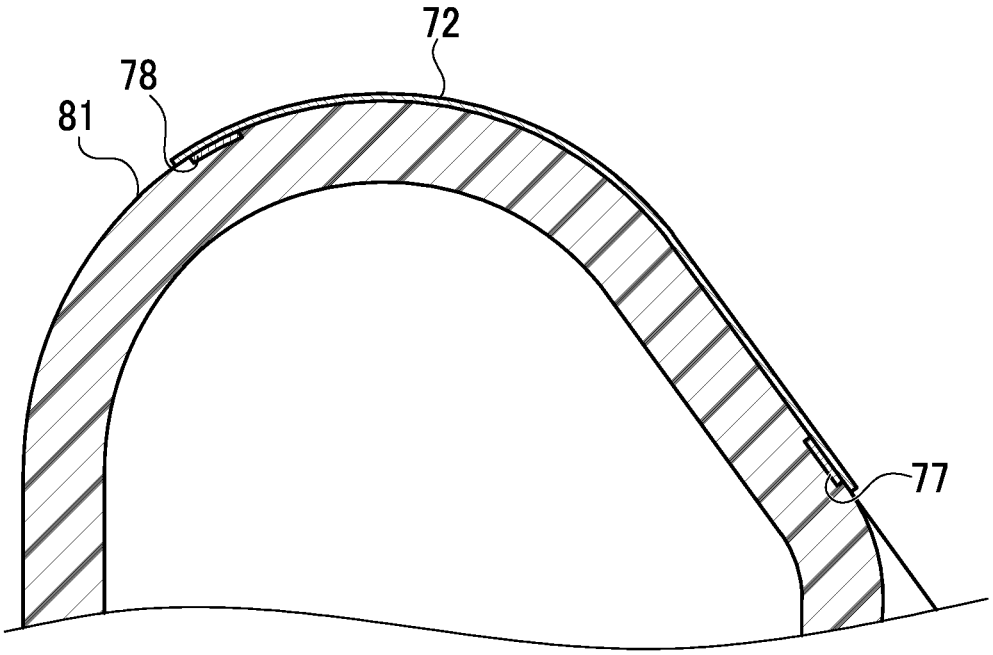
FIG. 53 is an enlarged cross-sectional view of a part of the upper casing, rectangularly enclosed by a chain line in FIG. 52, in the twenty-second embodiment.

FIG. 51 is an enlarged perspective view of a part of the upper casing 81, circularly enclosed by a chain line Q4 in FIG. 49. FIG. 52 is a cross-sectional view of the upper casing 81 taken along a line F-F in FIG. 50. FIG. 53 is an enlarged cross-sectional view of a part of the upper casing 81, rectangularly enclosed by a chain line Q5 in FIG. 52. As shown in FIGS. 48 to 53, the heating film 72 is provided in a strip shape along the protruding curved mountain-like or U-shaped form of the gas chamber 74 of the EGR gas distributor 71. At both edges of the heating film 72 in its width direction (i.e., in a vertical direction in FIG. 48), a positive electrode 77 and a negative electrode 78 are provided between the heating film 72 and the outer wall of the upper casing 81. The positive electrode 77 is provided, at one end, with a positive terminal 77*a*. The negative electrode 78 is provided, at one end, with a negative terminal 78*a*. These terminals 77*a* and 78*a* are connected to respective power supply lines. Herein, even though it is not illustrated, the outer wall of the lower casing 82 is also provided with the heating film, positive electrode, negative electrode, positive terminal, and negative terminal, as with the upper casing 81.

(Operations and Effects of EGR System)

The EGR system configured in the present embodiment described above is different from the first embodiment in that the heating film 72 is provided on the outer wall of the EGR gas distributor 71 (the upper casing 81 and the lower casing 82), not on the inner wall; however, the present embodiment can provide the equivalent operations and effects to those in the first embodiment. Specifically, in the EGR gas distributor 71 (the EGR passage) in the present embodiment, when the heating films 72 are energized through the corresponding positive electrode 77 and negative electrode 78, the heating films 72 generate heat, thereby heating the casings 81 and 82 from each outer wall side and thus heating the inner wall of the gas chamber 74 (the gas passage). Thus, arbitrarily controlling the energization of each heating film 72 adjusts the temperature of the inner wall of the gas chamber 74 provided with the heating films 72 and the temperature rise. This configuration can increase the temperature of the inner wall of the EGR gas distributor 71 (the EGR passage) with good responsivity and keep the temperature stable. Consequently, it is possible to prevent generation and freezing of condensed water inside the EGR gas distributor 71.

According to the configuration in the present embodiment, in which the heating films 72 are provided on the outer wall of the EGR gas distributor 71 (the upper casing 81 and the lower casing 82) made of resin, the following advantages can be provided.

(1) Each heating film 72 is less likely to be corroded by EGR gas flowing through the inside of the EGR gas distributor 71 and condensed water generated therein, resulting in a reduced necessity of countermeasures against corrosion.

(2) Each heating film 72 does not vary with stress caused by fluctuation of intake pressure (between −85 kPa and atmospheric pressure) in the intake passage 2.

(3) Each heating film 72 can be provided by baking onto the outer wall of the EGR gas distributor 71 after the EGR gas distributor 71 is molded, that is, the flexibility in design and process can be improved.

(4) Each heating film 72 can be provided by attaching onto the outer wall of the EGR gas distributor 71 after the EGR gas distributor 71 is molded.

On the other hand, according to the present embodiment configured as above, conceivable disadvantages which may be caused by the heating films 72 provided on the outer wall of the EGR gas distributor 71 made of resin can be addressed by the following manners.

Figure 54:
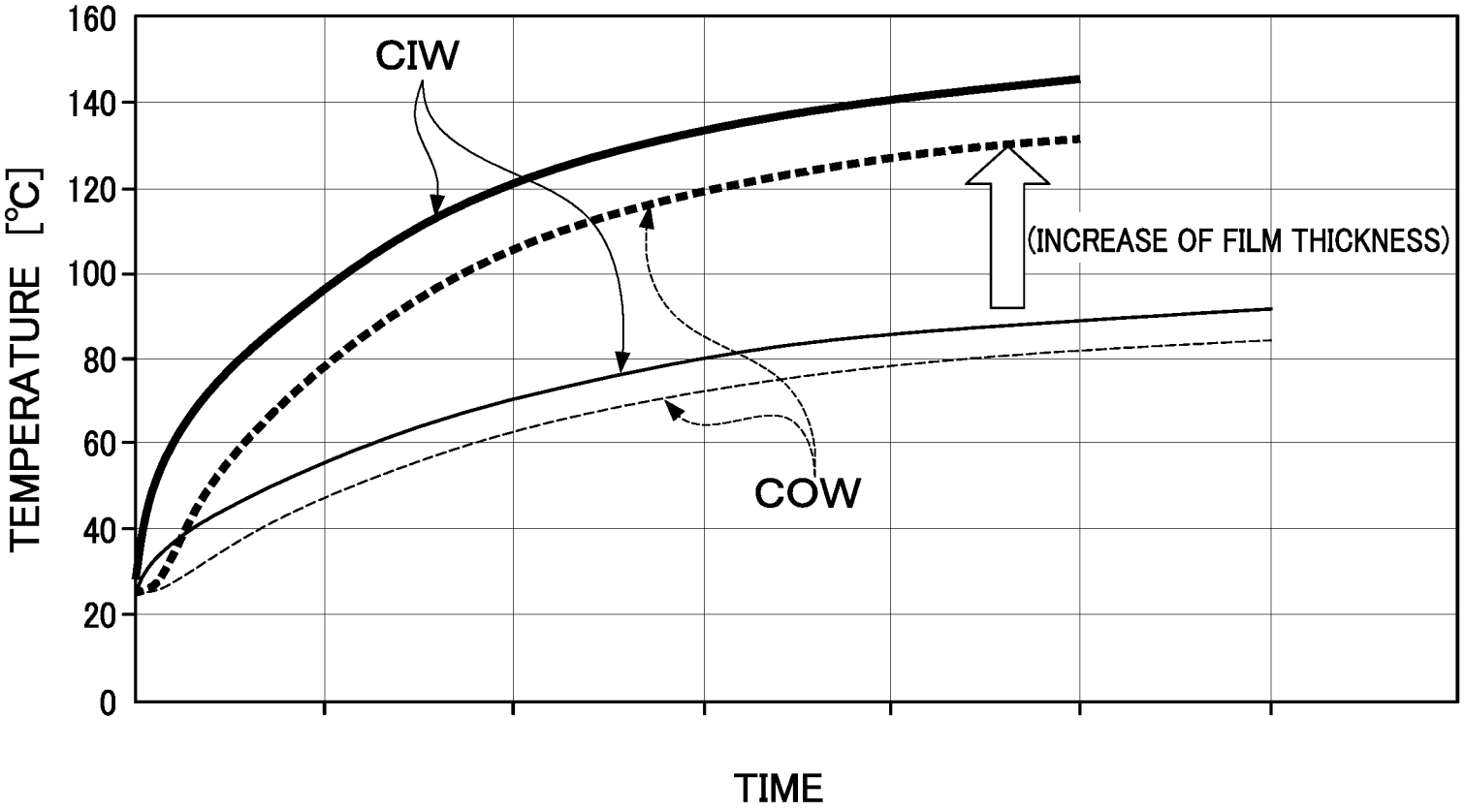
FIG. 54 is a graph showing a temperature-rising property of an inner wall of a resin passage by heat of a heating film by comparison between a case where the heating film is provided on the inner wall of the resin passage (a thick solid line and solid line) and a case where the heating film is provided on an outer wall (a thick broken line and a broken line) in the twenty-second embodiment.

(1) The temperature rising property of the inner wall of the EGR gas distributor 71 (the upper casing 81 and the lower casing 82) deteriorates. This problem can be addressed by increasing the thickness of the heating film 72. FIG. 54 is a graph showing a temperature-rising property of the inner wall of a resin passage by heat of a heating film by comparison between a case CIW where the heating film is provided on the inner wall of the resin passage (a thick solid line and a solid line) and a case COW where the heating film is provided on an outer wall (a thick broken line and a broken line). In the case CIW where the heating film is provided on the inner wall, the thick solid line indicates that the heating film is thick and the solid line indicates that the heating film is thin. In the case COI where the heating film is provided on the outer wall, the thick broken line indicates that the heating film is thick and the broken line indicates that the heating film is thin. This graph reveals that even in the case COW with the heating film provided on the outer wall, the heating film increased in thickness can have the temperature-rising property close to that in the case CIW with the heating film provided on the inner wall.

(2) When a vehicle is subjected to high-pressure cleaning, the splash of water on the heating film 72 of the EGR gas distributor placed in an engine compartment becomes a problem. This problem can be addressed because the heating film 72 itself is dried by energization.

(3) The heating film 72 on the EGR gas distributor 71 provided in an engine compartment may be damaged by contact with flipped stone during traveling of a vehicle. This problem can be addressed by a cover or the like placed on at least the heating film 72.

Twenty-Third Embodiment

Next, a twenty-third embodiment will be described in detail with reference to the accompanying drawings.

(Sticking Manner (1) of Film Such as a Heating Film)

Figure 55:
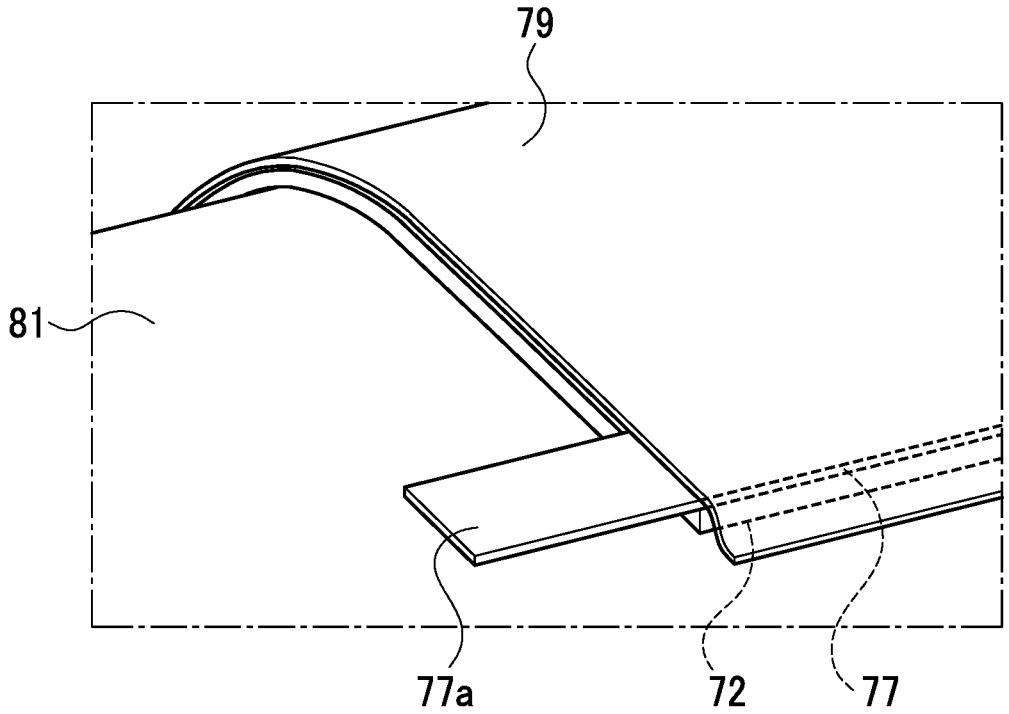
FIG. 55 is an enlarged perspective view of a part including a heating film and a positive terminal provided on an outer wall of an upper casing in a twenty-third embodiment.
Figure 56:
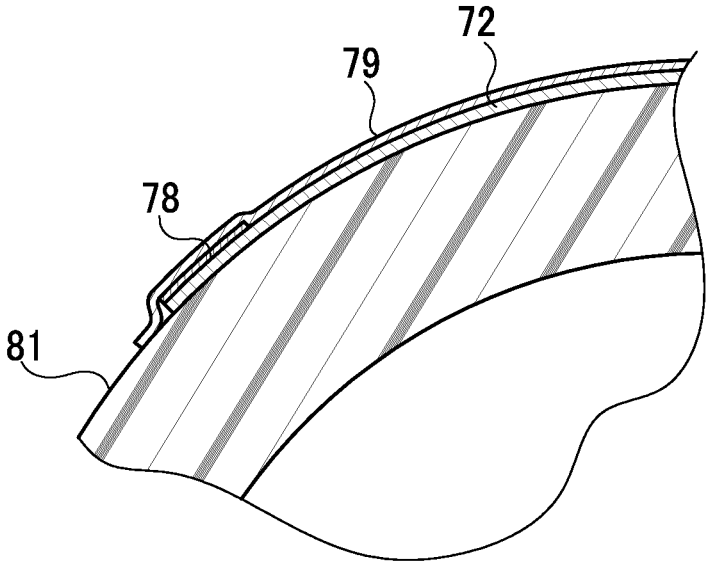
FIG. 56 is an enlarged cross-sectional view conforming to FIG. 53 and showing a part of a heating film and others provided on the outer wall of the upper casing in the twenty-third embodiment.

In the present embodiment, a concrete example of the case where the heating film 72 is stuck on the outer wall of the EGR gas distributor 71 after the EGR gas distributor 71 is molded will be described below. FIG. 55 is an enlarged perspective view of the heating film 72 provided on the outer wall of the upper casing 81 and the positive terminal 77*a*. FIG. 56 is an enlarged cross-sectional view conforming to FIG. 53 and showing a part of the heating film 72 provided on the outer wall of the upper casing 81 and others. In the present embodiment, as shown in FIGS. 55 and 56, the heating film 72, positive electrode 77 and positive terminal 77*a*, and negative electrode 78 and positive terminal (not shown), are provided in advance integrally with a film 79. This integrated film 79 and others are stuck on the outer wall of the upper casing 81 with adhesive or the like. In the present embodiment, the positive electrode 77 and the negative electrode 78 are placed on the heating film 72 and further those heating film 72 and electrodes 78 and 78 are covered by the film 79.

The EGR system configured in the present embodiment can provide the equivalent operations and effects to the twenty-second embodiment. In the present embodiment, additionally, the heating film 72 and each electrode 77 and 78 are covered by the film 79, so that the heating film 72 and each electrode 77 and 78 are protected.

Twenty-Fourth Embodiment

Next, a twenty-fourth embodiment will be described in detail with reference to the accompanying drawings.

(Sticking Manner (2) of Film Such as a Heating Film)

Figure 57:
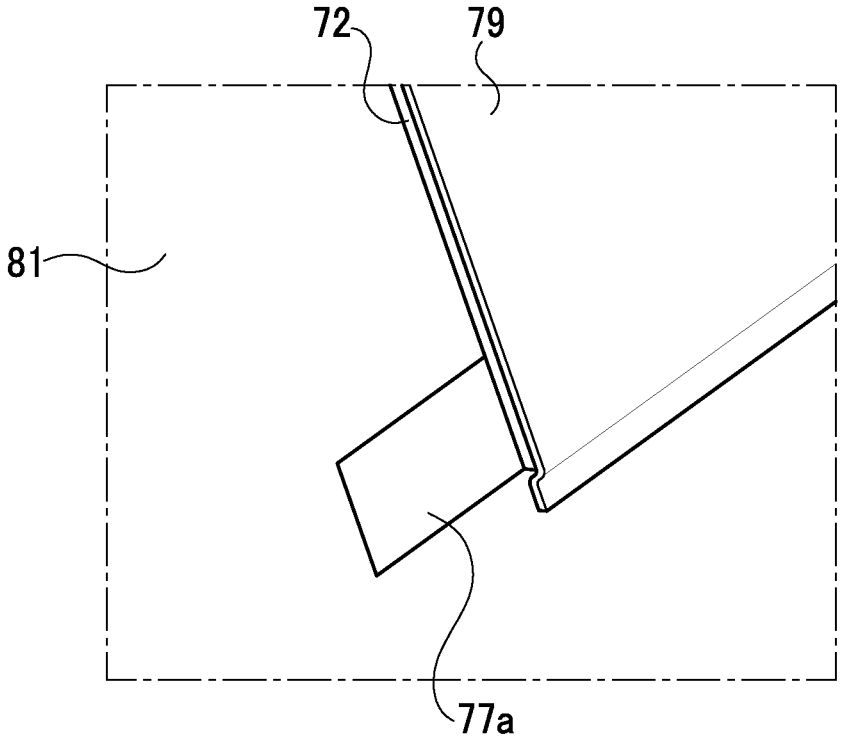
FIG. 57 is an enlarged perspective view of a part including a heating film and a positive terminal provided on an outer wall of an upper casing in a twenty-fourth embodiment.
Figure 58:
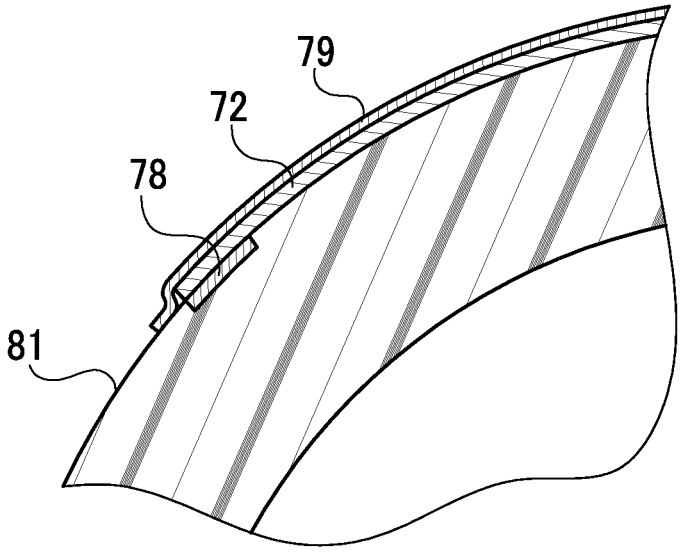
FIG. 58 is an enlarged cross-sectional view conforming to FIG. 53 and showing a part of a heating film and others provided on the outer wall of the upper casing in the twenty-fourth embodiment.

In the present embodiment, similarly, a concrete example of the case where the heating film 72 is stuck on the outer wall of the EGR gas distributor 71 after the EGR gas distributor 71 is molded will be described below. FIG. 57 is an enlarged perspective view of the heating film 72 provided on the outer wall of the upper casing 81 and the positive terminal 77*a*. FIG. 58 is an enlarged cross-sectional view conforming to FIG. 53 and showing a part of the heating film 72 provided on the outer wall of the upper casing 81 and others. In the present embodiment, as shown in FIGS. 57 and 58, a positive electrode (not shown) and the positive terminal 77*a*, and, the negative electrode 78 and a negative terminal (not shown) are insert-molded in advance in the upper casing 81. Further, the heating film 72 is provided in advance integrally with the film 79. Then, the heating film 72 integral with the film 79 is stuck on the outer wall of the upper casing 81 with adhesive and the like so that the heating film 72 contacts with or electrically connects to each of the electrodes 77 and 78. In the present embodiment, the electrodes 77 and 78 are covered by the heating film 72 and further this heating film 72 is covered by the film 79.

The EGR system configured in the present embodiment can provide the equivalent operations and effects to the twenty-second embodiment. In the present embodiment, additionally, the heating film 72 is covered by the film 79 and thus the heating film 72 can be protected.

The present disclosure is not limited to each of the foregoing embodiments and may be embodied in other specific forms without departing from the essential characteristics thereof.

Figure 59:
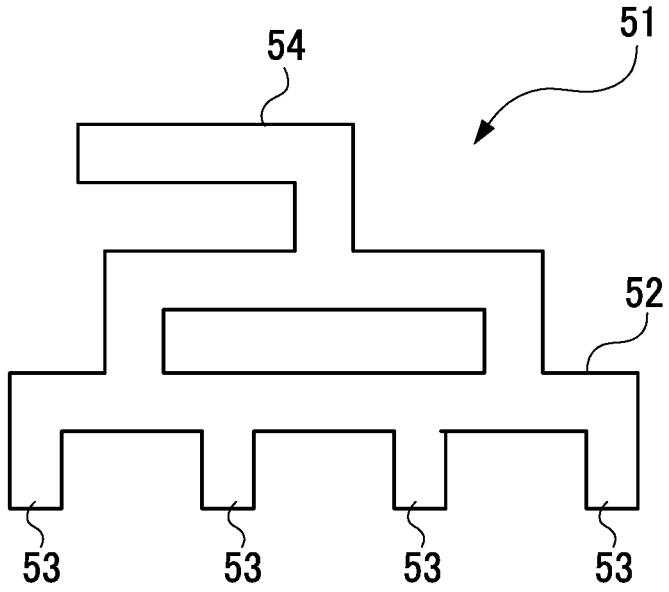
FIG. 59 is a plan view of an EGR gas distributor in another embodiment.
Figure 60:
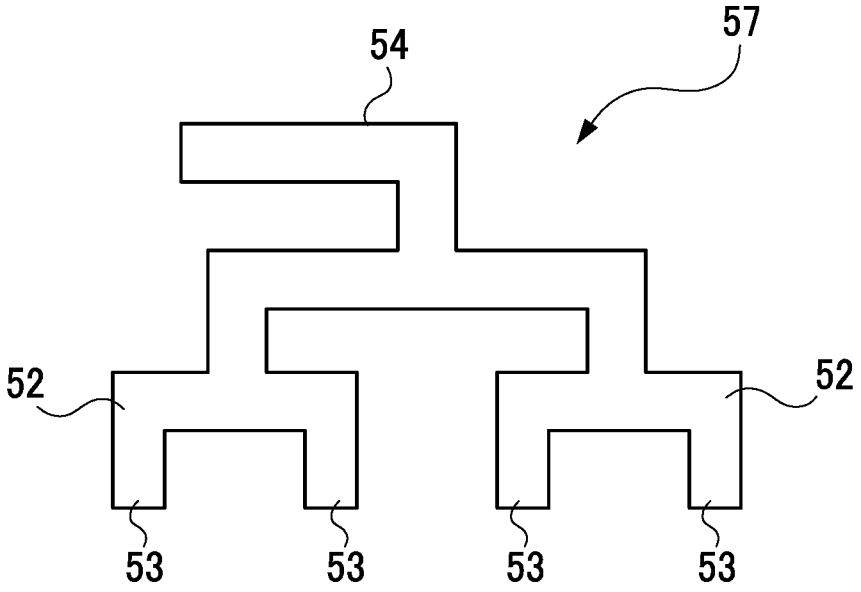
FIG. 60 is a plan view of an EGR gas distributor in another embodiment.

(1) In the first to sixteenth embodiments, as shown in FIG. 4, the EGR gas distributor 15 is constituted of the gas inflow passage 21 (including the passage part 21*a* and the two branch passage parts 21*b* and 21*c*), the single gas chamber 22 (having the inner diameter larger than the inner diameter of the gas inflow passage 21), and the four gas distribution passages 23 (each having the inner diameter smaller than each of the inner diameter of the gas inflow passage 21 and the inner diameter of the gas chamber 22). As an alternative, an EGR gas distributor 51 may be configured, as shown in a plan view in FIG. 59, that a gas chamber 52 and gas distribution passages 53 may be each designed with the same inner diameter as that of a gas inflow passage 54. As another alternative, an EGR gas distributor 57 may be entirely configured in a tournament form by division of the gas chamber 52 in FIG. 59 at its middle portion into two as shown in a plan view of FIG. 60.

(2) In the seventh embodiment, the EGR gas distributor 15 including the passage part 21*a*, branch passage parts 21*b* and 21*c*, and gas chamber 22 (the plurality of portions) provided thereon with the heating films 29 and 30 is configured such that the thickness of the heating films 29 and 30 in the gas chamber 22 (the specific portion) is set larger than the thickness of the heating films 29 and 30 in the passage part 21*a* and branch passage parts 21*b* and 21*c* (other portions) in order to set the temperature of the inner wall of the gas chamber 22 (the specific portion) higher than the temperatures of the inner walls of the passage part 21*a* and the branch passage parts 21*b* and 21*c* (the other portions). As an alternative, the EGR gas distributor including a plurality of different portions provided with the heating films may be configured such that the interelectrode distance (the shortest distance) between the positive electrode and the negative electrode provided to the heating film in the specific portion is set shorter than the interelectrode distance between the positive and negative electrodes provided to the heating film in the other portions in order to set the temperature of the inner wall of the specific portion higher than the temperature of the inner wall of the other portions.

(3) The twenty-second embodiment describes that the heating film 72 is provided on the outer wall of the EGR gas distributor 71 (the upper casing 81 and the lower casing 82). As an alternative, the characteristic configurations in the second to sixteenth, nineteenth, and twentieth embodiments may be rationally modified to the configuration that a heating film is provided on an outer wall of an EGR gas distributor or may be rationally changed to the configuration in the twenty-first embodiment that a heating film is provided on an outer wall of an intake passage (including an intake manifold) through which the EGR gas is allowed to flow.

(4) The twenty-third and twenty-fourth embodiments show that the film sticking manner to stick the heating film 72 and others together with the film 79 onto the outer wall of the upper casing 81. As an alternative, the heating film may be stuck together with a film onto an inner wall of a casing to the same effects. In this case, the heating film can be protected from corrosion due to condensed water generated inside the casing.

INDUSTRIAL APPLICABILITY

The present disclosure is applicable to an intake passage through which the EGR gas is allowed to flow and an EGR passage in a gasoline engine and a diesel engine.

REFERENCE SIGNS LIST

1 Engine
2 Intake passage
3 Exhaust passage
5 Intake manifold (Intake passage)
5*b* Branch pipe
12 EGR passage
15 EGR gas distributor (EGR passage)
21 Gas inflow passage (Gas passage)
22 Gas chamber (Gas passage)
23 Gas distribution passage
24*a* Inlet flange
25 Metal collar (Conductive member)
25*a* Ground wire
26 Upper casing
27 Lower casing
27*b* Projection
27*c* Depression
28 Microscopic projections and depressions
29 Upper heating film
30 Lower heating film
31 Upper positive electrode
32 Upper negative electrode
33 Lower positive electrode
34 Lower negative electrode
35 Heating film
36 Left casing
37 Right casing
39 Positive electrode
40 Negative electrode
41 Casing
42 Heating film
43 Heating film
44 Corrosion-resistant material
45 Insulating material
47 Microscopic projections and depressions (Close contact means)
48 Upset parts (Close contact means)
51 EGR gas distributor (EGR passage)
52 Gas chamber (Gas passage)
53 Gas distribution passage (Gas passage)
54 Gas inflow passage (Gas passage)
57 EGR gas distributor (EGR passage)
61 Heat-insulating film
63 Interface
65*a* Outside mating surface
65*b* Inside mating surface
67*a* Outside 67*a* thick film portion
67*b* Inside thick film portion
71*a* EGR gas distributor (EGR passage)
72 Heating film
74 Gas chamber (Gas passage)
75 Gas distribution passage (Gas passage)
76 Branch passage
77 Positive electrode
78 Negative electrode
81 Upper casing
82 Lower casing

What is claimed is:

1. An EGR system configured to allow a part of exhaust gas discharged from an engine to an exhaust passage to flow as an EGR gas to an intake passage through an EGR passage to return to the engine, wherein each of the intake passage through which the EGR gas is allowed to flow and the EGR passage includes an inner wall and an outer wall, the inner wall of at least one of the intake passage through which the EGR gas is allowed to flow and the EGR passage is provided with a heating film, and the EGR system further includes at least one pair of a positive electrode and a negative electrode to energize the heating film.

2. The EGR system according to claim 1 further including at least one positive electrode or at least one negative electrode, wherein the positive electrodes and the negative electrodes are alternately arranged in a specific direction of the heating film.

3. The EGR system according to claim 1, wherein the engine includes a plurality of cylinders, the intake passage includes an intake manifold having a plurality of branch pipes configured to distribute intake air to the plurality of cylinders of the engine, the EGR passage includes an EGR gas distributor configured to distribute the EGR gas to the plurality of branch pipes, the EGR gas distributor includes:

a plurality of gas distribution passages arranged side by side and configured to distribute the EGR gas to the plurality of branch pipes; and a gas passage branched off to flow the EGR gas to the gas distribution passage, each of the gas passage and the gas distribution passages includes an inner wall and an outer wall, and the gas passage and the gas distribution passages are configured such that the inner wall or the outer wall of at least the gas passage is provided thereon with the heating film.

4. The EGR system according to claim 3, wherein the EGR gas distributor includes a plurality of different portions provided with the heating films, and the different portions are different in at least one of a thickness of the heating film and a shortest distance between the positive electrode and the negative electrode according to a difference in inner diameter or inner circumferential length of the inner wall in order to adjust a temperature of the inner walls of the different portions provided with the heating films to be equal to each other or to a required temperature of the different portions.

5. The EGR system according to claim 3, wherein
the EGR gas distributor includes a plurality of different portions on which the heating films are provided, and
the different portions are configured such that a thickness of the heating film on a specific portion of the different portions provided with the heating films is set larger than each thickness of the heating films of other portions or a shortest distance between the positive electrode and the negative electrode provided to the heating film on the specific portion is set shorter than a shortest distance between the positive electrode and the negative electrode provided to each of the heating films of the other portions in order to set a temperature of the inner wall of the specific portion higher than each temperature of the inner walls of the other portions.

6. The EGR system according to claim 3, wherein
the EGR gas distributor includes a specific portion, and
the specific portion includes a portion located most downstream in the gas passage and provided with microscopic projections and depressions in the inner wall or the outer wall.

7. The EGR system according to claim 1, wherein
each of the intake passage through which the EGR gas is allowed to flow and the EGR passage is constituted of a plurality of members, and
the heating film is provided on at least one inner wall or at least one outer wall of the plurality of members constituting at least one of the intake passage through which the EGR gas is allowed to flow and the EGR passage.

8. The EGR system according to claim 1, wherein
the EGR gas distributor includes a first casing and a second casing,
the heating film includes a first heating film and a second heating film,
the first casing is provided with the first heating film and the second casing is provided with the second heating film,
the positive electrode includes a first positive electrode and a second positive electrode, and the negative electrode includes a first negative electrode and a second negative electrode,
the first heating film is provided with at least the first positive electrode and the first negative electrode, the second heating film is provided with at least the second positive electrode and the second negative electrode,
a first interelectrode distance is set as a shortest distance between the first positive electrode and the first negative electrode, and a second interelectrode distance is set as a shortest distance between the second positive electrode and the second negative electrode, and
the first heating film and the second heating film each have a thickness set according to a difference between the first interelectrode distance and the second interelectrode distance in order to adjust a temperature of the inner walls to be equal to each other between the first casing and the second casing or to a required temperature of the first casing and the second casing.

9. The EGR system according to claim 1, wherein the heating film includes a multi-layered part located at a position corresponding to at least each of the positive electrode and the negative electrode.

10. The EGR system according to claim 1, wherein the heating film includes a surface located at a position corresponding to each of the positive electrode and the negative electrode, and the surface is provided with a corrosion-resistant material.

11. The EGR system according to claim 1, wherein the heating film includes a surface, and the surface is provided with an insulating material.

12. The EGR system according to claim 1, wherein the intake passage through which the EGR gas is allowed to flow and the EGR passage are made of an electric conductive material, the inner wall or the outer wall is provided with an insulating material, and the heating film is placed on the insulating material.

13. The EGR system according to claim 1, further including a close contact means provided between the heating film and the inner wall or the outer wall of at least one of the intake passage and the EGR passage, the inner wall or the outer wall being provided with the heating film, the close contact means being configured to keep a close contact relation between the inner wall or outer wall and the heating film.

14. The EGR system according to claim 1, wherein
the intake passage through which the EGR gas is allowed to flow and the EGR passage include a joint connected to a target member,
the joint is provided with a conductive member, and
the conductive member is connected to a ground wire of the heating film.

15. The EGR system according to claim 1, further including a heat-insulating film for heat insulation in at least a part between the inner wall of at least one of the intake passage and the EGR passage, the inner wall being provided with the heating film, and the heating film.

16. The EGR system according to claim 15, wherein
the inner wall provided with the heat-insulating film has an uneven surface formed with a plurality of projections and a plurality of depressions, and
the heat-insulating film is placed in each of the plurality of depressions and the heating film is held on the plurality of the projections.

17. The EGR system according to claim 1, wherein
the positive electrode and the negative electrode are provided to be exposed at a surface of the inner wall or the outer wall and the heating film is provided to cover the positive electrode and the negative electrode,
the positive electrode and the inner wall or the outer wall are mated through a mating surface including an inside mating surface that faces inward to the negative electrode, the negative electrode and the inner wall or the outer wall are mated through a mating surface including an inside mating surface that faces inward to the positive electrode, and
the heating film is provided on at least a portion including the inside mating surface between the positive electrode and the inner wall or the outer wall and a portion including the inside mating surface between the negative electrode and the inner wall or the outer wall so that the heating film has a larger thickness than other portions.

18. The EGR system according to claim 10, wherein
the heating film includes an edge portion, and
the corrosion-resistant material is further provided on a portion of the heating film including an interface between the edge portion and the inner wall or the outer wall.

* * * * *